US005864814A

United States Patent [19]

Yamazaki

[11] Patent Number: 5,864,814

[45] Date of Patent: Jan. 26, 1999

[54] VOICE-GENERATING METHOD AND APPARATUS USING DISCRETE VOICE DATA FOR VELOCITY AND/OR PITCH

[75] Inventor: Nobuhide Yamazaki, Yokohama, Japan

[73] Assignee: Justsystem Corp., Tokushima, Japan

[21] Appl. No.: 828,643

[22] Filed: Mar. 31, 1997

[30] Foreign Application Priority Data

Dec. 4, 1996 [JP] Japan ..... 8-324458

[51] Int. Cl.[6] ..... G10L 5/04

[52] U.S. Cl. ..... 704/268; 704/270

[58] Field of Search ..... 704/270, 272, 704/246, 250, 207, 254, 258, 263, 264, 265, 266, 267, 268, 208, 276, 260, 247; 379/88

[56] References Cited

U.S. PATENT DOCUMENTS

| | | | |
|---|---|---|---|
| 4,405,838 | 9/1983 | Nitta et al. | 704/254 |
| 4,833,713 | 5/1989 | Muroi | 704/247 |
| 4,912,768 | 3/1990 | Benbassat | 381/52 |
| 4,964,167 | 10/1990 | Kunizawa et al. | 704/260 |
| 5,381,466 | 1/1995 | Shibayama et al. | 379/88 |
| 5,446,238 | 8/1995 | Kayama et al. | 84/669 |
| 5,633,984 | 5/1997 | Tkashi et al. | 704/260 |
| 5,734,119 | 3/1998 | France et al. | 84/622 |

FOREIGN PATENT DOCUMENTS

| | | |
|---|---|---|
| 60-102697 | 6/1985 | Japan . |
| 60-216395 | 10/1985 | Japan . |
| 61-87199 | 5/1986 | Japan . |
| 62-284398 | 12/1987 | Japan . |
| 63-191454 | 8/1988 | Japan . |
| 63-262699 | 10/1988 | Japan . |
| 2-58100 | 2/1990 | Japan . |
| 2-84700 | 3/1990 | Japan . |
| 3-160500 | 7/1991 | Japan . |
| 5-52520 | 8/1993 | Japan . |
| 5-232992 | 9/1993 | Japan . |
| 5-281984 | 10/1993 | Japan . |

*Primary Examiner*—Richemond Dorvil
*Attorney, Agent, or Firm*—Sughrue, Mion, Zinn, Macpeak & Seas, PLLC

[57] ABSTRACT

An information communication system, having host and remote terminal devices, and method for generating a voice in which one voice tone data is selected from a plurality of types of voice tone data and stored according to received voice generating information. The voice is reproduced by generating a voice waveform according to a meter pattern and selected voice tone data. The discrete voice data may be presented for either one or both of velocity and pitch of a voice correlated to a time lag between discrete voice data. The discrete data is dispensed so that each voice data is not dependent on a time lag between phonemes and at the same time is present at a level relative to a reference value. Voice tone data indicating a sound parameter for each voice element such as a phoneme for each voice tone type is stored in a voice tone data storing section in a terminal device. File information is transferred from a host device to a terminal device according to a request from the terminal device, and the terminal device reads out voice tone data specified by the voice-generating information in the file information thereto from a voice tone storing section. A voice is synthesized according to the voice tone data and the voice generating information.

243 Claims, 40 Drawing Sheets

FIG.2

11

| FILE NAME | FILE INFORMATION | | | |
|---|---|---|---|---|
| | VOICE-GENERATING INFORMATION | | IMAGE INFORMATION | PROGRAM INFORMATION |
| A | HDRA | PRSA | IMGA | PROA |
| B | HDRB | PRSB | IMGB | PROB |
| C | HDRC | PRSC | IMGC | PROC |
| ⋮ | ⋮ | ⋮ | ⋮ | ⋮ |

FIG.3

HDRA

| PHONEME GROUP | LANGUAGE | TIME RESOLUTION | VOICE TONE SPECIFYING DATA | PITCH REFERENCE | VOLUME REFERENCE |
|---|---|---|---|---|---|
| PG | LG | TD | VP | PB | VB |

FIG.6
| VL | VELOCITY |
|---|---|
| 0 | SILENCE |
| 1 | ppp |
| 2 | pp |
| 3 | mp |
| 4 | STANDARD |
| 5 | mf |
| 6 | ff |
| 7 | fff |
FIG.7A
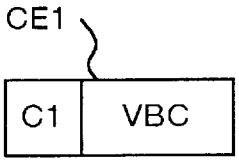
FIG.7B
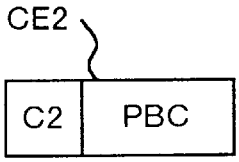

FIG.9

211

| SELECTION No. | VOICE TONE DATA |
|---|---|
| 1 | VD1(PB1) |
| 2 | VD2(PB2) |
| ⋮ | ⋮ |

FIG.11

33A

| CODE | CHARACTER | CODE | CHARACTER | CODE | CHARACTER | CODE | CHARACTER | CODE | CHARACTER | CODE | CHARACTER | CODE | CHARACTER | CODE | CHARACTER | CODE | CHARACTER |
|---|---|---|---|---|---|---|---|---|---|---|---|---|---|---|---|---|---|
| 00h | 、(COMMA) | 10h | GU | 20h | ZE | 30h | DO | 40h | PA | 50h | FI | 60h | GYO | 70h | CHE | 80h | MYU |
| 01h | 。(PERIOD) | 11h | GE | 21h | ZO | 31h | NA | 41h | PI | 51h | FU | 61h | GUYA | 71h | CHO | 81h | MYO |
| 02h | TTSU | 12h | GO | 22h | TA | 32h | NI | 42h | PU | 52h | FE | 62h | GUYU | 72h | DYU | 82h | RYA |
| 03h | A | 13h | NGA | 23h | TI | 33h | NU | 43h | PE | 53h | FO | 63h | GUYO | 73h | NYA | 83h | RYU |
| 04h | I | 14h | NGI | 24h | TU | 34h | NE | 44h | PO | 54h | WA | 64h | SYA | 74h | NYU | 84h | RYO |
| 05h | U | 15h | NGU | 25h | TE | 35h | NO | 45h | MA | 55h | WI | 65h | SYU | 75h | NYO | | |
| 06h | E | 16h | NGE | 26h | TO | 36h | HA | 46h | MI | 56h | WE | 66h | SYE | 76h | HYA | | |
| 07h | O | 17h | NGO | 27h | TSA | 37h | HI | 47h | MU | 57h | WO | 67h | SYO | 77h | HYU | | |
| 08h | N | 18h | SA | 28h | TSI | 38h | HU | 48h | ME | 58h | YA | 68h | JA | 78h | HYO | | |
| 09h | KA | 19h | SI | 29h | TSU | 39h | HE | 49h | MO | 59h | YU | 69h | JI | 79h | BYA | | |
| 0Ah | KI | 1Ah | SU | 2Ah | TSE | 3Ah | HO | 4Ah | RA | 5Ah | YO | 6Ah | JU | 7Ah | BYU | | |
| 0Bh | KU | 1Bh | SE | 2Bh | TSO | 3Bh | BA | 4Bh | RI | 5Bh | KYA | 6Bh | JE | 7Bh | BYO | | |
| 0Ch | KE | 1Ch | SO | 2Ch | DA | 3Ch | BI | 4Ch | RU | 5Ch | KYU | 6Ch | JO | 7Ch | PYA | | |
| 0Dh | KO | 1Dh | ZA | 2Dh | DI | 3Dh | BU | 4Dh | RE | 5Dh | KYO | 6Dh | CHA | 7Dh | PYU | | |
| 0Eh | GA | 1Eh | ZI | 2Eh | DU | 3Eh | BE | 4Eh | RO | 5Eh | GYA | 6Eh | CHI | 7Eh | PYO | | |
| 0Fh | GI | 1Fh | ZU | 2Fh | DE | 3Fh | BO | 4Fh | FA | 5Fh | GYU | 6Fh | CHU | 7Fh | MYA | | |

FIG.12

33B

| CODE | CHARACTER | CODE | CHARACTER | CODE | CHARACTER | CODE | CHARACTER |
|---|---|---|---|---|---|---|---|
| A0h | U/KA | B0h | U/TSI | C0h | U/FU | D0h | U/HYU |
| A1h | U/KI | B1h | U/TSU | C1h | U/FE | D1h | U/HYO |
| A2h | U/KU | B2h | U/TSE | C2h | U/FO | D2h | U/PYA |
| A3h | U/KE | B3h | U/TSO | C3h | U/KYA | D3h | U/PYU |
| A4h | U/KO | B4h | U/HA | C4h | U/KYU | D4h | U/PYO |
| A5h | U/SA | B5h | U/HI | C5h | U/KYO | | |
| A6h | U/SHI | B6h | U/HU | C6h | U/SYA | | |
| A7h | U/SU | B7h | U/HE | C7h | U/SYU | | |
| A8h | U/SE | B8h | U/HO | C8h | U/SYE | | |
| A9h | U/SO | B9h | U/PA | C9h | U/SYO | | |
| AAh | U/TA | BAh | U/PI | CAh | U/CHA | | |
| ABh | U/TI | BBh | U/PU | CBh | U/CHI | | |
| ACh | U/TU | BCh | U/PE | CCh | U/CHU | | |
| ADh | U/TE | BDh | U/PO | CDh | U/CHE | | |
| AEh | U/TO | BEh | U/FA | CEh | U/CHO | | |
| AFh | U/TSA | BFh | U/FI | CFh | U/HYA | | |

FIG.14

26

| FILE NAME | FILE INFORMATION | | | |
|---|---|---|---|---|
| | VOICE-GENERATING INFORMATION | | IMAGE INFORMATION | PROGRAM INFORMATION |
| A | HDRA | PRSA | IMGA | PROA |
| D | HDRD | PRSD | IMGD | PROD |
| ⋮ | ⋮ | ⋮ | ⋮ | ⋮ |

FIG.38

HDRX

| PHONEME GROUP | LANGUAGE | TIME RESOLUTION | VOICE TONE SPECIFYING DATA | PITCH REFERENCE | VOLUME REFERENCE | ATTRIBUTE OF VOICE TONE |
|---|---|---|---|---|---|---|
| PG | LG | TD | VP | PB | VB | AT |

FIG.39

AT

| SEX | AGE | PITCH REFERENCE | CLEARNESS | NATURALITY |
|---|---|---|---|---|
| SX | AG | PB | CL | NT |

FIG.40

43

| SELECTION No. | VOICE TONE DATA | ATTRIBUTE OF VOICE TONE |
|---|---|---|
| 1 | VD1 | AT1 |
| 2 | VD2 | AT2 |
| ⋮ | ⋮ | ⋮ |

FIG.41

AT1

| SEX | AGE | PITCH REFERENCE | CLEARNESS | NATURALITY |
|---|---|---|---|---|
| SX1 | AG1 | PB1 | CL1 | NT1 |

VOICE-GENERATING METHOD AND APPARATUS USING DISCRETE VOICE DATA FOR VELOCITY AND/OR PITCH

FIELD OF THE INVENTION

The present invention relates to an information communication system and a method for the same for regenerating media information such as a voice by executing data communications between communication apparatuses through a communication network such as the Internet, an information processing apparatus and a method for the same for making and editing information for regenerating media information such as a voice by executing data communications between communication apparatuses through a communication network such as the Internet.

BACKGROUND OF THE INVENTION

In the Internet having remarkably developed in recent years, for the purpose to deliver a voice from a server to a client, there has been employed the technology to compress a voice into a form of waveform data (.wav or .au) and transfer the waveform.

In the Internet, there is a tendency that users do not want to download a home page including a large quantity of data to be transferred. Thus, it is a key to popularization of voice communications to enable the transfer of waveform data having a large data size as a small quantity of data to be transferred.

To solve the problems relating to a transfer rate in voice communications as described above, there is, for instance, the technology disclosed in Japanese Patent Publication No. HEI 5-52520. This publication discloses the technology in which a voice is divided into voice source information and voice route information corresponding to the voice source information. The voice source information and voice route information corresponding to each other are then synthesized into a voice when desired.

However, as the Internet is a communication network utilized by many unspecified persons, generally a client accesses arbitrary voice source information, namely voice-generating information from a server, and fetches the voice-generating information. In this process, the client cannot confirm whether the prepared voice route information, namely voice tone information, is identical to the accessed voice-generating information or not.

For this reason, if a speaker providing voice tone information is identical to a speaker providing the voice-generating information, and at the same time conditions for making the voice tone information are the same as those for making the voice-generating information, there is no problem in reproducibility of a voice by means of voice synthesis. However, if the speakers or conditions are different, as an amplitude is specified as an absolute amplitude level and voice pitch is specified as an absolute pitch frequency, an amplitude pattern inherent to the voice tone information is not reflected, and there is the possibility that the voice may be inappropriately reproduced when synthesized.

SUMMARY OF THE INVENTION

It is an object of the present invention to obtain an information communication system in which high quality in voice synthesis can be maintained by obtaining an optimal correspondence between voice-generating information and voice tone information without fixing the correspondence.

It is another object of the present invention to obtain an information processing apparatus in which it is possible to easily make and edit information for maintaining high quality in voice synthesis with the information communication system described above.

It is another object of the present invention to obtain an information communicating method in which high quality in voice synthesis can be maintained by obtaining an optimal correspondence between voice-generating information and voice tone information without fixing the correspondence.

It is another object of the invention to obtain an information processing method in which it is possible to easily make and edit information for maintaining high quality in voice synthesis with the information communication system described above.

With the present invention, file information including voice-generating information is transferred from a first communicating apparatus to a second communicating apparatus. In the second communicating apparatus, meter patterns arranged successively in the direction of a time axis are developed according to the velocity or pitch of a voice, each not being dependent on a phoneme, and a voice waveform is made according to the phoneme patterns as well as to the voice tone data selected according to the voice-generating information, so that a voice can be reproduced with a preferable type of voice tone without limiting the voice tone to a particular type. Also, the displacement in patterns of voice pitch is not generated when the voice waveform is synthesized. As a result, it is possible to maintain high quality of a voice in voice synthesis by obtaining the most suitable correlation between voice-generating information and voice tone information without fixing the correlation between them.

With the present invention, file information including voice-generating information is transferred from a first communicating apparatus to a second communicating apparatus. In the second communicating apparatus, meter patterns arranged successively in the direction of a time axis are developed according to velocity or pitch of a voice, each not dependent on a phoneme. A voice waveform is made according to the phoneme patterns as well as to the voice tone data selected according to information indicating a type of voice tone included in the voice-generating information. As a result, a voice can be reproduced with the most suitable type of voice tone directly specified from a plurality of types of voice tone without limiting voice tone to a particular type. Further, a displacement in patterns of voice pitch is not generated when the voice waveform is synthesized. As a result, it is possible to maintain the high quality of a voice in voice synthesis by obtaining the most suitable correlation between voice-generating information and voice tone information without fixing the correlation between them.

With the present invention, file information including voice-generating information is transferred from a first communicating apparatus to a second communicating apparatus. In the second communicating apparatus, meter patterns that are not dependent on a phoneme, and are arranged successively in the direction of a time axis, are developed according to the velocity or pitch of a voice. A voice waveform is generated according to the meter patterns as well as to voice tone data selected according to a similarity based on information indicating the attributes of the voice tone included in the voice-generating information. Thus, a voice can be reproduced with a type of voice tone having the highest similarity, without using any unsuitable type of voice tone. Also, displacement in patterns of voice pitch is not generated when the voice waveform is synthesized. As a result, it is possible to maintain the high quality of a voice in voice synthesis by obtaining the most suitable correlation between voice-generating information and voice tone information without fixing the correlation between them.

With the present invention, file information including voice-generating information is transferred from a first communicating apparatus to a second communicating apparatus. In the second communicating apparatus, meter patterns that are arranged successively in the direction of a time axis are developed according to the velocity or pitch of a voice that is not dependent on a phoneme. A voice waveform is generated according to the meter pattern as well as to voice tone data selected according to information indicating a type and attribute of voice tone included in voice-generating information. Thus, so that a voice can be reproduced with a type of voice tone having the highest similarity without using any unsuitable type of voice tone, even though the voice tone directly specified is not available. Also, The displacement in patterns of voice pitch is not generated when the voice waveform is synthesized. For this reason, it is possible to maintain high quality of a voice in voice synthesis by obtaining the most suitable correlation between voice-generating information and voice tone information without fixing the correlation between them.

With the present invention, file information including voice-generating information is transferred from a first communicating apparatus to a second communicating apparatus. In the second communicating apparatus, meter patterns that are arranged successively in the direction of a time axis are developed according to voice-generating information in the file information. A voice waveform is generated according to the meter pattern as well as to the voice tone data selected according to the voice-generating information. Thus, a voice can be reproduced with the most suitable voice tone without limiting the voice tone to any particular tone. Also, no displacement of the pattern is generated when the voice waveform is synthesized. Thus, it is possible to maintain a high voice quality in voice synthesis by obtaining the most suitable correlation between voice-generating information and voice tone information without fixing the correlation between them.

With the present invention, file information including voice-generating information is transferred from a first communicating apparatus to a second communicating apparatus. In the second communicating apparatus, meter patterns that are arranged successively in the direction of a time axis are developed according to voice-generating information that is included in the file information. A voice waveform is generated according to the meter patterns as well as to voice tone data selected according to information indicating a type of voice tone included in the voice-generating information. Thus, a voice can be reproduced with the most suitable type of voice tone directly specified from a plurality of types of voice tone without limiting voice tone to a particular type. Also, a displacement in patterns of voice pitch is not generated when the voice waveform is synthesized. As a result, it is possible to maintain a high voice quality when synthesizing a voice by obtaining the most suitable correlation between voice-generating information and voice tone information without fixing the correlation between them.

With the present invention, file information including voice-generating information is transferred from a first communicating apparatus to a second communicating apparatus. In the second communicating apparatus, meter patterns that are arranged successively in the direction of a time axis are developed according to voice-generating information that is included in the file information. A voice waveform is generated according to the meter patterns as well as to voice tone data selected according to similarity based on information indicating attributes of voice tone included in the voice-generating information. Thus, a voice can be reproduced with a type of voice tone having a highest similarity without using any unsuitable type of voice tone. Also, no displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, file information including voice-generating information is transferred from a first communicating apparatus to a second communicating apparatus. In the second communicating apparatus, meter patterns that are arranged successively in the direction of a time axis are developed according to voice-generating information included in the file information. A voice waveform is generated according to the meter patterns as well as to voice tone data selected according to information indicating a type and attribute of voice tone included in voice-generating information, so that the voice can be reproduced with a type of voice tone having the highest similarity without using any unsuitable type of voice tone even though the type of the voice tone directly specified is not available. Also, no displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, a reference for the pitch of a voice in a voice-generating information storing means is shifted according to a reference for pitch of a voice in a voice tone data storing means when the voice is reproduced, so that pitch of each voice relatively changes according to the shifted reference for voice pitch regardless of a time zone of each phoneme. As a result, the reference for voice pitch becomes closer to that for voice tone, which makes it possible to improve the quality of the voice.

With the present invention, a reference for voice pitch in a voice-generating information storing means is shifted according to an arbitrary reference for voice pitch when the voice is reproduced, so that pitch for each voice relatively changes according to the shifted reference of voice pitch regardless of a time zone of each phoneme. As a result, it is possible to execute voice processing such as making it closer to intended voice quality according to the shift rate.

With the present invention, voice-generating information is made by outputting discrete voice data for at least one of velocity and pitch of a voice based on an inputted natural voice so that each voice data is not dependent on a time lag between phonemes and has a level relative to a reference, and the voice-generating information is transferred to a first communicating apparatus to be registered in a file information storing means, so that it is possible to give velocity and pitch of a voice to the voice data that is not dependent on the time lag between phonemes at an arbitrary point of time.

With the present invention, there are provided the steps of transferring file information including voice-generating information from a first communicating apparatus to a second communicating apparatus, developing meter patterns successively in the direction of a time axis according to the velocity and pitch of a voice that is not dependent on a phoneme in the second communicating apparatus, and generating a voice waveform according to the meter patterns as well as to voice tone data selected according to the voice-generating information. Thus, a voice can be reproduced with a preferable type of voice tone without limiting the voice tone to a particular type. Also, no displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, there are provided the steps of transferring file information, including voice-generating information, from a first communicating apparatus to a second communicating apparatus, developing meter patterns successively in the direction of a time axis according to velocity and pitch of a voice that is not dependent on a phoneme in the second communicating apparatus, and generating a voice waveform according to the meter patterns as well as to voice tone data selected according to information indicating a type of voice tone included in the voice-generating information. Thus, a voice can be reproduced with the most suitable type of voice tone directly specified from a plurality of types of voice tone without limiting the voice tone to a particular type. Also, no displacement in patterns of voice pitch is generated when the voice waveform is synthesized. As a result, it is possible to maintain high voice quality in the voice synthesis by obtaining the most suitable correlation between voice-generating information and voice tone information without fixing the correlation between them.

With the present invention, there are provided the steps of transferring file information including voice-generating information from a first communicating apparatus to a second communicating apparatus, developing meter patterns that are arranged successively in the direction of a time axis according to the velocity and pitch of a voice that is not dependent on a phoneme in the second communicating apparatus, and generating a voice waveform according to the meter patterns as well as to voice tone data selected according to similarity based on information indicating attributes of voice tone included in the voice-generating information. Thus, a voice can be reproduced with a type of voice tone having a highest similarity without using any unsuitable type of voice tone. Also, displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, there are provided the steps of transferring file information, including voice-generating information, from a first communicating apparatus to a second communicating apparatus, developing meter patterns that are arranged successively in the direction of a time axis according to the velocity and pitch of a voice that is not dependent on a phoneme in the second communicating apparatus, and generating a voice waveform according to the meter patterns as well as to voice tone data selected according to information indicating a type and attribute of voice tone included in voice-generating information, so that the voice can be reproduced with a type of voice tone having highest similarity without using any unsuitable type of voice tone even though the type of voice tone directly specified is not available. Also, no displacement in patterns of voice pitch is generated when the voice waveform is synthesized. As a result, it is possible to maintain high voice quality of voice synthesis by obtaining the most suitable correlation between voice-generating information and voice tone information without fixing the correlation between them.

With the present invention, there are provided the steps of transferring file information, including voice-generating information, from a first communicating apparatus to a second communicating apparatus; developing meter patterns that are arranged successively in the direction of a time axis according to voice-generating information that is included in the file information, and generating a voice waveform according to the meter patterns as well as to voice tone data selected according to the voice-generating information. Thus, a voice can be reproduced with a preferable type of voice tone without limiting the voice tone to a particular type, and no displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, there are provided the steps of transferring file information, including voice-generating information, from a first communicating apparatus to a second communicating apparatus; developing meter patterns that are arranged successively in the direction of a time axis according to voice-generating information included in the file information, and generating a voice waveform according to the meter patterns as well as to voice tone data selected according to information indicating a type of voice tone included in the voice-generating information, so that a voice can be reproduced with the most suitable type of voice tone directly specified from a plurality of types of voice tone without limiting the voice tone to a particular type, and no displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, there are provided the steps of transferring file information, including voice-generating information, from a first communicating apparatus to a second communicating apparatus, developing meter patterns that are arranged successively in the direction of a time axis according to voice-generating information included in the file information, and generating a voice waveform according to the meter patterns as well as to voice tone data selected according to a similarity based on information indicating attributes of voice tone included in the voice-generating information. Thus, a voice can be reproduced with a type of voice tone having highest similarity without using any unsuitable type of voice tone. Also, no displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, there are provided the steps of transferring file information, including voice-generating information, from a first communicating apparatus to a second communicating apparatus, developing meter patterns that are arranged successively in the direction of a time axis according to voice-generating information included in the file information, and generating a voice waveform according to the meter patterns as well as to voice tone data selected according to information indicating a type and attribute of voice tone included in voice-generating information. Thus, the voice can be reproduced with a type of voice tone having a highest similarity without using an unsuitable type of voice tone even though there is not a directly specified type of the voice tone. Also, no displacement in patterns of voice pitch is generated when the voice waveform is synthesized. As a result, it is possible to maintain high voice quality in voice synthesis by obtaining the most suitable correlation between voice-generating information and voice tone information without fixing the correlation between them.

With the present invention, there is provided the step of shifting a reference for pitch of a voice in a voice-generating information storing means according to a reference for pitch of a voice in a voice tone data storing means when the voice is reproduced. Thus, the pitch for each voice relatively changes according to the shifted reference for voice pitch regardless of a time zone of a phoneme. As a result, the reference for voice pitch becomes closer to that for voice tone, which makes it possible to further improve quality of the voice.

With the present invention, there is provided the step of shifting a reference for pitch of a voice in a voice-generating information storing means according to an arbitrary reference for voice pitch when the voice is reproduced, so that pitch for each voice relatively changes according to the shifted reference of voice pitch regardless of a time zone of a phoneme, and as a result, it is possible to process voice tone by making it closer to intended voice quality according to the shift rate.

With the present invention, there are provided the steps of making voice-generating information by dispersing discrete voice data for either one or both of the velocity and pitch of a voice based on an inputted natural voice so that each voice data is not dependent on a time lag between phonemes and has a level relative against the reference, transferring the voice-generating information to a first communicating apparatus, and registering the voice-generating information in a file information storing means. Thus, it is possible to give velocity and pitch of a voice to the voice data not dependent on the time lag between phonemes at an arbitrary point of time.

Other objects and features of this invention will become understood from the following description with reference to the accompanying drawings.

BRIEF DESCRIPTION OF THE DRAWINGS

FIG. 2 is a view showing an example of a memory configuration of DB in a host device according to the embodiment;

FIG. 3 is a view showing an example of header information included in voice-generating information according to the embodiment;

FIG. 6 is a view explaining content of levels of voice velocity;

FIGS. 7A and 7B are views showing an example of a configuration of a control event included in voice-pronouncing information;

FIG. 9 is a view showing an example of a memory configuration of a voice tone section in a voice tone data storing section according to the embodiment;

FIG. 11 is a view showing an example of a memory configuration of a vocalizing phoneme table in a Japanese language phoneme table;

FIG. 12 is a view showing an example of a memory configuration of a devocalizing phoneme table in a Japanese language phoneme table;

FIG. 14 is a view showing an example of a memory configuration of a DB according to the embodiment;

FIG. 38 is a view showing an example of a configuration of header information according to Variant 3 of the embodiment;

FIG. 39 is a view showing an example of a configuration of a voice tone attribute in the header information shown in FIG. 38;

FIG. 40 is a view showing an example of a configuration of a voice tone section according to Variant 3 of the embodiment;

FIG. 41 is a view showing an example of a configuration of a voice tone attribute in the voice tone section shown in FIG. 40;

DESCRIPTION OF PREFERRED EMBODIMENTS

Detailed description is made hereinafter of preferred embodiments of the present invention with reference to the related drawings. It should be noted that description of the embodiments below assumes that Internet is used as the information communication system.

Figure 1:
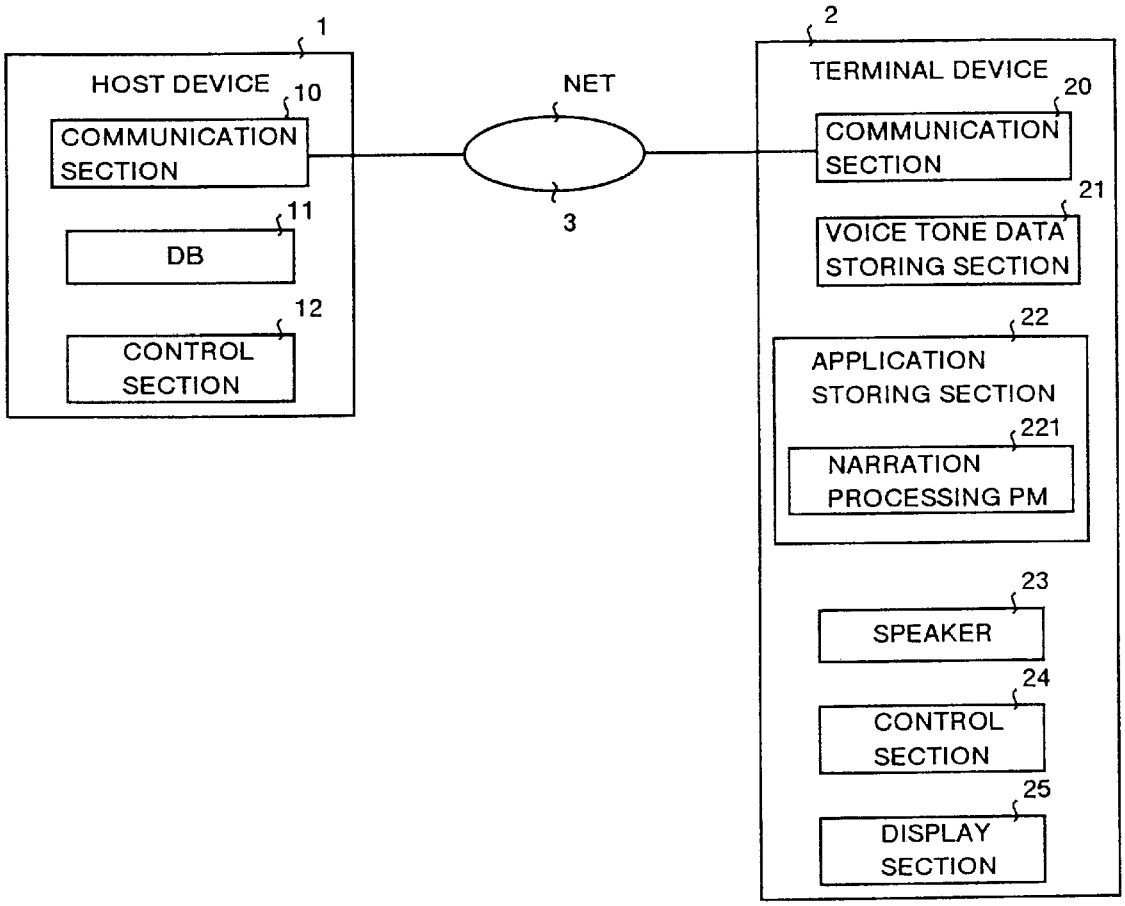
FIG. 1 is a view showing configuration of an information communication system according to one of embodiments of the present invention.

FIG. 1 is a block diagram showing the information communication system according to one of the embodiments of the present invention. This information communication system has a configuration in which a host device 1 (a first communicating apparatus) and a plurality of terminal devices 2 are connected to a communication network NET 3, such as ISDN networks or the like, and data communications is executed between the host device 1 and each of the terminal devices 2. In FIG. 1, the illustrated terminal device 2 is representative of a plurality of terminal devices, but other terminal devices need not be identical thereto.

The host device 1 comprises a communication section 10 connected to the communication network 3 (NET) a database (described as DB hereinafter) 11, a control section 12.

The communication section 10 is a unit for controlling data communications (including voice communications) with the terminal device 2 through the communication network NET, the DB 11 is a memory for registering file information including voice-generating information made in the terminal device 2 or in the host device in each file. The controlling section 12 provides controls such as receiving a file according to a request for registration of a file from the terminal device 2 and registering the file in the DB 11, or reading out a desired file information from the DB 11 according to a request from the terminal device 2 and transferring the file information to the terminal device 2.

The voice-generating information as described above is information comprising discrete voice data for either one of or both velocity and pitch of a voice correlated to a time lag between each discrete voice data as well as to a type of a voice tone, and made by dispensing each discrete data for either one of or both velocity and pitch of a voice so that the voice data is not dependent on a time lag between phonemes and at the same time present at a level relative to a reference.

The terminal device 2 comprises a communication section 20 connected to the communication network NET, a voice tone data storing section 21, an application storing section 22, a speaker 23, a controlling section 24, and a display section 25.

The communication section 20 is a unit for controlling data communications (including voice communications) with the host device 1 through the communication network NET, and the voice tone data storing section 21 is a memory for storing therein voice tone data. The voice tone data described above is data each indicating a sound parameter for each raw voice element such as a phoneme for each voice tone type.

The application storing section 22 has a voice processing PM (program memory) 221 and can execute operations such as adding, changing, or deleting any program for this narration processing PM 221 through the communication network NET or a storage medium such as a FD (floppy disk) or a CD (compact disk)-ROM or the like.

Figure 16:
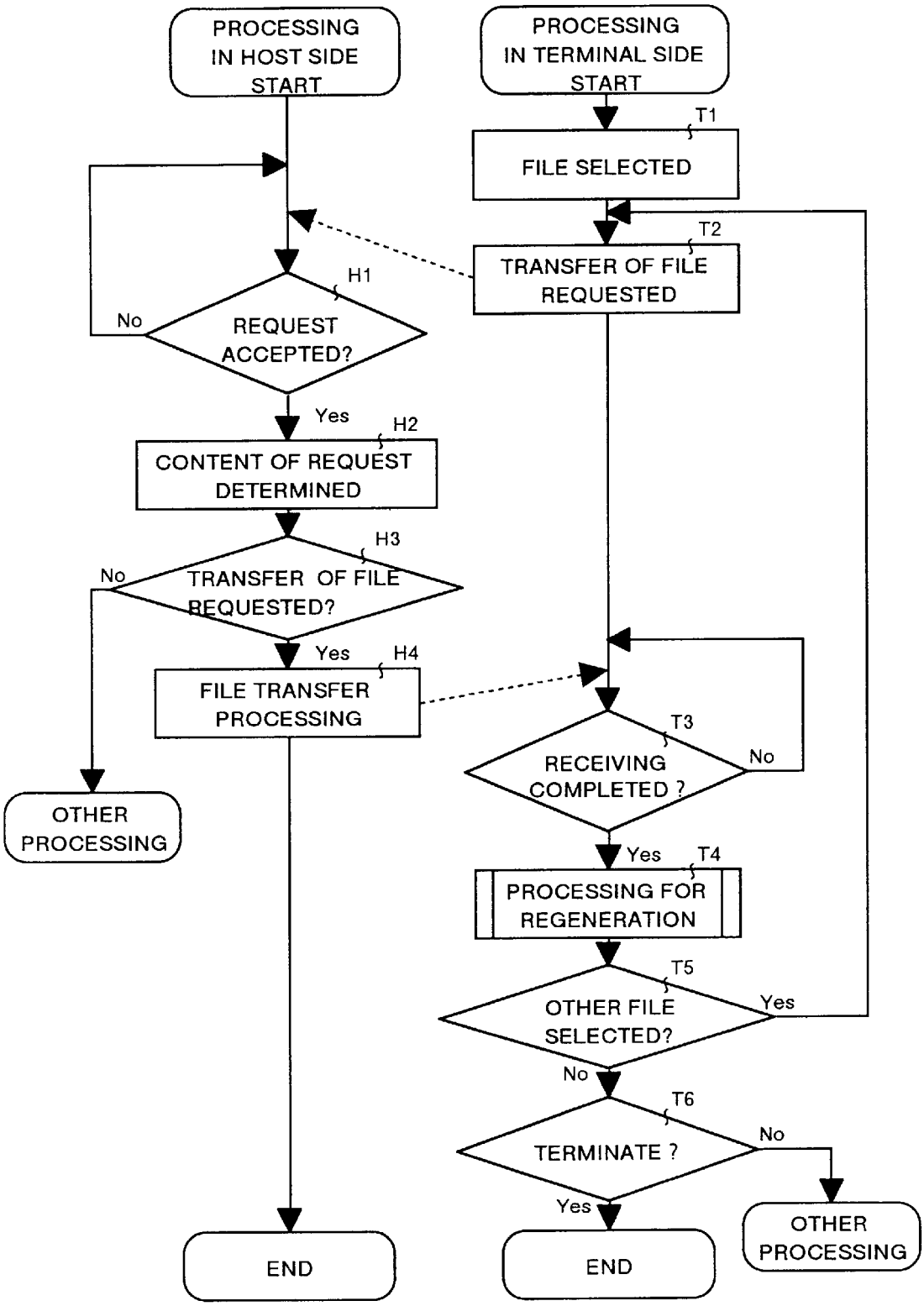
FIG. 16 is a flow chart illustrating the file transferring processing according to the embodiment.
Figure 17:
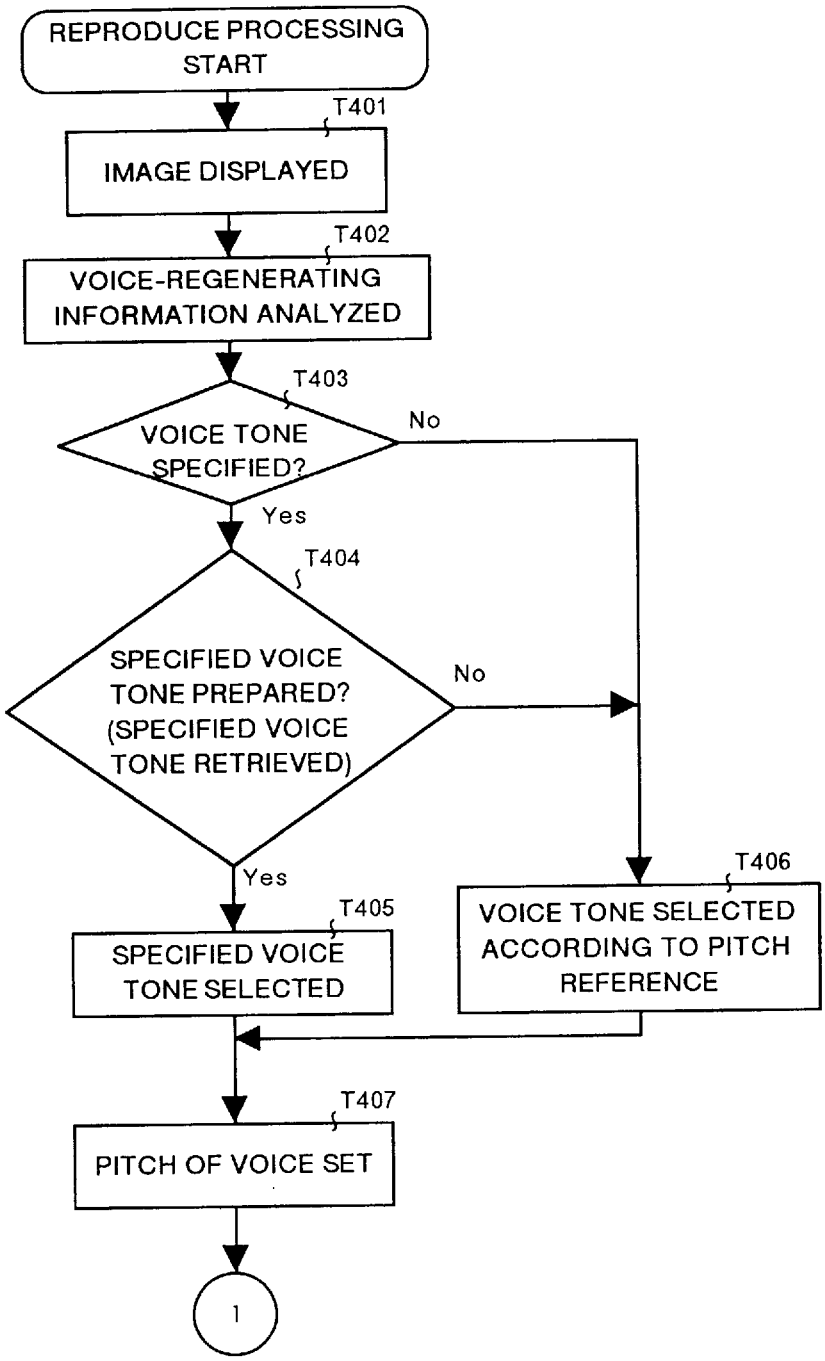
FIG. 17 is a flow chart illustrating the voice reproduction processing according to the embodiment.
Figure 18:
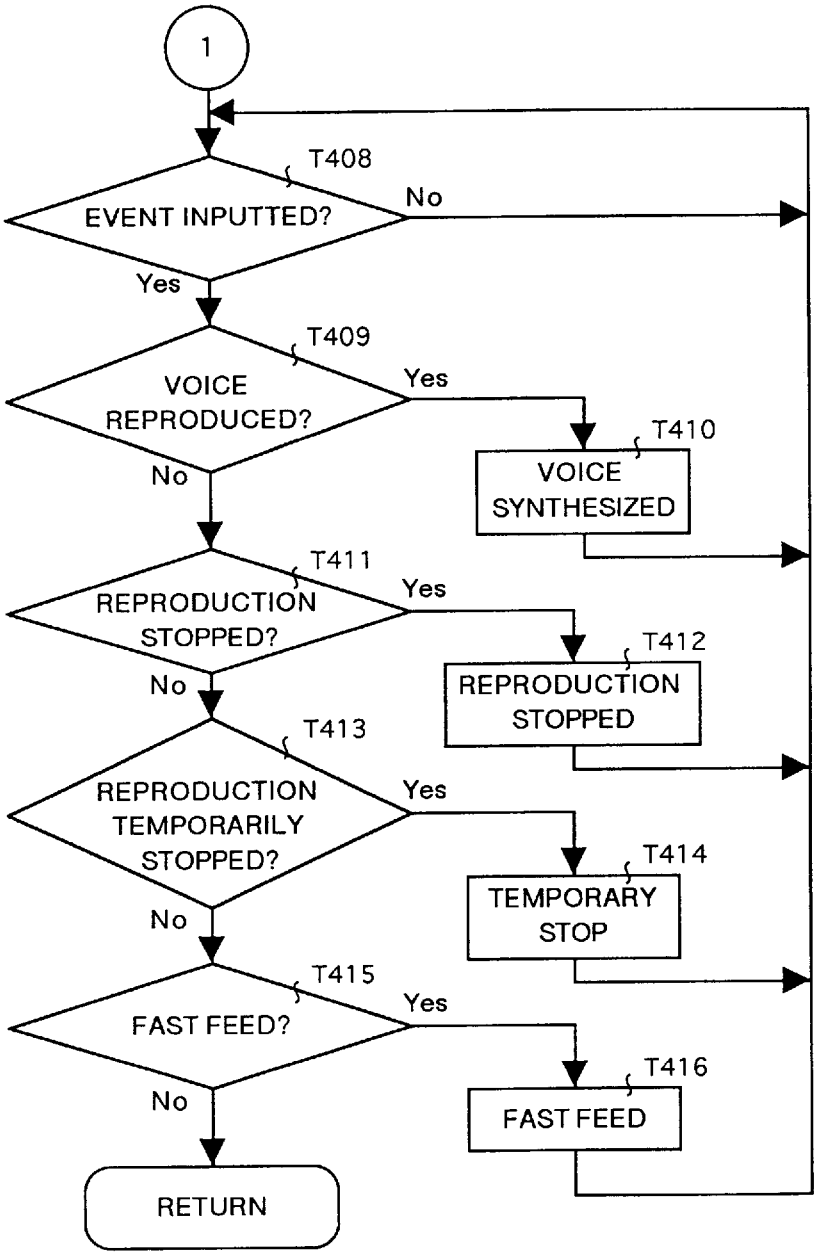
FIG. 18 is a flow chart illustrating the voice reproduction processing according to the embodiment.
Figure 23:
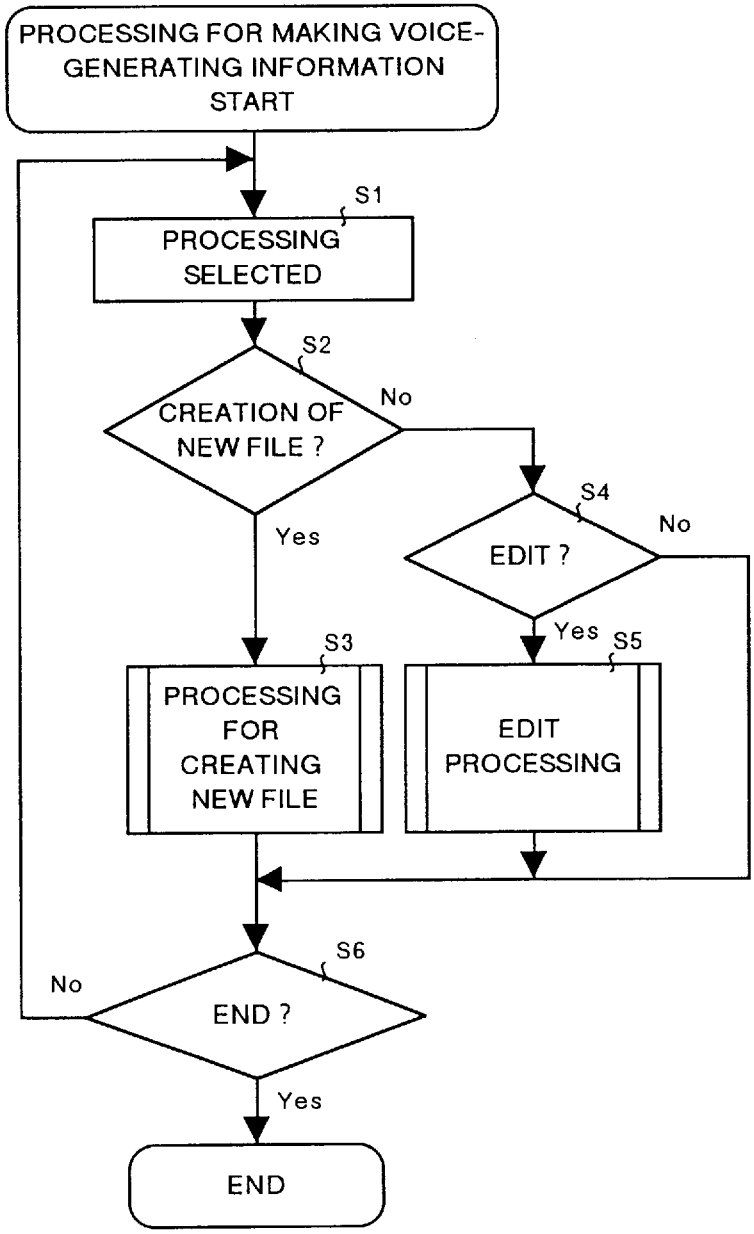
FIG. 23 is a flow chart illustrating the voice-generating information making processing according to the embodiment.
Figure 24:
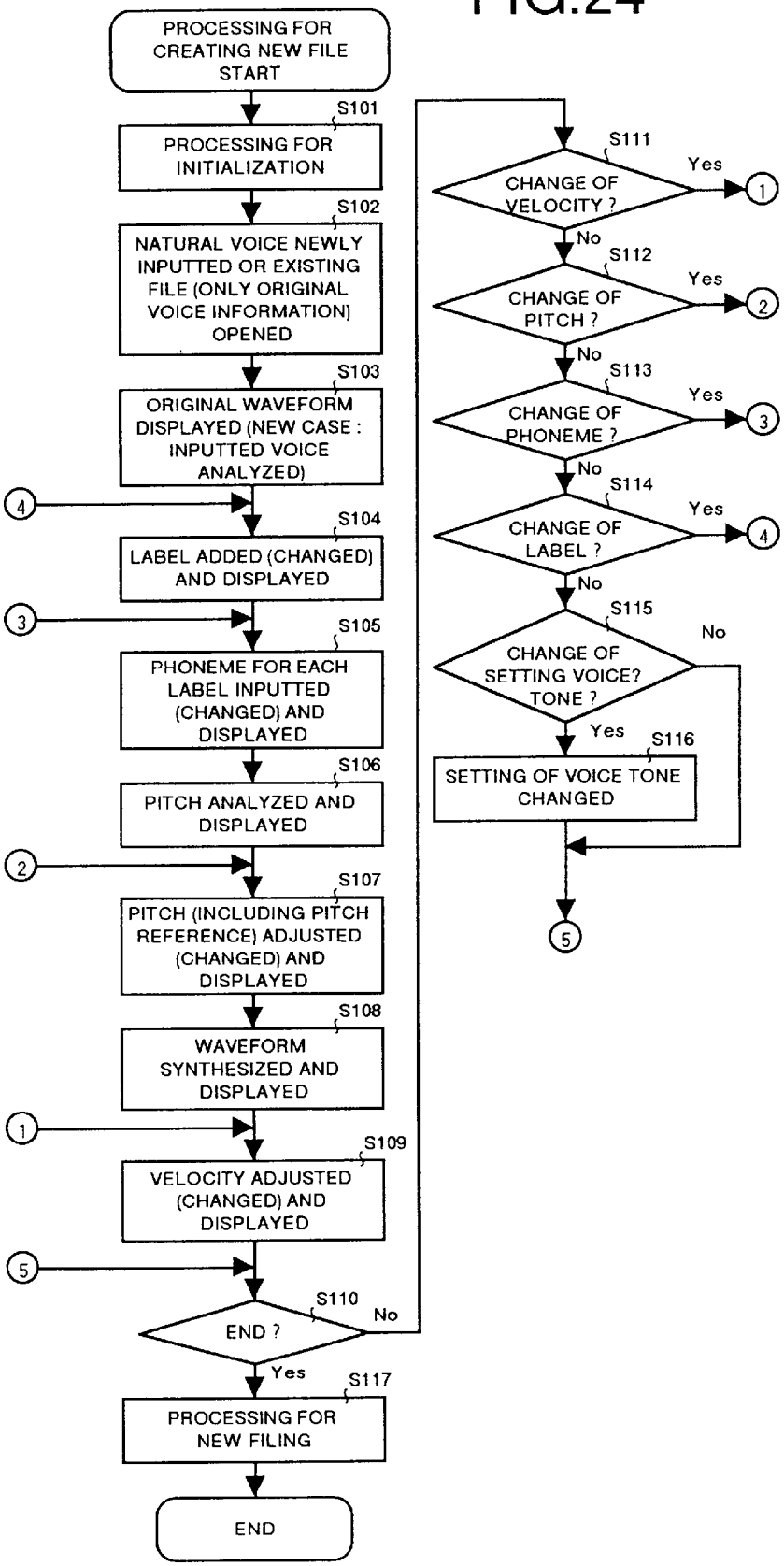
FIG. 24 is a flow chart illustrating newly making processing according to the embodiment.
Figure 25:
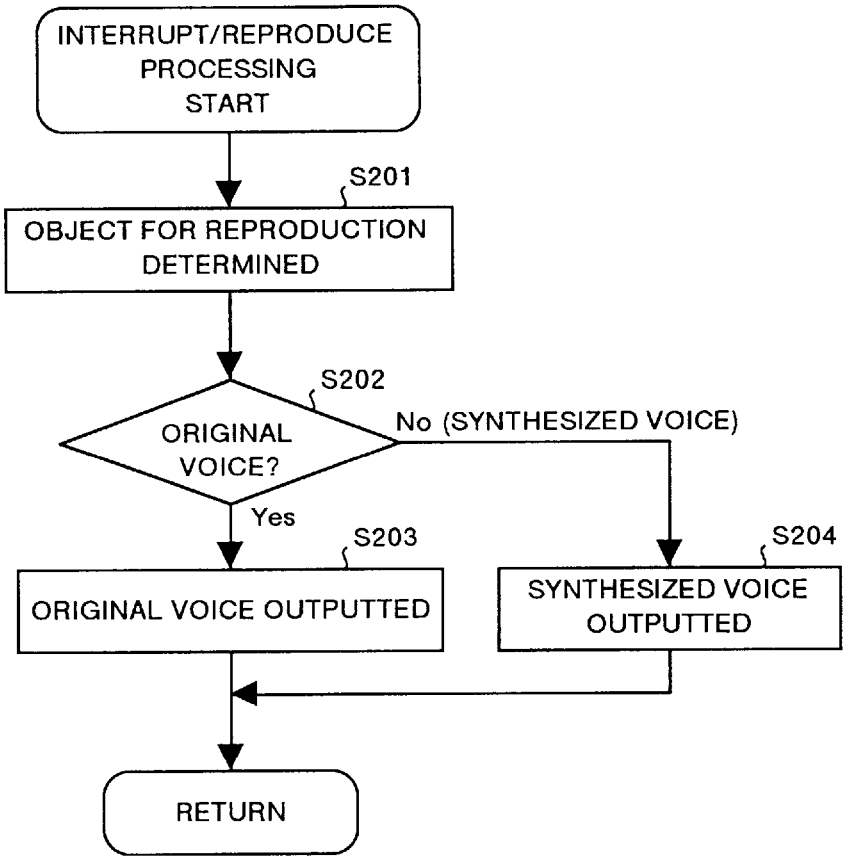
FIG. 25 is a flow chart explaining interrupt reproducing processing according to the embodiment.
Figure 34:
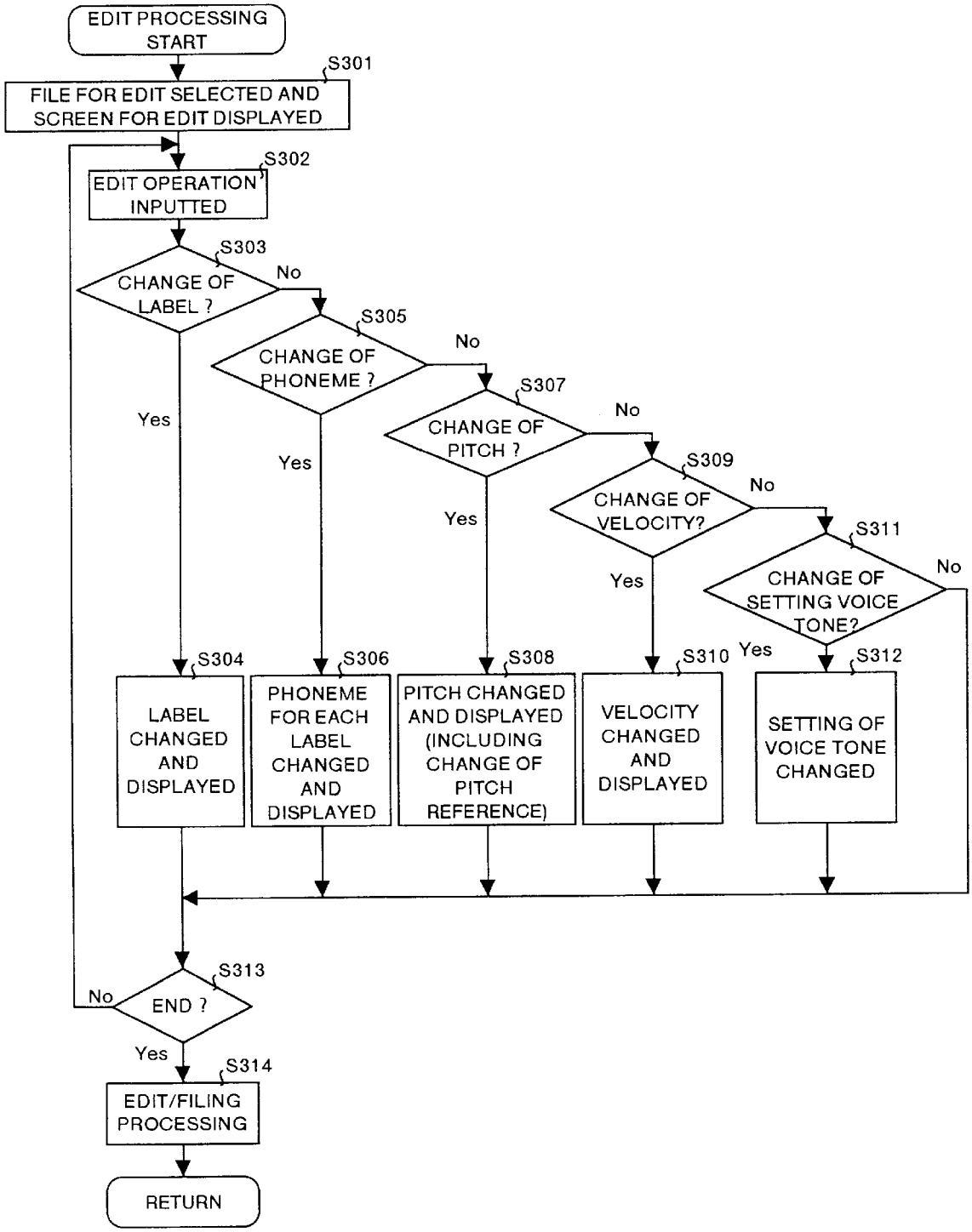
FIG. 34 is a flow chart illustrating the editing processing according to the embodiment.
Figure 35:
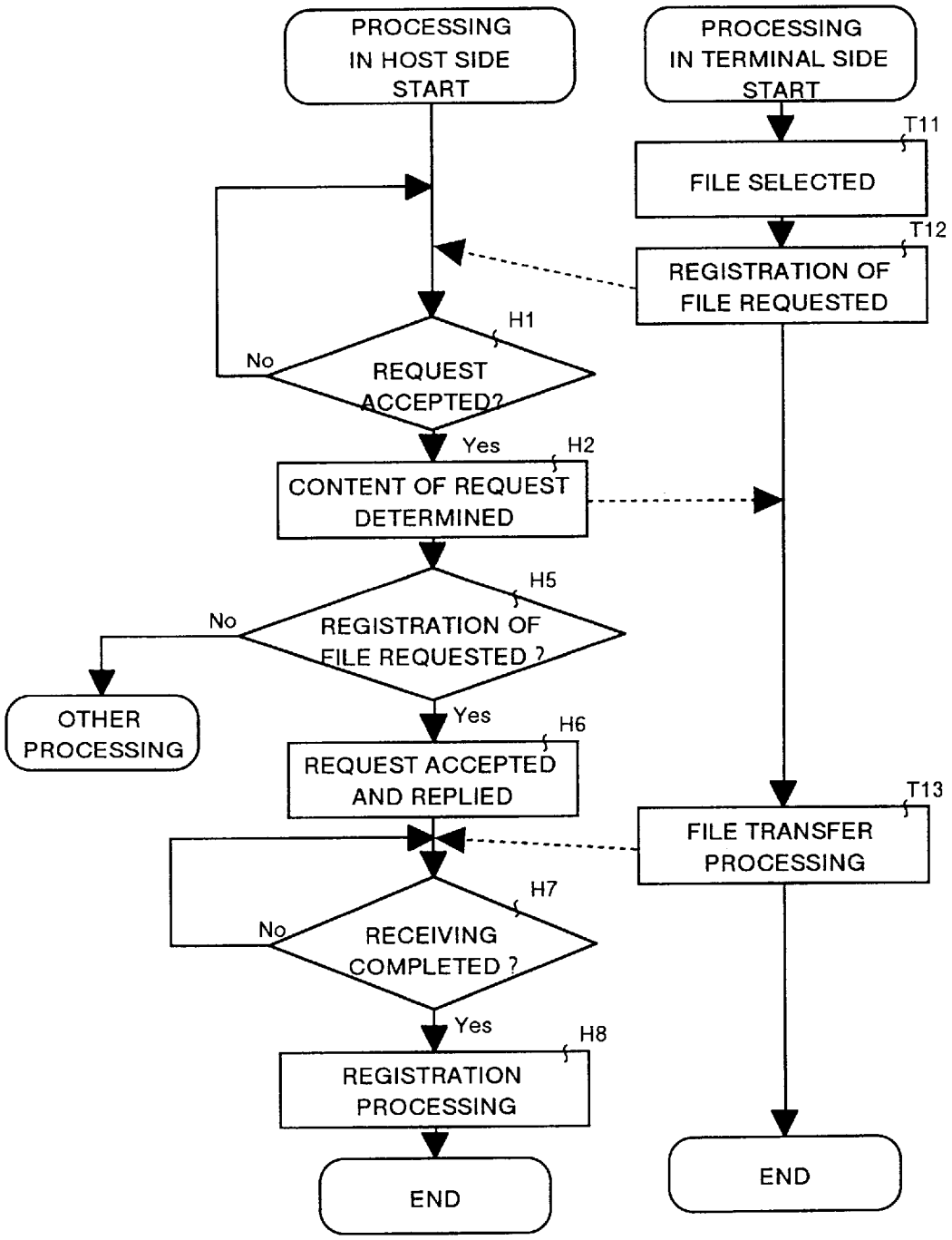
FIG. 35 is a flow chart illustrating the file registration processing according to the embodiment.

Stored in this narration processing PM 221 are programs for executing processing for transferring a file according to the flow chart shown in FIG. 16, reproducing a voice according to the flow chart shown in FIG. 17 and FIG. 18, making voice-generating information according to the flow chart shown in FIG. 23, creating new voice-generating information according to the flow chart shown in FIG. 24, interrupt/reproduce according to the flow chart shown in FIG. 25, editing information according to the flow chart shown in FIG. 34, and registering a file according to the flow chart shown in FIG. 35 or the like.

The processing for transferring a file shown in FIG. 16 indicates such operations that the terminal device 2 requires file information including desired voice-generating information to the host device 1, receives the file information transferred from the host device 1, and executes output processing such as voice reproduction or the like.

The processing for reproduction shown in FIG. 17 and FIG. 18 indicates an operation for concretely executing voice reproduction in said file transfer processing.

The processing for making voice-generating information shown in FIG. 23 indicates operations for newly creating and editing voice-generating information indicating a dispersed meter not including voice tone data based on a natural voice and registering the voice-generating information in a file.

The processing for creating new voice-generating information shown in FIG. 24 indicates an operation for making new voice-generating information in the processing for making voice-generating information described above.

The interrupt/reproduce processing shown in FIG. 25 indicates an operation for reproducing a voice when a request for reproduction is issued during the processing for making voice-generating information as well as the processing for editing.

The processing for editing shown in FIG. 34 indicates an operation for editing in said processing for making voice-generating information, and an object for the processing for editing is a file (voice-generating information) which has already been made.

The processing for registering a file shows in FIG. 35 indicates an operation for registering a file in said processing for making voice-generating information. Namely, the processing for registering a file comprises operations for issuing a request for registration of desired file information from the terminal device 2 to the host device 1 and transferring the file information to the host device 1 for registration therein.

The speaker 23 is a voice output unit for outputting a synthesized voice or the like reproduced in the reproduction processing as well as in the interrupt/reproduce processing by synthesizing waveforms of the voice-generating information as well as of the voice tone data.

The display section 25 is a display unit such as a LCD and a CRT or the like for forming a display screen when a file of the voice-generating information is created, transferred and registered.

Next a detailed description is made of a form of file information management by the host device 1.

FIG. 2 is a view showing an example of a memory configuration in the DB 11 of the host device 1.

The DB 11 stores therein file information, as shown in FIG. 2, including voice-generating information correlated to each of the files A, B, C. For instance, the file information in the file A is stored therein in correlation to the voice-generating information (header information HDRA and pronouncing information PRSA), image information IMGA, and program information PROA. Similarly, the file information in the file B is stored therein in correlation to the voice-generating information (header information HDRB and pronouncing PRSB), image information IMGB, and program information PROB, and the file information in the file C is stored therein in correlation to the voice-generating information (header information HDRC and pronouncing information PRSC), image information IMGC, and program information PROC. It should be noted that the embodiment assumes that Internet is used as an information communication system herein as an example, so that each of the program information PROA, PROB, PROC in each of the file information A, B, C respectively is information written in HTML language for creating a home page or the like.

Figure 4:
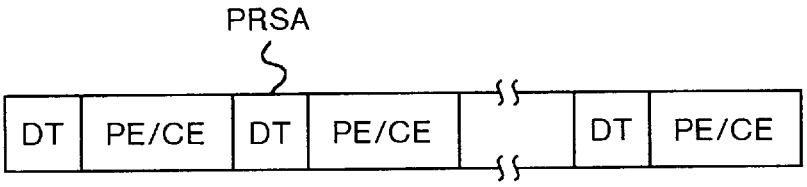
FIG. 4 is a view showing an example of a configuration of pronouncing information included in voice-generating information.
Figure 5A:
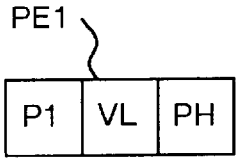
FIGS. 5A to 5C are views showing an example of a configuration of a pronouncing event included in the pronouncing information.
Figure 5B:
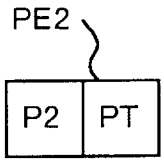
Figure 5C:
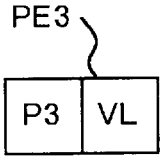

FIG. 3 is a view showing an example of header information in voice-generating information, FIG. 4 is a view showing an example of a configuration of a pronouncing information in the voice-generating information, FIG. 5 is a view showing an example of a configuration of a pronouncing event in the voice-generating information, FIG. 6 is a view for explanation of the contents on levels of the velocity, and FIG. 7 is a view showing an example of a configuration of a control event in the pronouncing information.

Herein, description is made for voice-generating information for the file A as an example. FIG. 3 shows the header information HDRA for the file A. This header information HDRA comprises a phoneme group PG, a language code LG, time resolution TD, voice tone specifying data VP, pitch reference data PB, and volume reference data VB.

The phoneme group PG and the language code LG are data for specifying a phoneme group and a language code in the phoneme section 42 (Refer to FIG. 8) described later respectively, and a phoneme table to be used for synthesizing a voice is specified with this data.

Data for time resolution TD is data for specifying a basic unit of time for a time lag between phonemes. Data for specifying a voice tone VP is data for specifying (selecting) a file in the voice tone section 211 (Refer to FIG. 8) described later and used when a voice is synthesized, and a type of voice tone, namely, voice tone data used for synthesizing a voice is specified with this data.

The data for a pitch reference PB is data for defining pitch of a voice (a pitch frequency) as a reference. It should be noted that an average pitch is employed as an example of pitch reference, but other than the average pitch, a different reference such as a maximum frequency or a minimum frequency or the like of pitch may be employed. When a voice waveform is synthesized, pitch can be changed in a range consisting an octave in an upward direction and an octave in a downward direction with pitch, for instance, according to this data for pitch reference PB as a reference.

The data for a volume reference VB is data for specifying a reference of an entire volume.

FIG. 4 shows pronouncing information PRSA for the file A. The pronouncing information PRSA has a configuration in which each time lag data DT and each event data (pronouncing event PE or control event CE) is alternately correlated to each other, and is not dependent on a time lag between phonemes.

The time lag data DT is data for specifying a time lag between event data. A unit of a time lag indicated by this time lag data DT is specified by time resolution TD in the header information of the voice-generating information.

The pronouncing event PE in the event data is data comprising a phoneme for making a voice, pitch of a voice for relatively specifying voice pitch, and velocity for relatively specifying a voice strength or the like.

The control event CE in the event data is data specified for changing volume or the like during the operation as control over parameters other than those specified in the pronouncing event PE.

Next a detailed description is made for the pronouncing event PE with reference to FIG. 5 and FIG. 6.

There are three types of pronouncing event PE, as shown in FIG. 5; namely a phoneme event PE1, a pitch event PE2, and a velocity event PE3.

The phoneme event PE1 has a configuration in which identifying information P1, velocity of a voice, and a phoneme code PH are correlated to each other, and is an event for specifying a phoneme as well as velocity of a voice.

The identifying information P1 added to the header of the phoneme event PE1 indicates the fact that a type of event is the phoneme event PE1 in the pronouncing event PE.

The voice amplitude VL is data for specifying a volume of a voice (velocity), and specifies the volume as sensuous amplitude of a voice.

In a case where this voice strength VL is divided, for instance, into eight values, each consisting of three bits and a sign of a musical sound is correlated to each of the values, as shown in FIG. 6, silence, pianissimo (ppp) . . . fortissimo (fff) are correlated to a value "0", a value "1" and a value "7", respectively.

A value of an actual voice strength VL and a physical voice strength are dependent on voice tone data in voice synthesis, so that, for instance, both of the values of voice strength VL of a vowel "A" and that of a vowel "I" have only to be set to the standard value, and a physical voice strength of the vowel "A" can be larger than that of the vowel "I" according to the voice tone data if the standard value is used. It should be noted that, generally, an average amplitude power of the vowel "A" becomes larger than that of the vowel "I".

The phoneme code PH is data for specifying any phoneme code in each phoneme table (Refer to FIG. 10, FIG. 11, and FIG. 12) described above. In this embodiment, the phoneme code is one byte data.

The pitch event PE2 has a configuration in which identifying information P2 and voice pitch PT are correlated to each other, and is an event for specifying voice pitch at an arbitrary point of time. This pitch event PE2 can specify voice pitch independently from a phoneme (not dependent on a time lag between phonemes), and also can specify voice pitch at an extremely short time interval in the time zone of one phoneme. These specification and the operations are essential conditions required for generating a high-grade meter.

The identifying information P2 added to the header of the pitch event PE2 indicates the fact that a type of event is a pitch event in the pronouncing event PE.

Voice pitch PT does not indicate an absolute voice pitch, and is data relatively specified according to a pitch reference as a reference (center) indicated by the pitch reference data PB in the header information.

In a case where this voice pitch PT is one-byte data, a value is specified in a range consisting of one octave in the upward direction and one octave in the downward direction with the pitch reference as a reference indicated by levels of 0 to 255. If voice pitch PT is defined, for instance, with a pitch frequency f [Hz], the following equation (1) is obtained.

Namely, $$f=PBV\cdot((PT/256)^2+0.5\cdot(PT/256)+0.5) \quad (1)$$

Wherein, PBV indicates a value (Hz) of a pitch reference specified by the pitch reference data PB.

Reversely, a value of a pitch reference PT can be obtained from a pitch frequency f according to the following equation (2). The equation (2) is described as follows.

Namely, $$PT=64\cdot(\ ((16\cdot f/PBV)-7)-1) \quad (2)$$

The velocity event PE3 has a configuration in which identifying information 23 and velocity VL are correlated to each other, and is an event for specifying velocity at an arbitrary point of time. This velocity event PE3 can specify velocity of a voice independently from a phoneme (not dependent on a time lag between phonemes), and also can specify velocity of a voice at an extremely short time interval in the time zone of one phoneme. These specification and the operations are essential conditions required for generating a high-grade meter.

Velocity of a voice VL is basically specified for each phoneme, but in a case where the velocity of a voice is changed in the middle of one phoneme while the phoneme is prolonged or the like, a velocity event PE3 can additionally be specified, independently from the phoneme, at an arbitrary point of time as required.

Next a detailed description is made for a control event CE with reference to FIGS. 7A and 7B.

The control event CE is an event for defining the volume event CE1 (Refer to FIG. 7A) as well as the pitch reference event CE2 (Refer to FIG. 7B).

The volume event CE1 has a configuration in which identifying information C1 and volume data VBC are correlated to each other, and is an event for specifying volume reference data VB specified by the header information HDRA so that the data VB can be changed during the operation.

Namely this event is used when the entire volume level is operated to be larger or smaller, and a volume reference is replaced from the volume reference data VB specified by the header information HDRA to specified volume data VBC until volume is specified by the next volume event CE1 in the direction of a time axis.

The identifying information C1 added to the header of the volume event CE1 indicates volume of a voice which is one of the types of the control event.

The pitch reference event CE2 has a configuration in which identifying information C2 and pitch reference data PBC are correlated to each other, and is an event specified in a case where voice pitch exceeds a range of the voice pitch which can be specified by the pitch reference data PB specified by the header information HDRA.

Namely this event is used when the entire pitch reference is operated to be higher or lower, and a pitch reference is replaced from the pitch reference data PB specified by the header information HDRA to a specified pitch reference data PBC until a pitch reference is specified by the next pitch reference event CE2 in the direction of a time axis. After the operation and on, the voice pitch will be changed in a range consisting of one octave in the upward direction and one octave in the downward direction according to the pitch reference data PBC as a center.

Figure 8:
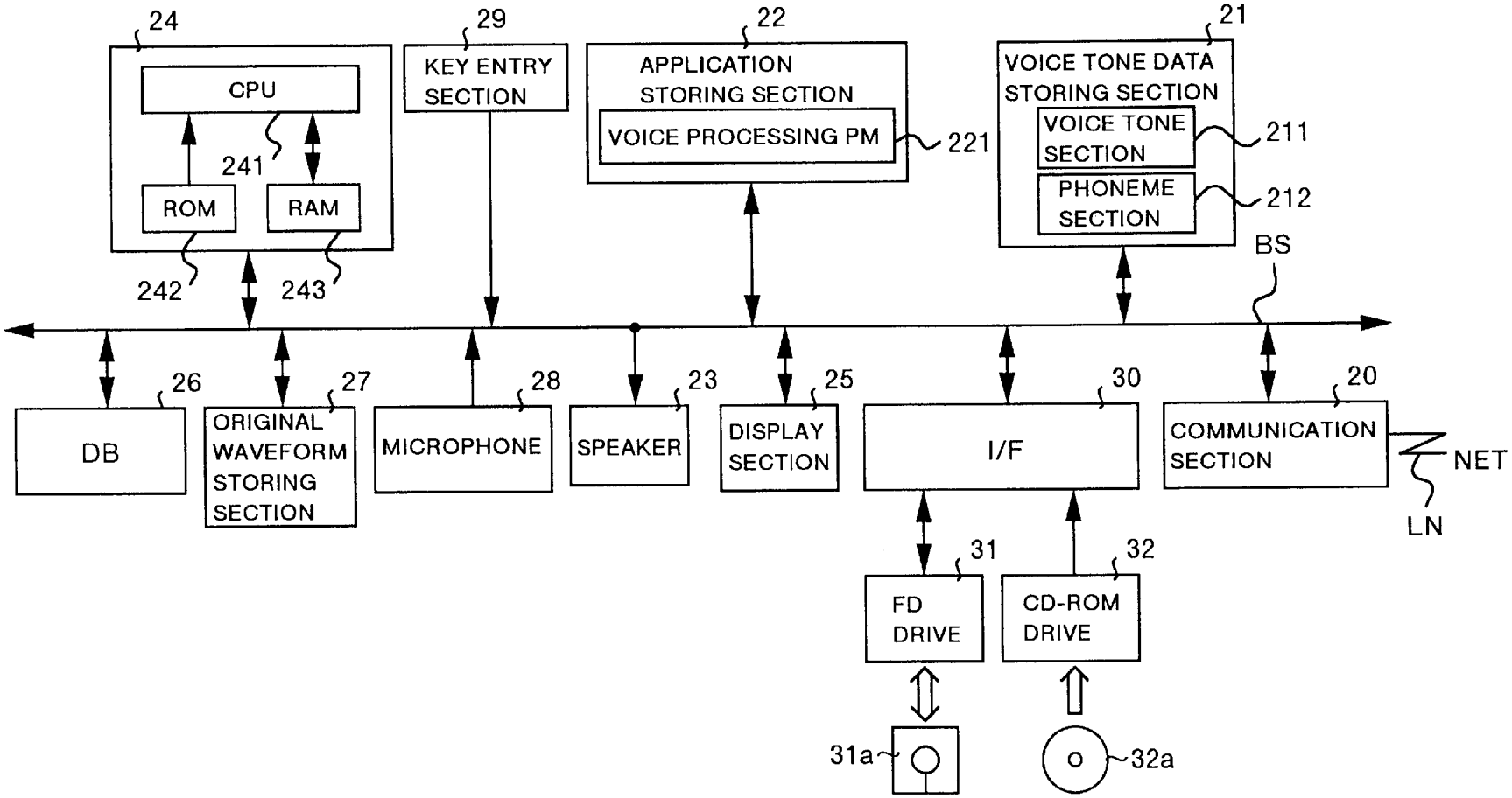
FIG. 8 is a block diagram showing a terminal device according to one of embodiments of the present invention.

Next detailed a description is made of the terminal device 2. FIG. 8 is a block diagram showing internal configuration of the terminal device 2.

The terminal device 2 comprises units such as a control section 24, a key entry section 29 or other input means for making or changing data by an operator, an application storing section 22, a voice tone data storing section 21, a DB 26, an original waveform storing section 27, a microphone 28 (or other voice inputting means), a speaker 23, a display section 25, an interface (I/F) 30, an FD drive 31, a CD-ROM drive 32, and a communication section 20 or the like.

The control section 24 is a central processing unit for controlling each of the units coupled to a bus B.S. This control section 24 controls operations such as detection of key operation in the key entry section 29, execution of applications, addition or deletion of information on voice tone, phoneme, and voice-generation, making and transaction of voice-generating information, storage of data on original waveforms, and forming various types of display screen or the like.

This control section 24 comprises a CPU 241, a ROM 242, and a RAM 243. The CPU 241 operates according to an OS program stored in the ROM 242 as well as to an application program (a voice processing PM (a program memory) 31 or the like) stored in the application storing section 22.

The ROM 242 is a storage medium storing therein the OS (operating system) program or the like, and the RAM 243 is a memory used for the various types of programs as a work area and is also used when data for transaction is temporarily stored therein.

The key entry section 29 comprises input devices such as various types of key and a mouse so that the control section 24 can detect any instruction for file preparation, transaction, or filing on voice-generating information as well as for file transaction or filing or the like by the voice tone data storing section each as a key signal.

The application storing section 22 is a storage medium storing therein application programs such as that for the narration processing PM 221 or the like. As for the application storing section 22, operations such as addition, change, or deletion of the program for this narration processing PM 221 can be executed through other storage medium such as a communication network NET, a FD (floppy disk), or a CD (compact disk)-ROM or the like.

Stored in this narration processing PM 221 are programs for executing the processing for transferring a file according to the flow chart shown in FIG. 16, the processing for reproducing a voice according to the flow chart shown in FIG. 17 and FIG. 18, the processing for making voice-generating information according to the flow chart shown in FIG. 23, the processing for creating a new file according to the flow chart shown in FIG. 24, the processing for interrupting/reproducing according to the flow chart shown in FIG. 25, the processing for editing voice-generating information according to the flow chart shown in FIG. 34, and the processing for registering a file according to the flow chart shown in FIG. 35 or the like.

The processing for transferring a file shown in FIG. 16 shows such operations that the terminal device 2 requires desired file information (including voice-generating information and image information or the like) to the host device 1, receives the file information transferred from the host device 1, and executes a reproduction of voices and images or the like.

The processing for reproduction shown in FIG. 17 and FIG. 18 indicates an operation for reproducing a voice and an image during the processing for transferring a file.

The processing for making voice-generating information shown in FIG. 23 indicates operations such as making, editing, and filing new voice-generating information (Refer to FIG. 3 to FIG. 7) based on a natural voice not including voice tone data and indicating a sound parameter for each raw voice element such as a phoneme.

The processing for making new a new file shown in FIG. 24 indicates an operation for making a new file in the processing for making voice-generating information.

The interrupt/reproduce processing shown in FIG. 25 indicates operations for reproducing a voice in a case where an operation of reproducing a voice is requested during the operation of making a new file or editing the data described above.

The editing processing shown in FIG. 34 indicates an editing operation in the processing for making voice-generating information, and an object for the edit is the voice-generating information in the file which has already been made.

The processing for registering a file shown in FIG. 35 indicates an operation for sending a request for registration of file information from the terminal device 2 to the host device 1 and transferring the file information to the host device 1.

The voice tone data storing section 21 is a storage medium for storing therein voice tone data indicating various types of voice tone, and comprises a voice tone section 211 and a phoneme section 212. The voice tone section 211 selectively stores therein voice tone data indicating sound parameters of each raw voice element such as a phoneme for each voice tone type (Refer to FIG. 9), and the phoneme section 212 stores therein a phoneme table with a phoneme correlated to a phoneme code for each phoneme group to which each language belongs (Refer to FIG. 10 to FIG. 13).

In both the voice tone section 211 and phoneme section 212, it is possible to add thereto voice tone data or the phoneme table or the like through the storage medium such as a communication line LN, a FD, a CD-ROM or the like, or delete any of those data therein through key operation in the key entry section 29.

The DB 26 stores therein voice-generating information in units of a file. This voice-generating information includes pronouncing information comprising a dispersed phoneme and dispersed meter information (phoneme groups, a time lag in pronouncing or pronunciation control, pitch of a voice, and velocity of a voice), and header information (languages, time resolution, specification of voice tone, a pitch reference indicating velocity of a voice as a reference, and a volume reference indicating volume as a reference) specifying the pronouncing information.

When a voice is to be reproduced, dispersed meters are developed to continuous meter patterns based on the voice-generating information, and a voice can be reproduced by synthesizing a waveform from the meter pattern as well as from the voice tone data indicating voice tone of a voice according to the header information.

The original waveform storing section 27 is a storage medium for storing therein a natural voice in a state of waveform data for preparing a file of voice-generating information. The microphone 28 is a voice input unit for inputting a natural voice required for the processing for preparing a file of voice-generating information or the like.

The speaker 23 is a voice output unit for outputting a voice such as a synthesized voice or the like reproduced by the reproduction processing or the interrupt/reproduce processing.

The display section 25 is a display unit, such as an LCD, a CRT or the like forming a display screen related to the processing for preparing a file, transaction, and filing of voice-generating information.

The interface 30 is a unit for data transaction between a bus B.S. and the FD drive 31 or the CD-ROM drive 32. The FD drive 31 is a device in which a detachable FD 31*a* (a storage medium) is set to execute operations of reading out data therefrom or writing it therein. The CD-ROM drive 32 is a device in which a detachable CD-ROM 32*a* (a storage medium) is set to execute an operation of reading out data therefrom.

It should be noted that it is possible to update the contents stored in the voice tone data storing section 21 as well as in the application storing section 22 or the like if the information such as the voice tone data, phoneme table, and application program or the like is stored in the FD 31*a* or CD-ROM 32*a*.

The communication section 20 is connected to a communication line LN and executes communications with an external device through the communication line LN.

Next a detailed description is made of the voice tone data storing section 21. FIG. 9 is a view showing an example of a memory configuration of the voice tone section 211 in the voice tone data storing section 21. The voice tone section 211 is a memory for storing therein voice tone data VD1, VD2, as shown in FIG. 9, each corresponding to selection No. 1, 2 respectively. For a type of voice tone, voice tone of men, women, children, adults, husky, or the like is employed. Pitch reference data PB1, PB2, . . . , each indicating a reference of voice pitch, are included in the voice tone data VD1, VD2 . . . respectively.

Included in voice tone data are sound parameters of each synthesized unit (e.g., CVC or the like) . For the sound parameters, LSP parameters, cepstrum, or one-pitch waveform data or the like are preferable.

Figure 10:
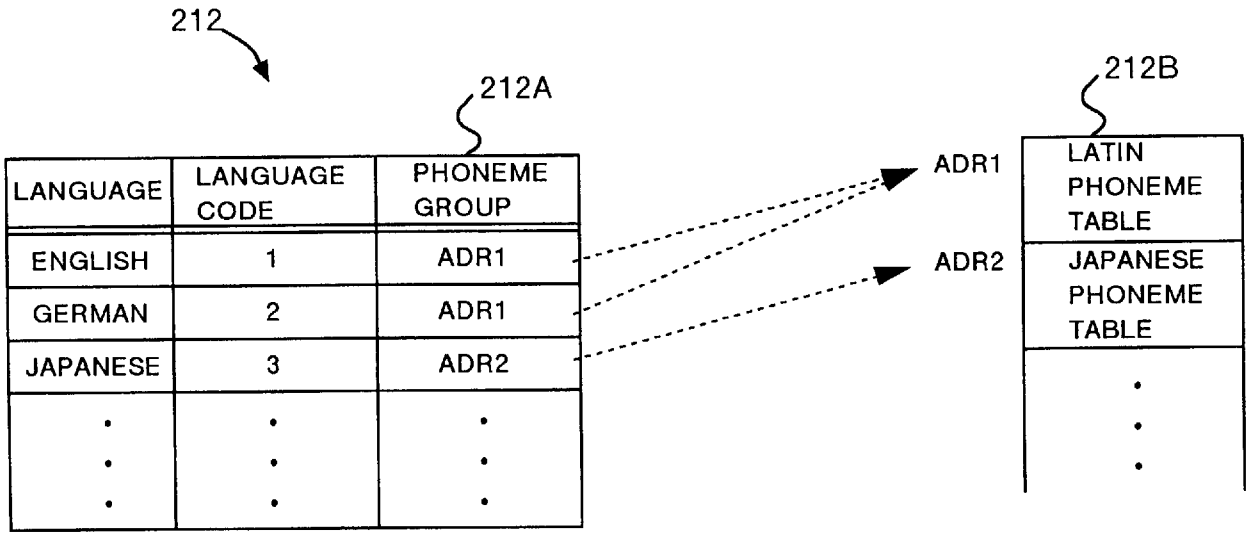
FIG. 10 is a view showing an example of a memory configuration of a phoneme section in a voice tone data storing section according to the embodiment.
Figure 13:
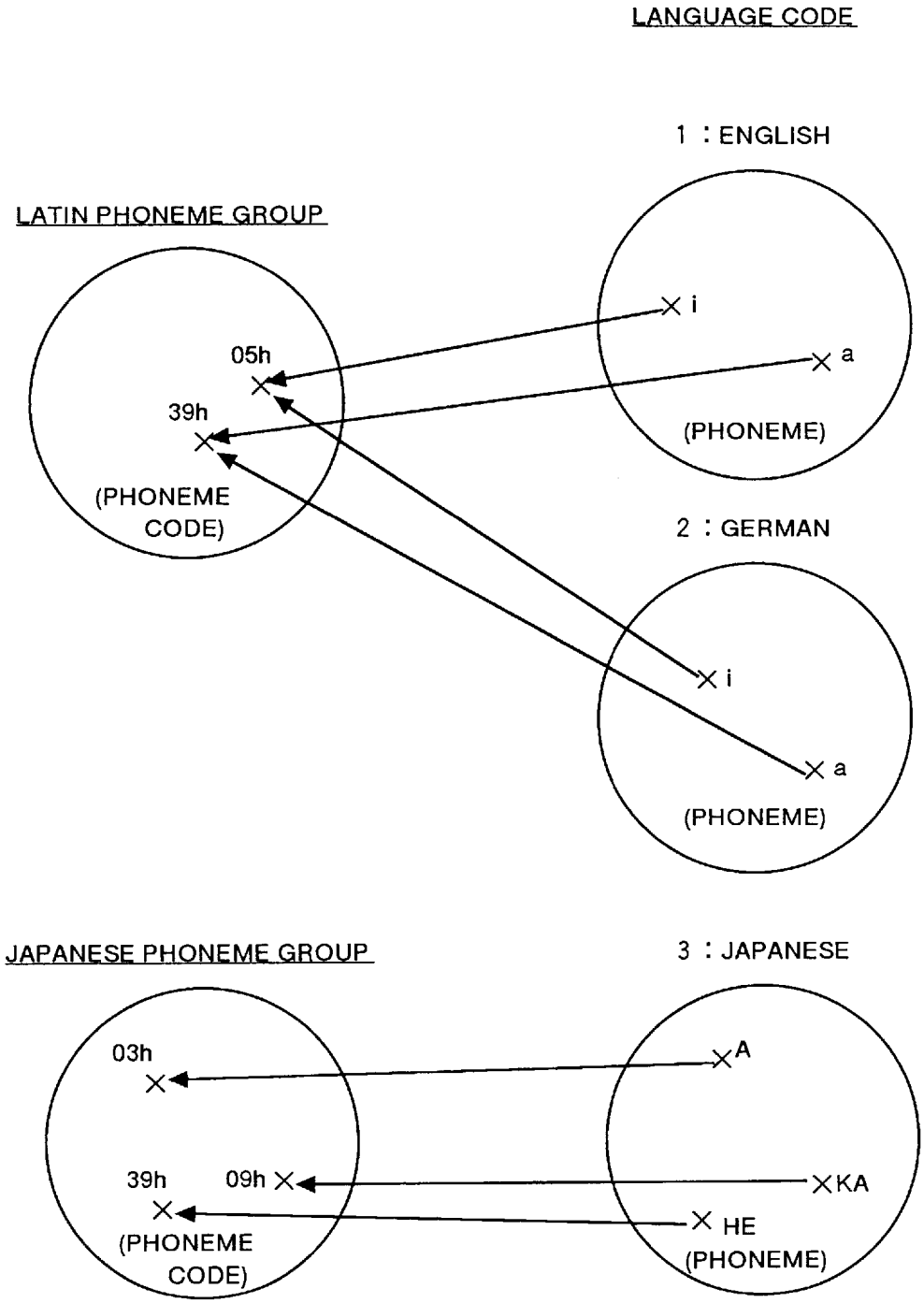
FIG. 13 is a view explaining correlation between a phoneme and phoneme code for each language code in a phoneme section.

Next description is made for the phoneme section 212. FIG. 10 is a view showing an example of a memory configuration of the phoneme section 212 in the voice tone data storing section 21, FIG. 11 is a view showing an example of a memory configuration of a vocalized phoneme table 33A of a Japanese phoneme table, FIG. 12 is a view showing an example of a memory configuration of a devocalized phoneme table 33B of the Japanese phoneme table, and FIG. 13 is a view showing the correspondence between a phoneme and a phoneme code of each language code in the phoneme section 212.

The phoneme section 212 is a memory storing therein a phoneme table 212A correlating a phoneme group to each language code of any language such as English, German, or Japanese or the like and a phoneme table 212B indicating the correspondence between a phoneme and a phoneme code of each phoneme group.

A language code is added to each language, and there is a one-to-one correspondence between any language and the language code. For instance, the language code "1" is added to English, the language code "2" to German, and the language code "3" to Japanese respectively.

Any phoneme group specifies a phoneme table correlated to each language. For instance, in a case of English and German, the phoneme group thereof specifies address ADR1 in the phoneme table 212B, and in this case a Latin phoneme table is used. In a case of Japanese, the phoneme group thereof specifies address ADR2 in the phoneme table 212B, and in this case a Japanese phoneme table is used.

To be more specific, a phoneme level is used as a unit of voice in Latin languages, for instance, in English and German. Namely, a set of one type of phoneme codes corresponds to characters of a plurality of types of language. On the other hand, in a case of languages like Japanese, any one of the phoneme codes and a character are in substantially one-to-one correspondence.

Also, the phoneme table 212B provides data in a table form showing correspondence between phoneme codes and phonemes. This phoneme table 212B is provided in each phoneme group, and for instance, the phoneme table (Latin phoneme table) for Latin languages (English, German) is stored in address ADR1 of the memory, and the phoneme table (Japanese phoneme table) for Japanese language is stored in address ADR2 thereof.

For instance, the phoneme table (the position of address ADR2) corresponding to the Japanese language comprises, as shown in FIG. 11 and FIG. 12, the vocalized phoneme table 33A and the devocalized phoneme table 33B.

In the vocalized phoneme table 33A shown in FIG. 11, phoneme codes for vocalization are correlated to vocalized phonemes (character expressed by a character code) respectively. A phoneme code for vocalization comprises one byte and, for instance, the phoneme code 03h (h: a hexadecimal digit) for vocalization corresponds to a character of "A" as one of the vocalized phonemes.

A phoneme for a character in the Ka-line with "○" added on the right shoulder of the character indicates a phonetic rule in which the character is pronounced as a nasally voiced sound. For instance, nasally voiced sounds of the characters "Ka" to "Ko" correspond to phoneme codes 13h to 17h of vocalized phonemes.

In the devocalized phoneme table 33B shown in FIG. 12, phoneme codes for devocalization are correlated to devocalized phonemes (character expressed by a character code) respectively. In this embodiment, a phoneme code for devocalization also comprises one byte and, for instance, the phoneme code A0h for devocalization corresponds to a character of "Ka" ("U/Ka") as one of the devocalized phonemes. A character of "U" is added to each of devocalized phonemes in front of each of the characters.

For instance, in a case of a Japanese language with the language code of "3", the Japanese phoneme table at address ADR2 is used. With this operation, as one of the examples shown in FIG. 13, characters of "A", "Ka", and "He" are correlated to phoneme codes 03h, 09h, 39h respectively.

Also, in a case where the language is English or German, the Latin phoneme table at address ADR1 is used. With this operation, as indicated by one of the examples shown in FIG. 13, phonemes in English of "a", "i" are correlated to phoneme codes 39h, 05h respectively, and phonemes in German of "a", "i" are correlated to the phoneme codes 39h, 05h respectively.

As indicated by one of the examples shown in FIG. 13, for instance, the common phoneme codes 39h, 05h are added to the phonemes of "a", "i" each common to both English and German.

Next description is made for the DB 26. FIG. 14 is a view showing an example of a memory configuration of the DB 26 in the terminal device 2.

The DB 26 stores therein file information including voice-generating information, as shown in FIG. 14, in correlation to files A, D . . . . For instance, the file information for the file A has already been received by the DB 26 from the host device 1 and is stored therein with voice-generating information (the header information HDRA and the pronouncing information PRSA), image information IMGA, and program information PROA each correlated thereto. Similarly, the file information for the file D is stored in the DB 26 with voice-generating information (the header information HDRD and the pronouncing information PRSD), image information IMGD, and program information PROD each correlated thereto. It should be noted that the Internet is assumed herein as an information communication system, so that each of the program information PROA, PROD . . . in each of the file information A, D . . . is written in HTML language for preparing a home page or the like.

Figure 15:
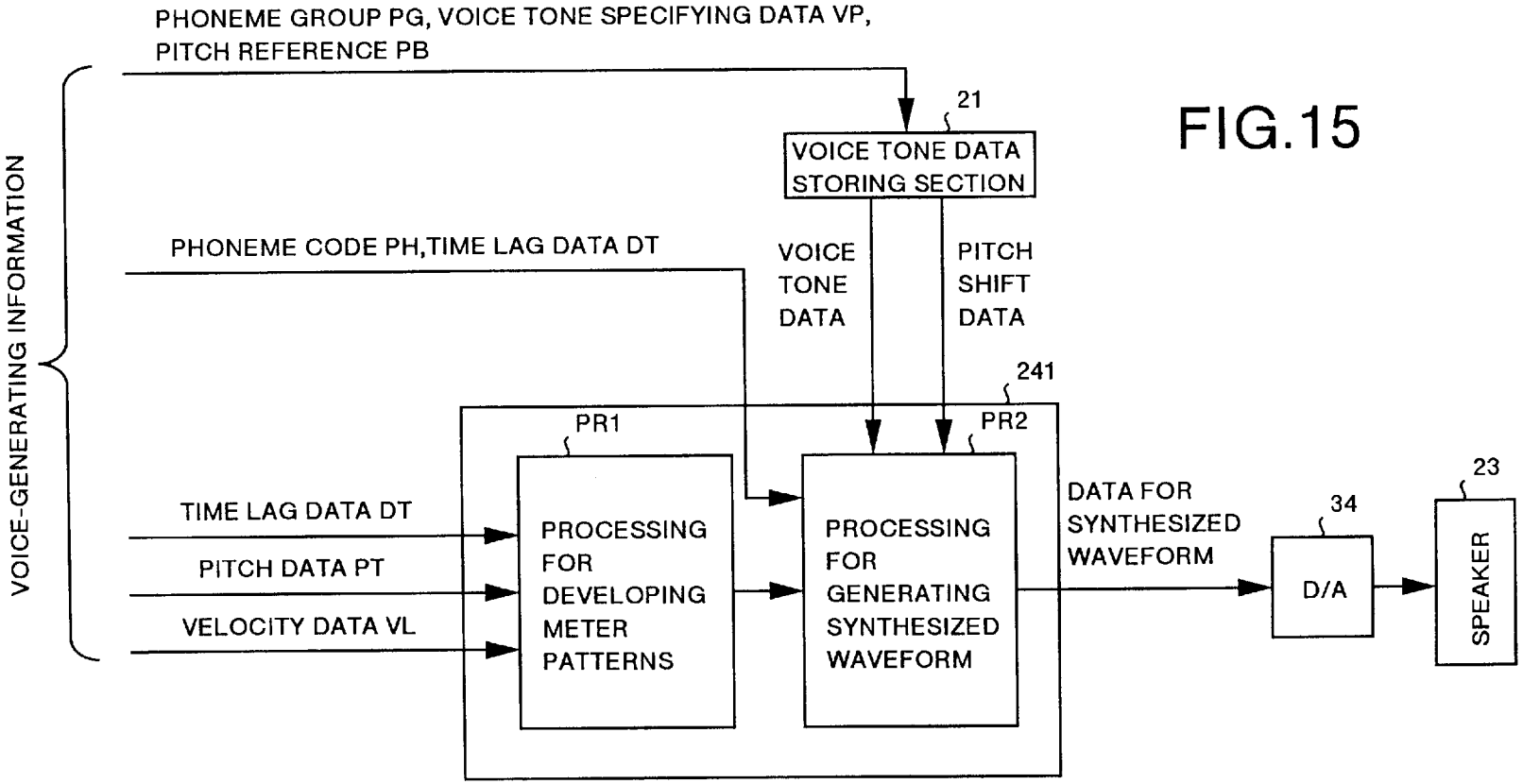
FIG. 15 is a block diagram conceptually explaining the voice reproduction processing according to the embodiment.

Next a description is made for voice synthesis. FIG. 15 is a block diagram for conceptually illustrating the voice reproducing processing according to the embodiment.

The voice reproducing processing is an operation executed by the CPU 241 in the control section 24. Namely, the CPU 241 successively receives voice-generating information and generates data for a synthesized waveform through processing PR1 for developing meter patterns and processing PR2 for generating a synthesized waveform.

The processing PR1 for developing meter patterns is executed by receiving pronouncing information in the voice-generating information of the file information received from the host device 1 or of the file information specified to be read out by the DB 26, and developing meter patterns successively in the direction of a time axis from the data on the time lag data DT, voice pitch PT, and the velocity of a voice VL, each in the pronouncing event PE. It should be noted that the pronouncing event PE has three types of event pattern, as described above, so that pitch and velocity of a voice are specified in a time lag independent from the phoneme.

It should be noted that, in the voice tone data storing section 21, voice tone data is selected according to the phoneme group PG, voice tone specifying data VP, and pitch reference data PB each specified by the header information of the file information received by the host device 1 or the header information of the file information stored in the DE 26, and pitch shift data for deciding a pitch value is supplied to the processing PR2 for generating a synthesized waveform. A time lag, pitch, and velocity are decided as relative values according to the time resolution TD, pitch reference data PB, and volume reference data VB as a reference respectively.

In the processing PR2 for generating a synthesized waveform, processing is executed for obtaining a series of phonemes and a length of duration thereof according to the phoneme code PH as well as to the time lag data DT and making shorter or longer a length of a sound parameter by an appropriate synthesized unit selected from the phoneme series according to the voice tone data.

Then, in the processing PR2 for generating a synthesized waveform, a synthesized waveform data is obtained by executing voice synthesis according to sound parameters as well as to patterns of pitch and velocity of a voice successive in time and obtained through the processing PR1 for developing meter patterns.

It should be noted that an actual and physical pitch frequency is decided by the pattern obtained through the processing PR1 for developing meter patterns and the shift data.

The data for a synthesized waveform is converted from the digital data to analog data by a D/A converter 15 not shown in FIG. 8, and then a voice is outputted by the speaker 23.

Next description is made for operations.

At first, description is made for file transfer. FIG. 16 is a flow chart illustrating an operation for transferring a file in this embodiment, and FIG. 17 and FIG. 18 are flow charts each illustrating processing for reproduction in this embodiment. FIG. 19 to FIG. 22 are views each showing a state shift according to an operation of a display screen during the processing for reproduction.

In this file transfer, the terminal device 2 downloads desired file information from the host device 1 and executes processing for reproduction of a voice or an image.

Concretely, in communications between the host device 1 and the terminal device 2, at first in the terminal device 2, a desired file is selected through a key operation in the key entry section 29 (step T1). In file selection in this step T1, during communications, a list of files which can be transferred is transferred, and the list is displayed in the display section 30 in the terminal device 2.

Then, transfer (download) of the file selected in step T1 is requested to the host device 1 (step T2). This processing for issuing a request is executed when the file selection described above is executed.

In the side of the host device 1, if any request is sent thereto from the terminal device 2, the request is accepted (step H1), and a determination is made as to contents of the request (step H2).

In a case where it is determined that the content is a request for file transfer (step H3), system control shifts to step H4 with the processing for file transfer executed, and in a case where it is determined that the content is not a request for file transfer (step H3), system control shifts to other processing according to a result of the determination.

In the file transfer processing in step H4, the file requested by the terminal device 2 is read out from the DB 11 and transferred to the terminal device 2. In this file transfer, as for voice information, only voice-generating information required for reproduction of a voice is transferred. Namely, in this transfer, file transfer is executed with a small quantity of voice information not including voice tone data.

Then in the terminal device 2, when the desired file has been received (downloaded) (step T3), system control shifts to step T4 and the processing for reproduction is executed.

This processing for regeneration is executed to reproduce a voice or an image according to the file information downloaded from the host device 1. During the processing for reproduction, if an event is inputted and the event is for selection of other file (step T5), system control shifts to step T2, the file transfer request described above is again issued, and if the event is an instruction for terminating the processing (step T6), this processing is terminated, and if the event is an instruction for other processing, processing according to the instruction is executed.

Herein description is made for the processing for reproduction in step T4 with reference to FIG. 15 described above as well as to FIG. 17 and FIG. 18.

Figure 19:
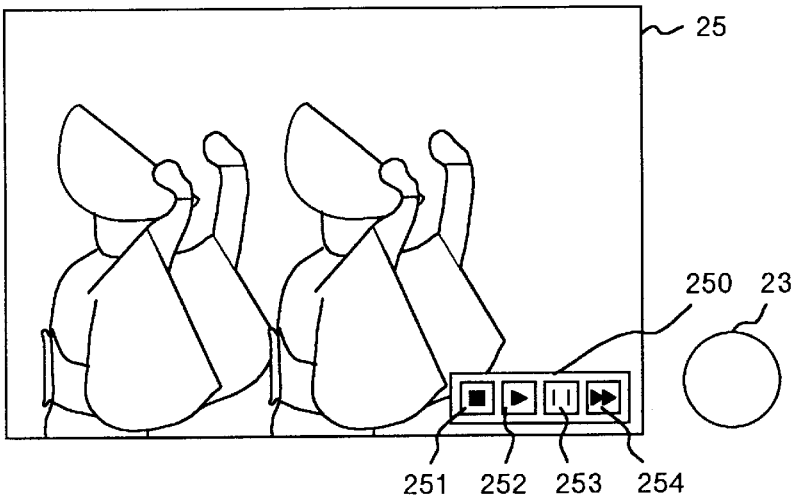
FIG. 19 is a view showing an example of a state shift of a display screen in the voice reproduction processing according to the embodiment.
Figure 20:
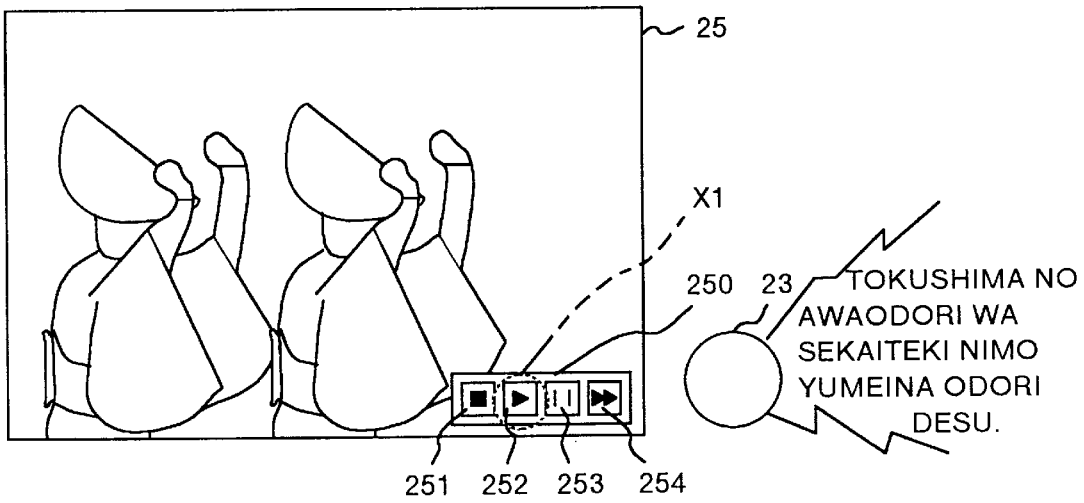
FIG. 20 is a view showing another example of a state shift of a display screen in voice reproduction processing according to the embodiment.

In this processing for reproduction, an operation for regeneration is started according to program information in the file information transferred thereto. At first, in step T401, image information in the file information is read out and an image (in this case, a scene of Awa Odori; a folk dance in Awa (now Tokushma Prefecture) is displayed in the display section 25 as shown in FIG. 19. As this file information includes voice-generating information, a narration control (described as NC hereinafter) window 250 is displayed in FIG. 19.

This NC window 250 comprises a STOP button 251, REPRODUCE button 252, a HALT button 253, and a FAST FEED button 254, and the display position can freely be moved by operating the key entry section 29.

A REPRODUCE button 252 is a software switch for giving an instruction for reproducing narration (voice synthesis realized by generating a voice waveform according to voice-generating information), and the FAST FEED button 254 is a software switch for giving an instruction for fast-feeding a position for reproduction of narration by specifying an address.

The STOP button 251 is a software switch for giving an instruction for stopping reproduction of narration or a fast-feeding operation according to an operation of the REPRODUCE button 252 or the FAST FEED 254 button.

The HALT button 253 is a software switch for giving an instruction for halting a position for reproduction of narration by specifying an address when narration is reproduced.

In the next step T402, voice-generating information in the file information is read and analyzed. In this case, at first, voice tone specifying data VP of header information in the voice-generating information is referred to, and a determination is made as to whether voice tone has been specified according to the voice tone specifying data VP or not (step T403).

In a case where it is determined that voice tone has been specified, system control shifts to step T404, and in a case where it is determined that voice tone has not been specified, system control shifts to step T406.

In step T404, at first the voice tone specified by the voice tone specifying data VP is retrieved from the voice tone section 211 of the voice tone data storing section 21, and determination is made as to whether the voice tone data is prepared in the voice tone section 211 or not.

In a case where it is determined that the specified voice tone data is prepared therein, system control shifts to step T405, and on the other hand, in a case where the specified voice tone is not prepared therein, system control shifts to step T406.

In step T405, the voice tone prepared in the voice tone data storing section 21 is set as a voice tone to be used for reproduction of a voice. Then system control shifts to step T407.

In step T406, it is determined that any voice tone data is not included in the header information, or that the specified voice tone is not prepared in the voice tone section 211, so that data closest to a reference value is selected from pitch reference data PB1, PB2, . . . of pitch reference data PB in the header information, and a voice tone corresponding to the closest pitch reference is selected and set as a voice tone to be used for reproduction of a voice. Then system control shifts to step T407.

Then in step T407, processing is executed through the key entry section 29 for setting pitch of a voice when the voice is synthesized. The voice pitch either may be or may not be set (the pitch reference in the voice tone section 211 is used if the voice pitch is not set), and in a case where the voice pitch is set, the set-up value is employed as a reference value in place of the pitch reference data in the voice tone data.

When system control shifts to step T408, input of an event is waited for. Objects for input includes pressing down of each button in the NC window 250, specification of other file, and specification of termination or the like.

For instance, in a case where a cursor (not shown herein) moves on the display screen to the position shown at X1 and the REPRODUCTION button 252 is pressed down, system control shifts to step T410, and processing for voice synthesis shown in FIG. 15 (corresponding to the processing for reproduction of narration) is executed. In the example shown in FIG. 20, narration of "Tokushma no awaorodi wa, sekaiteki nimo yumeina odori desu" (meaning "Awa-Odori in Tokushima is a dance which is famous all over the world") is reproduced from the speaker 23 in association with the illustration of Awa-Odori displayed in the display section 25.

In a case where displacement of pitch reference has been generated between the voice-generating information and voice tone data in voice synthesis, pitch shift data indicating the shift rate is supplied from the voice tone storing section 21 to the synthesized waveform generating processing PR2. In this synthesized waveform generating processing PR2, the pitch reference is changed according to the pitch shift data. For this reason, the voice pitch changes so that it matches the voice pitch in the voice tone section 211.

Now a detailed description is made for this pitch shift. For instance, in a case where an average pitch frequency is used as a pitch reference and an average pitch frequency of the voice-generating information is 200 [Hz] and that of the voice tone data is 230 [Hz], the pitch in voice synthesis is generally made higher by 230/200 times for voice synthesis. With this feature, it becomes possible to synthesize voice pitch suited to the voice tone data with the voice quality improved.

It should be noted that the pitch reference may be expressed with other parameters such as a cycle based on a frequency.

When voice synthesis is started in step T410 above, system control immediately returns to step T408, and input of the next event is awaited.

Figure 21:
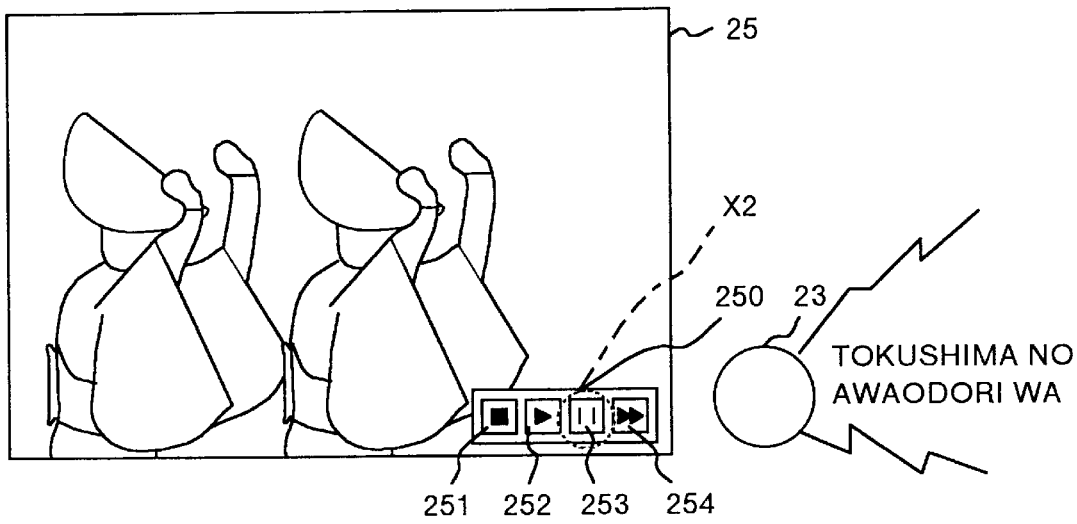
FIG. 21 is a view showing another example of a state shift of a display screen in the voice reproduction processing according to the embodiment.

In a case where voice reproduction is started in step T410 and the HALT button 253 shown at the position of X2 is operated, as shown in FIG. 21, in the stage where the narration of up to "Tokushima no Awaodori wa," ("Awa-Odori in Tokushima") has been reproduced (step T413), system control shifts to step T414, and the processing for reproduction is halted at the position of "," once.

Figure 22:
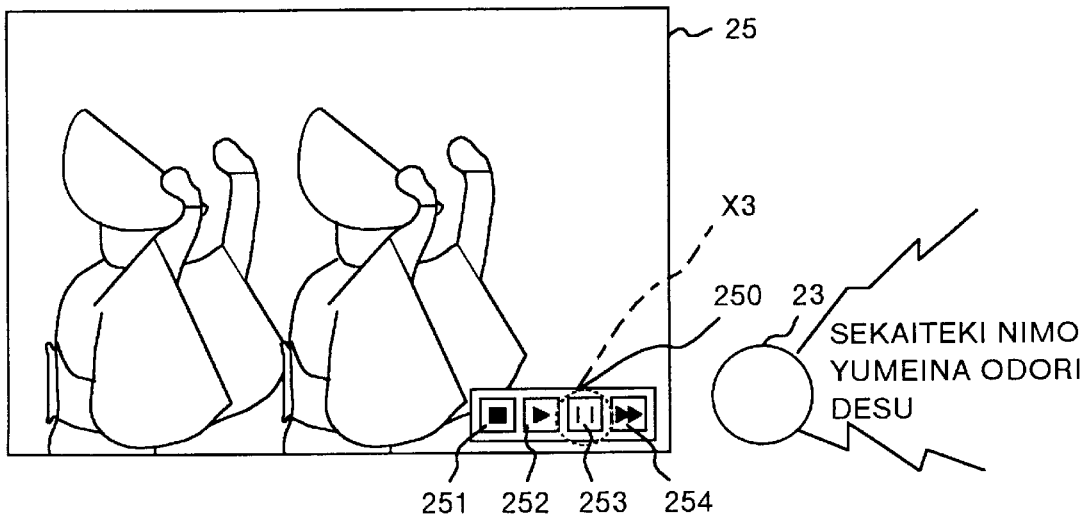
FIG. 22 is a view showing another example of a state shift of a display screen in the voice reproduction processing according to the embodiment.

Then system control shifts to step T408 again, and input of the next event is waited for, but if the HALT button or the REPRODUCTION button 251 is operated, the event input is determined as input of an event for reproduction of a voice in step T409, and in step T410 the narration is reproduced from a position next to the position where the narration was halted before. Namely, as shown in FIG. 22, the narration of "sekaiteki nimo yumeina odori desu" (is a dance which is famous all over the world") is reproduced.

In a case where the HALT button 251 is operated during reproduction of narration (step T411), system control shifts to step T412 with the narration stopped, and even if reproduction of the narration is on the way, the position for next regeneration is returned to a header position of the narration.

Also when narration is to be reproduced, or in a case where the FAST FEED button 254 is operated in the state where input of an event is waited for (step T415), system control shifts to step T416 with the narration under reproduction advanced in a fast mode or with a position for reproduction of the narration fed fast by specifying a memory count.

It should be noted that, in a case where an instruction for issuing a request for other file information to the host device 1 or an instruction for terminating the processing is inputted during the state where input of an event is waited for the processing returns from this processing for reproduction to the file transfer processing (main processing) again.

Next a description is made for file processing by the terminal device 2. FIG. 23 is a flow chart illustrating the processing for making voice-generating information in this embodiment, FIG. 24 is a flow chart illustrating the processing for making new voice-generating information in this embodiment, FIG. 25 is a flow chart illustrating the processing for interruption and reproduction in this embodiment, FIG. 26 to FIG. 33 are views each showing the state shift of an operation screen in the processing for making new voice-generating information in this embodiment, and FIG. 34 is a flow chart illustrating the processing for editing in this embodiment.

This file processing includes the processing for making voice-generating information, processing for interruption and regeneration, processing for reproduction, or the like. The processing for making voice-generating information includes the processing for making new voice-generating information and processing for editing.

In the processing for making voice-generating information shown in FIG. 23, at first processing is selected by operating a key in the key entry section 29 (step S1). Then, a determination is made as to contents of the selected processing, and in a case where it is determined that the processing for making new voice-generating information has been selected (step S2), system control shifts to step S3 and the processing for making new voice-generating information (Refer to FIG. 24) is executed. Also in a case where it is determined that the processing for editing has been selected (step S4), system control shifts to step S5 and the processing for editing (Refer to FIG. 29) is executed.

Then after the processing for making new voice-generating processing (step S3) or processing for editing (step S5) is executed, system control shifts to step S6 and determination is made as to whether an instruction for terminating the processing has been issued or not. If it is determined that the instruction for terminating the processing has been issued, the processing is terminated, and if it is determined that the instruction for terminating the processing has not been issued, system control again returns to step S1.

Next a description is made for the processing for making new voice-generating information with reference to FIG. 26 to FIG. 33. In this processing for making new voice-generating information, at first header information and pronouncing information each constituting the voice-generating information are initialized, and at the same time also a screen for making voice-generating information used for making a file is initialized (step S101).

Then a natural voice is inputted using the microphone 28, or a file of original voice information (waveform data) already registered in the original waveform storing section 27 is opened (step S102), and the original waveform is displayed on the screen for making voice-generating information (step S103). It should be noted that, in a case where a natural voice is inputted anew, the inputted natural voice is analyzed and digitalized by the D/A converter 34 and then displayed as waveform data in the display section 25.

Figure 26:
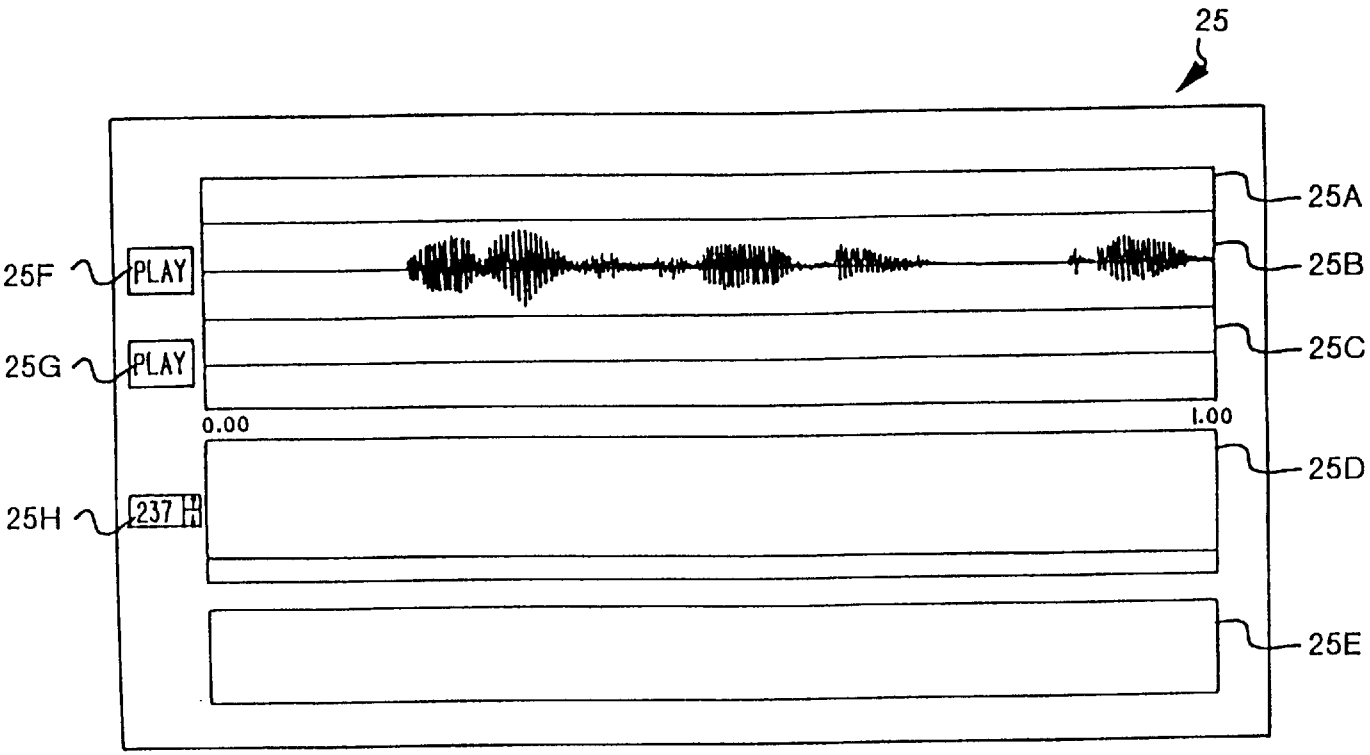
FIG. 26 is a view showing an example of a state shift of an operation screen in the processing for making new voice-generating information according to the embodiment.

The screen for making voice-generating information comprises, as shown in FIG. 26, the phoneme display window 25A, original waveform display window 25B, synthesized waveform display window 25C, pitch display window 25D, velocity display window 25E, original voice reproduce/stop button 25F, synthesized voice waveform reproduce/stop button 25G, pitch reference setting scale 25H or the like each on the display section 25.

On this screen for making voice-generating information, the original waveform formed when a voice is inputted or when a file is opened is displayed on the original waveform display window 25B as shown in FIG. 26.

In the next step S104, to set a duration length of each phoneme in relation to the original waveform displayed on the original waveform display window 25B, labels each separating phonemes from each other along the direction of a time axis are given through a manual operation. Each of the labels can be given by moving the cursor on the display screen by, for instance, operating the key entry section 29 to the inside of the synthesized waveform display located under the original waveform display window 25B to specify the label at a desired position. In this case, the label position can easily be specified by using an input device such as a mouse.

Figure 27:
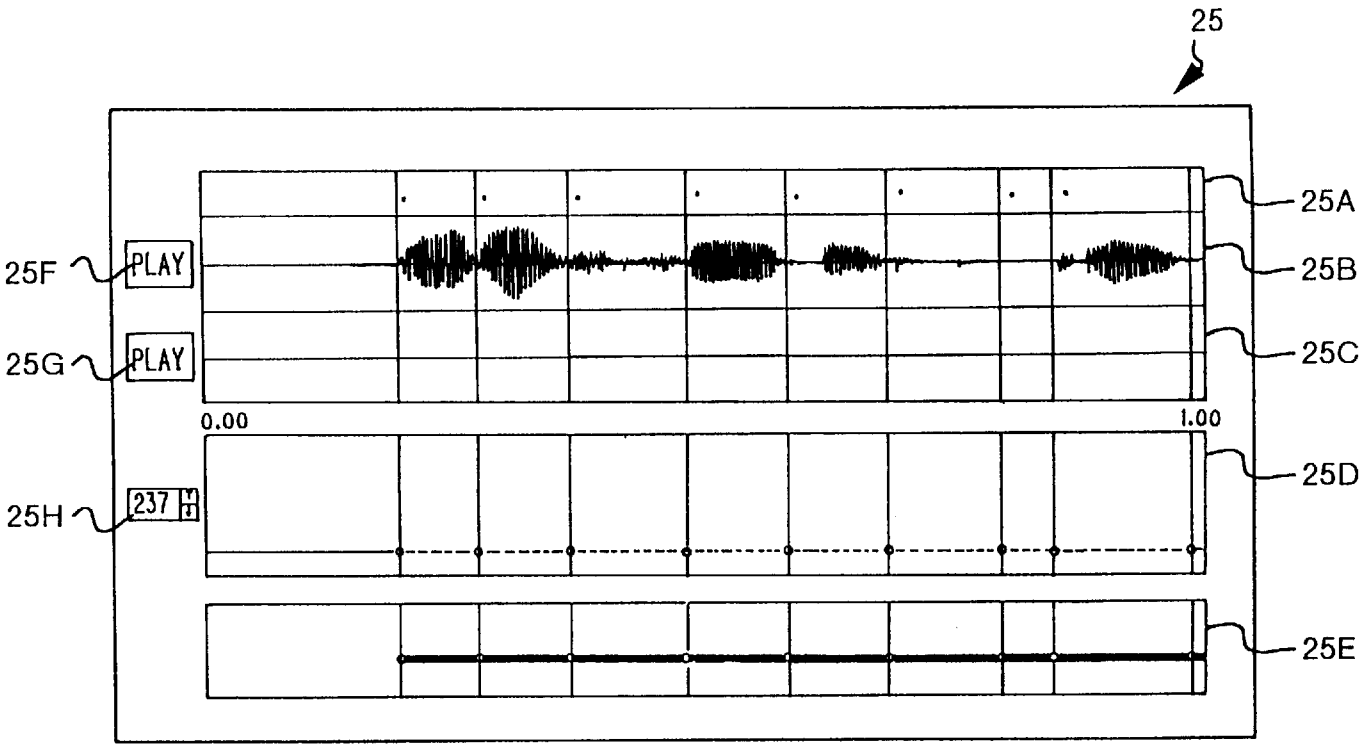
FIG. 27 is a view showing another example of a state shift of an operation screen in the processing for making new voice-generating information according to the embodiment.

Shown in FIG. 27 is an example in which 11 pieces of label are given inside the synthesized waveform display window 25C. When the labels are given, each label is extended also to the phoneme display window 25A, original waveform display window 25B, pitch display window 25D, and velocity display window 25E located above and below the synthesized waveform display window 25C, and within this correlation between the parameters on the time axis is established.

In a case where the inputted natural voice is Japanese, also in the subsequent step S105, phonemes (characters) of Japanese are inputted into the phoneme display window 25A. Also in this case, like in a case of giving a label, phonemes are inputted with the key entry section 29 through a manual operation, and each phoneme is set in each of spaces separated from each other with a label within the phoneme display window 25A.

Figure 28:
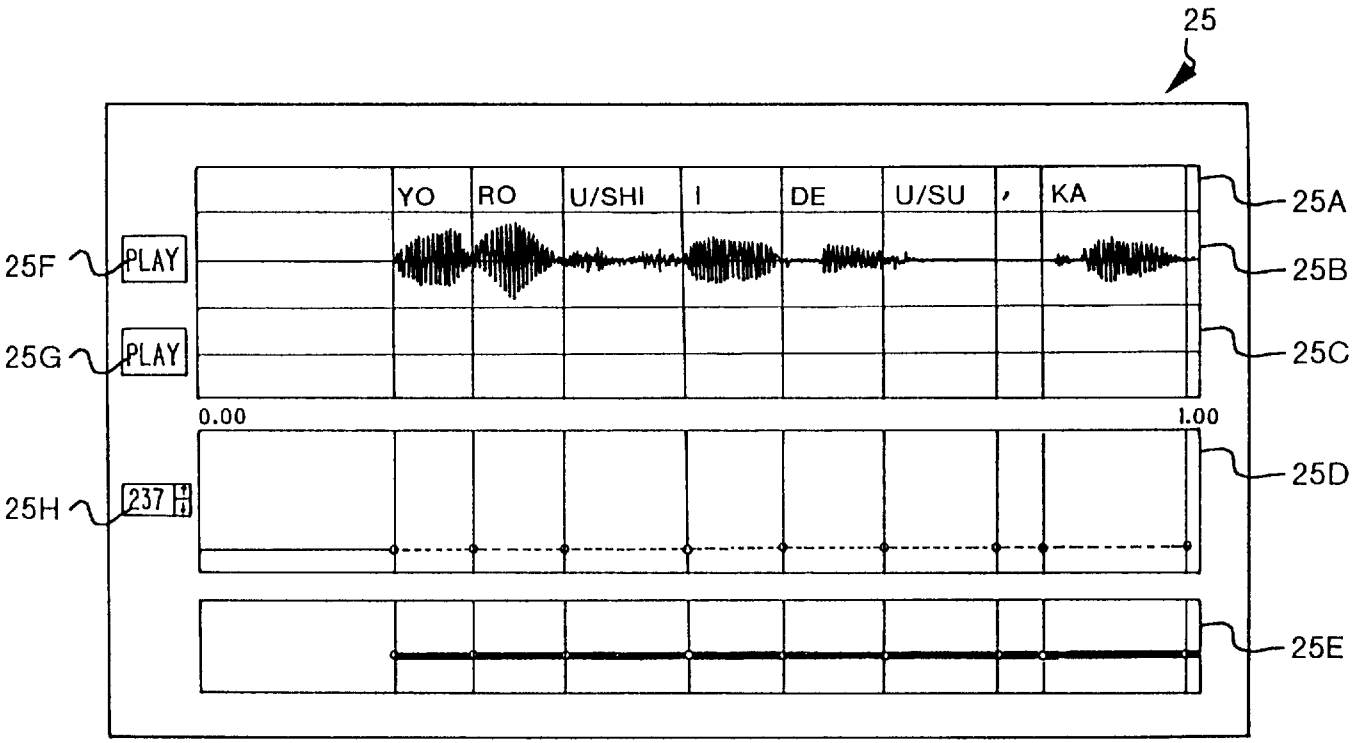
FIG. 28 is a view showing another example of a state shift of an operation screen in the processing for making new voice-generating information according to the embodiment.

Shown in FIG. 28 is a case where phonemes of "yo", "ro","U/shi", "i", "de", "U/su", ", " and "ka" were inputted in this order in the direction of a time axis. Of the inputted phonemes, "U/shi" and "U/su" indicates devocalized phonemes, and others indicate vocalized phonemes.

In the subsequent step S106, pitch analysis is executed for the original waveform displayed in the original waveform display window 25B.

Figure 29:
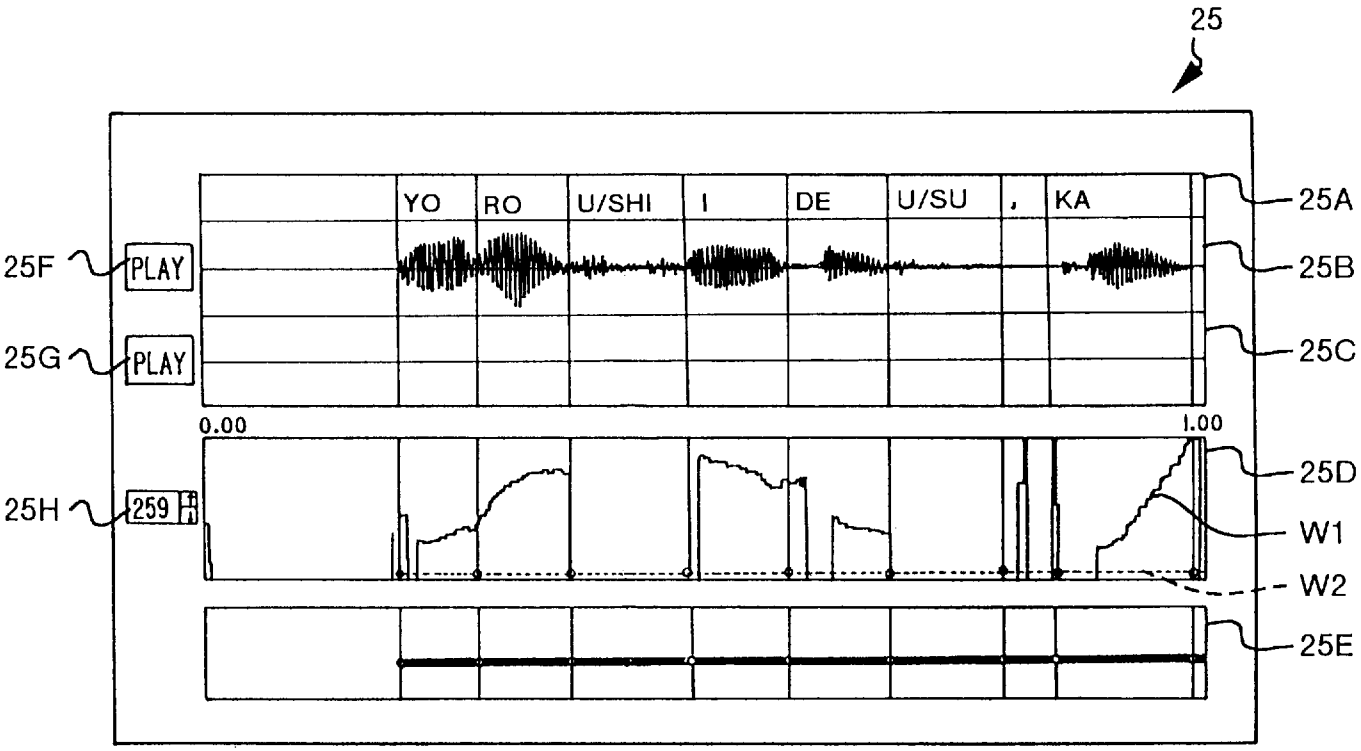
FIG. 29 is a view showing another example of a state shift of an operation screen in the processing for making new voice-generating information according to the embodiment.

Shown in FIG. 29 are a pitch pattern W1 of the original waveform displayed in the pitch display window 25D and having been subjected to pitch analysis (a portion indicated by a solid line in FIG. 29) and a synthesized pattern W2 of the original waveform (a portion indicated by a dashed line linked with a circle at the label position in FIG. 29) each shown, for instance, with a different color respectively.

In the next step S107, pitch adjustment is executed. The pitch adjustment includes such operations as addition, movement (in the direction of a time axis or in the direction of level), deletion of a pitch value each associated with addition of a pitch label, movement in the direction of time axis, and deletion of a pitch label respectively.

In this pitch adjustment, a user manually sets the pitch pattern W2 of the synthesized waveform visually referring to a pitch pattern of the original waveform, and in this step, the pitch pattern W1 of the original waveform is kept fixed. The pitch pattern W2 of a synthesized waveform is specified with a dot pitch at the label position on the time axis, and interpolates a section between labels each having a time lag not dependent of a time zone for each phoneme with a straight line.

Figure 30:
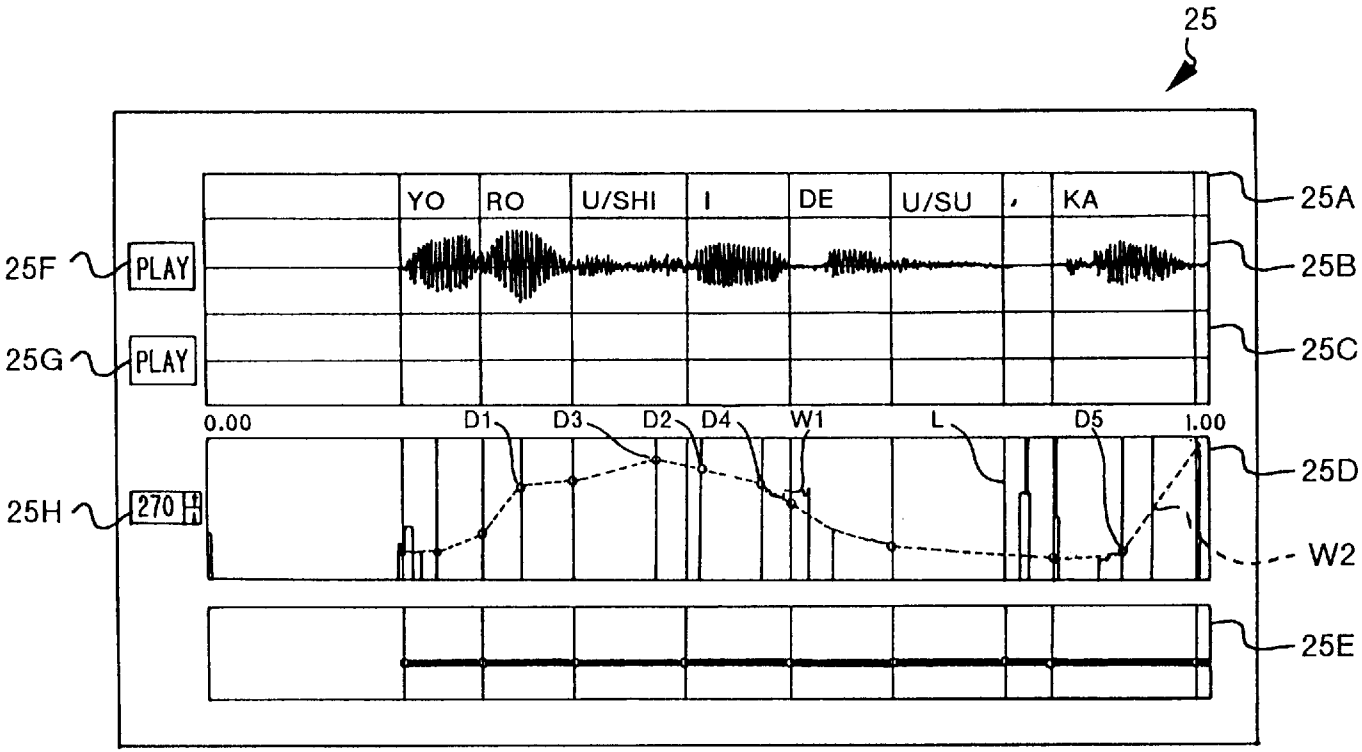
FIG. 30 is a view showing another example of a state shift of an operation screen in the processing for making new voice-generating information according to the embodiment.

In adjustment of a pitch label, as shown in FIG. 30, a label can be added to a section between labels each separating phonemes from each other. For adding a new label, the label position may directly be specified at a label position, as indicated by D1, D3, D4, D5, with a device like a mouse. The pitch newly added as described above is linked to adjoining pitch with a straight line respectively, so that a desired pitch change can be given in one phoneme, which makes it possible to realize an ideal meter.

Also for movement of a pitch label, a destination for movement of the label pitch may directly be specified as indicated by the reference numeral D2, with a mouse or the like within the pitch display window 25D. Also in this movement of a pitch label, a pitch is linked with adjoining pitches with a straight line respectively, so that a desired pitch change can be given to one phoneme, which makes it possible to realize an ideal meter.

It should be noted that, also in a case where a pitch is deleted from a pitch label, the pitch is linked to adjoining pitches exclusive of the deleted pitch with a straight line respectively, so that a desired pitch change can be given to one phoneme, which makes it possible to realize an ideal meter.

In this case, pronouncing event PE1 is set.

Figure 31:
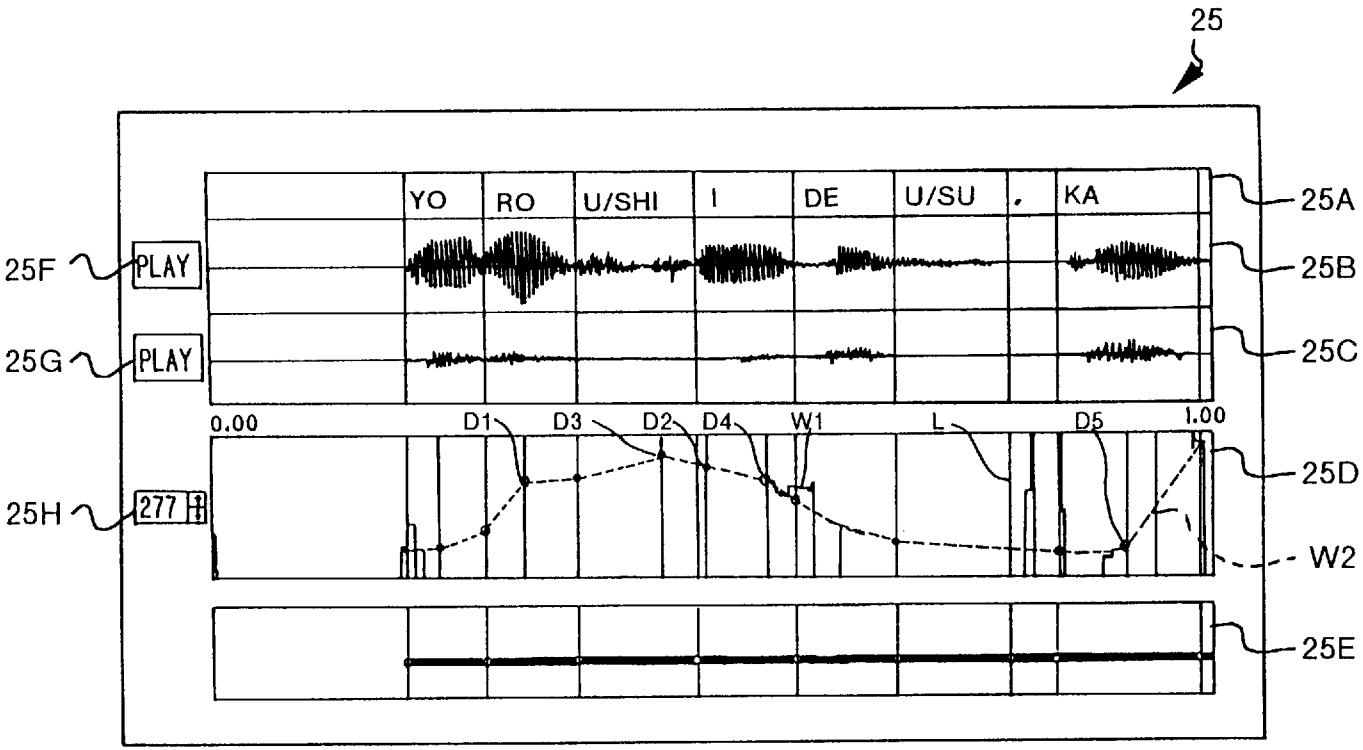
FIG. 31 is a view showing another example of a state shift of an operation screen in the processing for making new voice-generating information according to the embodiment.

In the next step S108, a synthesized waveform having been subjected up to the pitch adjustment is generated, and for instance, as shown in FIG. 31, the synthesized waveform is formed and displayed in the synthesized waveform display window 25C. In this step, as velocity has not been set, plain velocity is displayed in the velocity display window 25E as shown in FIG. 31.

Also when a synthesized waveform is displayed in step Sl08, it is possible to compare the original voice to the synthesized voice and reproduce the synthesized voice. In this step, a type of tone of the synthesized voice is a default voice tone.

In a case where the original voice is reproduced, the original voice reproduce/stop button 25F is operated, and in a case where the reproduction is to be stopped, the original voice reproduce/stop button 25F may be pressed down again. Also for reproducing the synthesized voice, the synthesized voice reproduce/stop button 25G should be operated, and when the synthesized voice reproduce/stop button 25G is operated again, the reproduction is stopped.

The processing for reproduction is executed as processing for making new voice-generating information or as an interrupt/reproduce processing during the processing for editing described later. The details are the same as those of the operation shown in FIG. 25. Namely, in step S201, at first a determination is made as to whether an object for reproduction is an original voice or a synthesized voice according to an operation of either the original voice reproduce/stop button 25F or the synthesized voice reproduce/stop button 25G.

In a case where it is determined that an object for reproduction is an original voice (step S202), system control shifts to step S203 and the original voice is reproduced and outputted from the original waveform, and on the other hand in a case where it is determined that an object for reproduction is a synthesized voice (step S202), system control shifts to step S204 and the synthesized voice is reproduced and outputted from the synthesized waveform. Then system control returns to the operation of a point of time of interruption by the processing for making new voice-generating information.

Returning to description of the processing for making new voice-generating information again, in the next step S109, the velocity indicating a volume of a phoneme is manually adjusted. This velocity adjustment is executed, as shown in FIG. 32, in a range of a pre-specified stages (for instance, 16 stages).

Also in this velocity adjustment, like in the pitch adjustment described above, velocity of a voice can be changed more minutely as compared to a time lag of each phoneme on the time axis not dependent on any time zone between phonemes.

Figure 32:
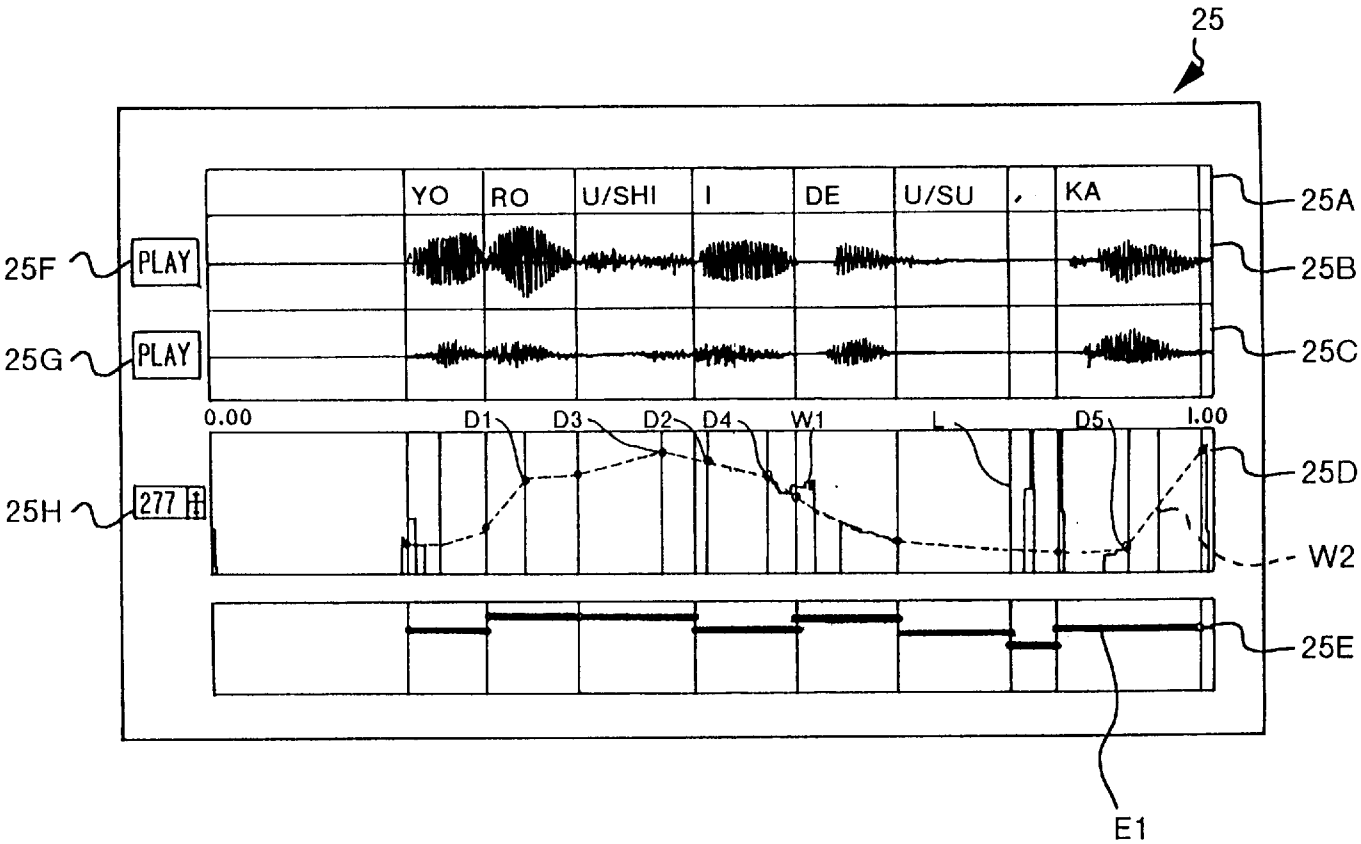
FIG. 32 is a view showing another example of a state shift of an operation screen in the processing for making new voice-generating information according to the embodiment.
Figure 33:
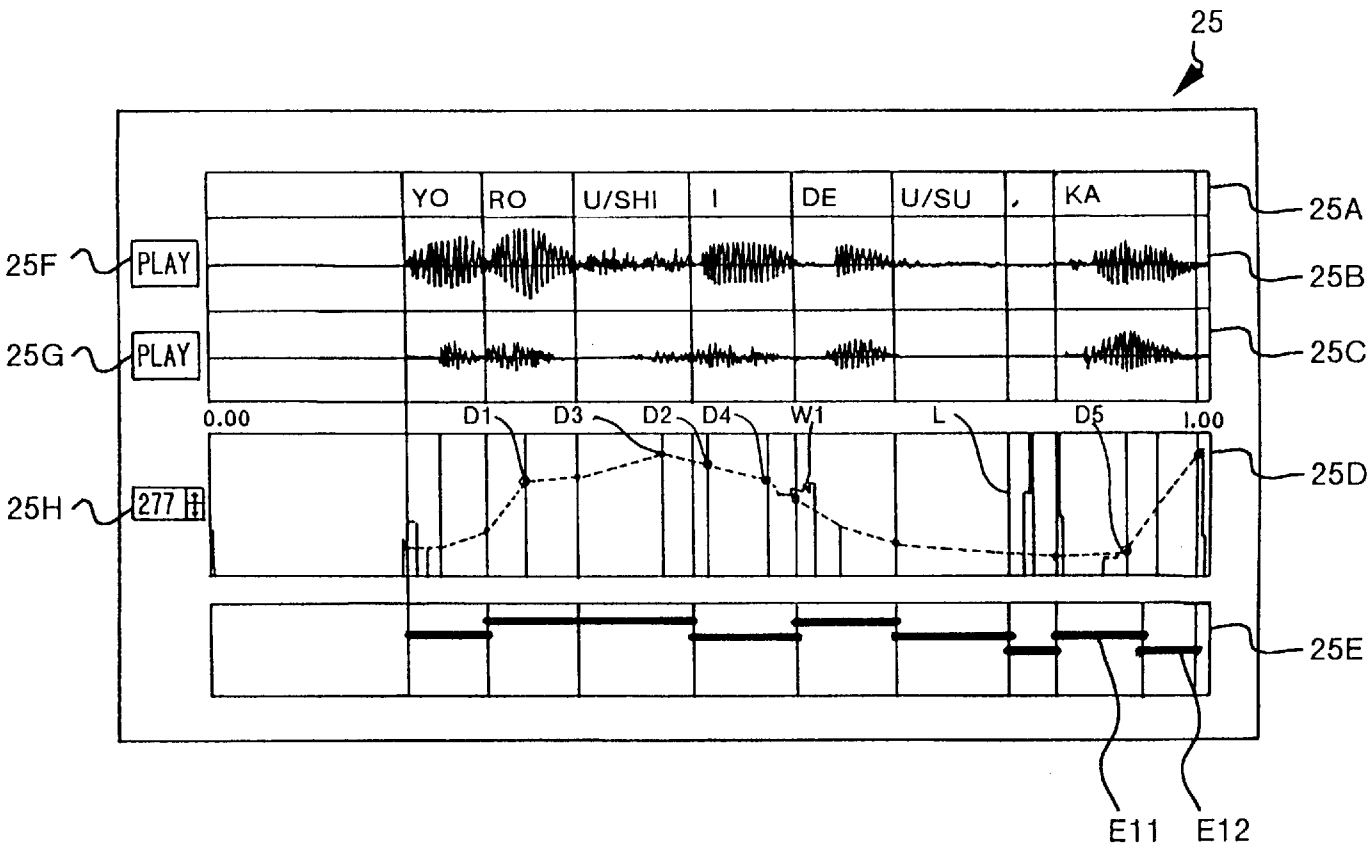
FIG. 33 is a view showing another example of a state shift of an operation screen in the processing for making new voice-generating information according to the embodiment.

For instance, velocity E1 in a time zone for the phoneme of "ka" in the velocity display window 25E shown in FIG. 32 can be subdivided to velocity E11 and velocity E12 as shown in FIG. 33.

If reproduction of a synthesized voice is executed again after the velocity adjustment, velocity of voice changes with a time lag not dependent on a time lag between phonemes and accent clearer than that in the plain velocity can be added to the voice. It should be noted that a time zone for velocity of a voice may be synchronized to that for a pitch label obtained through pitch adjustment.

Then, in this step S110, a determination is made as to whether an operation for terminating the processing for making new voice-generating information has been executed or not, and in a case where it is determined that the operation for terminating the operation for making new voice-generating operation has been executed, system control shifts to step S117, and the processing for new filing is executed. In this processing for new filing, a file name is inputted and a new file corresponding to the file name is stored in the DB 26. If the file name is "A", the voice-generating information is stored in the form of header information HDRA and pronouncing information PRSA as shown in FIG. 14.

In step S110, if it is determined that the operation for terminating the processing for making new voice-generating information is not executed and that any of the operations for changing velocity (step S111), changing pitch (step S112), changing a phoneme (step S113), changing a label (step S114), and changing voice tone setting (step S115) is executed, system control shifts to the processing corresponding to the request for changing.

If change of velocity is requested (step S111), system control returns to step S109, and a value of velocity is changed for each phoneme through a manual operation. If change of pitch is requested (step S112), system control returns to step S107, and a value of pitch is changed (including addition or deletion) for each label through a manual operation.

If change of a phoneme is requested (step S113), system control returns to step S105, and the phoneme is changed through a manual operation. If change of a label is requested (step S114), system control returns to step S104, and the label is changed through a manual operation. In the label change as well as in the pitch change, the pitch pattern W2 of a synthesized waveform is changed according to a pitch interval after the change.

If change of voice tone setting is requested (step S115), system control shifts to step S116, and the voice tone is changed and set to a desired type thereof through a manual operation. After this change of voice tone setting, if a synthesized voice is reproduced again, features of the voice become different, so that, for instance, a natural voice having a male's voice tone can be changed to a voice having, for instance, a female's voice tone.

It should be noted that, if it is determined in step S109 that an operation for terminating the processing for making new voice-generating information has not been executed, and at the same time that an operation for changing any parameter has not been executed, the processing of returning from step S115 to step S1110 is repeatedly executed.

In change of each parameter, only the parameter specified to be changed is changed. For instance, if change of a label is requested and the processing in step S104 is terminated, the processing from step S105 to step S109 is passed through, and execution of the processing is resumed from step S110.

Next a description is made for the processing for editing with reference to FIG. 34. The processing for editing includes the addition of parameters to, change of parameters in, and deletion of parameters from a file already made, and basically the same processing as that in the processing for making new voice-generating information is executed.

Namely, in the processing for editing, at first in step S301, a file as an object for editing is selected and operated referring to the file list in the DB 26. And a screen like that in the processing for making new voice-generating information is formed and displayed in the display section 25.

In this processing for editing, an original synthesized waveform as an object for editing is treated as an original waveform, and the original waveform is formed and displayed in the original waveform display window 25B.

In the next step S302, an operation for editing is selected. This selection corresponds to selection of an operation for changing in the processing for making new voice-generating information.

In this operation for editing, if it is determined that any change of a label (step S303), change of a phoneme (step S305), change of pitch (step S307), change of velocity (step S309), and change of voice tone setting (step S311) has been requested, system control shifts to processing corresponding to the request.

Namely, if change of a label is requested (step S303), system control shifts to step S304, and the label is changed through a manual operation. It should be noted that, also in this processing for editing, if change of a label or change of pitch is requested, the pitch pattern W2 of a synthesized waveform changes according to the request.

If change of a phoneme is requested (step S303), system control shifts to step S306, and the phoneme is changed through a manual operation. If change of pitch is requested (step S307), system control shifts to step S308, and the pitch value is changed (including addition or deletion) for each label through a manual operation.

If change of velocity is requested (step S309), system control shifts to step S310, and a value of velocity is changed for each phoneme through a manual operation. If change of voice tone setting is requested (step S311), system control shifts to step S312, and the voice setting is changed to a desired type of voice tone through a manual operation.

If it is determined in step S302 that an operation for terminating the processing for editing has been executed, system control shifts to step S313, it is confirmed that the operation for terminating the processing for editing has been executed, and further system control shifts to step S314. In this step S314, processing for editing and filing is executed, and in this step it is possible to arbitrarily select registration as a new file or overwriting on an existing file.

It should be noted that, after change of each parameter, system control may return to step S302 again to continue the operation for changing parameters.

Next description is made for file registration. FIG. 35 is a flow chart illustrating the processing for registering a file in this embodiment.

In this operation for registering a file, the terminal device 2 uploads a desired file to the host device 1, where processing for registering voice-generating information is executed.

Concretely, in communication between the host device 1 terminal device 2, at first in the terminal device 2, a prepared file is selected through a key operation in the key entry section 29 (step T11). In this file selection in step T11, files stored in the DB 26 may be displayed in a list form for selection.

Then transfer (upload) of the file selected in step T11 is requested to the host device 1 (step T12). This request is issued when the operation for selecting a file described above is executed.

In the side of the host device 1, if any request is issued thereto from the terminal device 2, the request is accepted (step H1 like that in the file transfer described above), and determination is made as to contents of the request (step H2 like that in the file transfer described above).

If it is determined that the request is for registration of a file (step H5), system control shifts to step H6, and acknowledgment of the request for file registration is returned to the terminal device 2. If it is determined in step H5 that the request is not for file registration, system control shifts to other processing corresponding to contents of the request.

In the side of the terminal device 2, if acknowledgment of reception is received from the host device 1, file information to be registered is read out from the DB 26 and the file is transferred to the host device 1.

In the side of the host device 1, when the file requested to be registered is received (downloaded) (step H7), system control shifts to step H8, and the file is registered in the DB 11.

As described above, when file registration in the host device 1 is finished, a file registered in the DB 11 can be accessed from other terminal devices connected to the communication network NET, and in this step the file transfer described above is executed.

As described above, in this embodiment, file information including voice-generating information is transferred from the host device 1 to the terminal device 2, and in the terminal device 2, a meter pattern arranged successively in the direction of a time axis is developed according to the velocity or pitch of a voice but not dependent on any phoneme, and a voice waveform is generated according to the meter pattern as well as to the voice tone data selected according to the information indicating a type of voice tone in voice-generating information, so that a voice can be reproduced with an optimal voice tone directly specified from a plurality of types of voice tone without limiting the voice tone to any particular tone, and no displacement is generated in voice pitch when a waveform is synthesized. Thus, by obtaining an optimal correspondence between voice-generating information and voice tone information without fixing it, it is possible to maintain high voice quality in voice synthesis.

Also a reference for voice pitch of voice-generating information is shifted according to a reference for voice pitch in the voice tone section 211 when the voice is reproduced, so that pitch of each voice relatively changes according to the shifted reference for voce pitch irrespective of a time lag between phonemes. For this reason, reference for voice pitch becomes closer to a reference for voice tone, which makes it possible to further improve quality of a reproduced voice.

Also a reference for voice pitch of voice-generating information is shifted, when a voice is reproduced, according to an arbitrary reference of voice pitch, so that pitch of each voice relatively changes according to the shifted reference for voice pitch irrespective of a time lag between phonemes, and it is possible to process a voice tone by, for instance, getting the voice quality closer to an intended one according to the shift rate.

Also a reference for voice pitch is an average frequency, a maximum frequency, or a minimum frequency of voice pitch, so that it is easy to set a reference for voice pitch.

Also in the terminal device 2, voice tone data is read out from a storage medium and stored in the voice tone section 211, so that various types of voice tone are available through the storage medium and an optimal voice tone can be applied when a voice is reproduced.

Also in the terminal device 2, voice tone data is received through a communication line LN from an external device and the voice tone data is stored in the voice tone section 211, so that various types of voice tone are available through the communication line LN, and an optimal voice tone can be applied when a voice is reproduced.

Also in the terminal device 2, voice-generating information is made depending on an inputted natural voice by dispersing discrete voice data for either one or both velocity and pitch of a voice each data not being dependent of a time lag between phonemes but at present at a relative level against the reference, and the voice-generating information is transferred to the host device 1 and registered in the DB 11, so that velocity or pitch of a voice can be given at an arbitrary point of time not dependent on a time lag between phonemes.

Also when voice-generating information is made, a reference for voice pitch is set in the state where it is included in the voice-generating information, so that a reference for voice pitch can be included in the voice-generating information.

Also when voice-generating information is made, each parameter can arbitrarily be changed, so that information can freely be changed to improve the voice quality.

Next description is made for variants of the embodiment described above.

In Variant 1, the processing for making new voice-generating information described above is changed, so that description is made below for the processing for making new voice-generating information in this variant.

Figure 36:
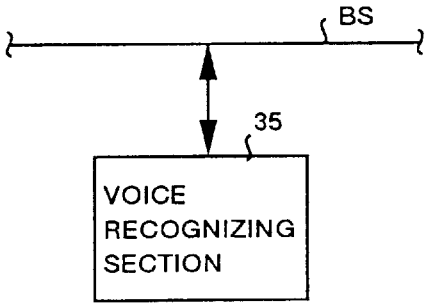
FIG. 36 is a block diagram showing a key part according to Variant 1 of the embodiment.

FIG. 36 is a block diagram showing a key section in Variant 1 of this embodiment. The apparatus according to this variant has the configuration in which a voice identifying section 35 is added to the terminal device 2 described above (Refer to FIG. 8), and is connected to a bus B.S.

This voice identifying section 35 identifies a voice depending on a natural voice inputted through the microphone 28, and a result of identification is supplied to the control section 24. In this control section 24, processing for converting the inputted natural voice to character code (by referring to the phoneme table described above) from the result of identification supplied thereto is executed.

Figure 37:
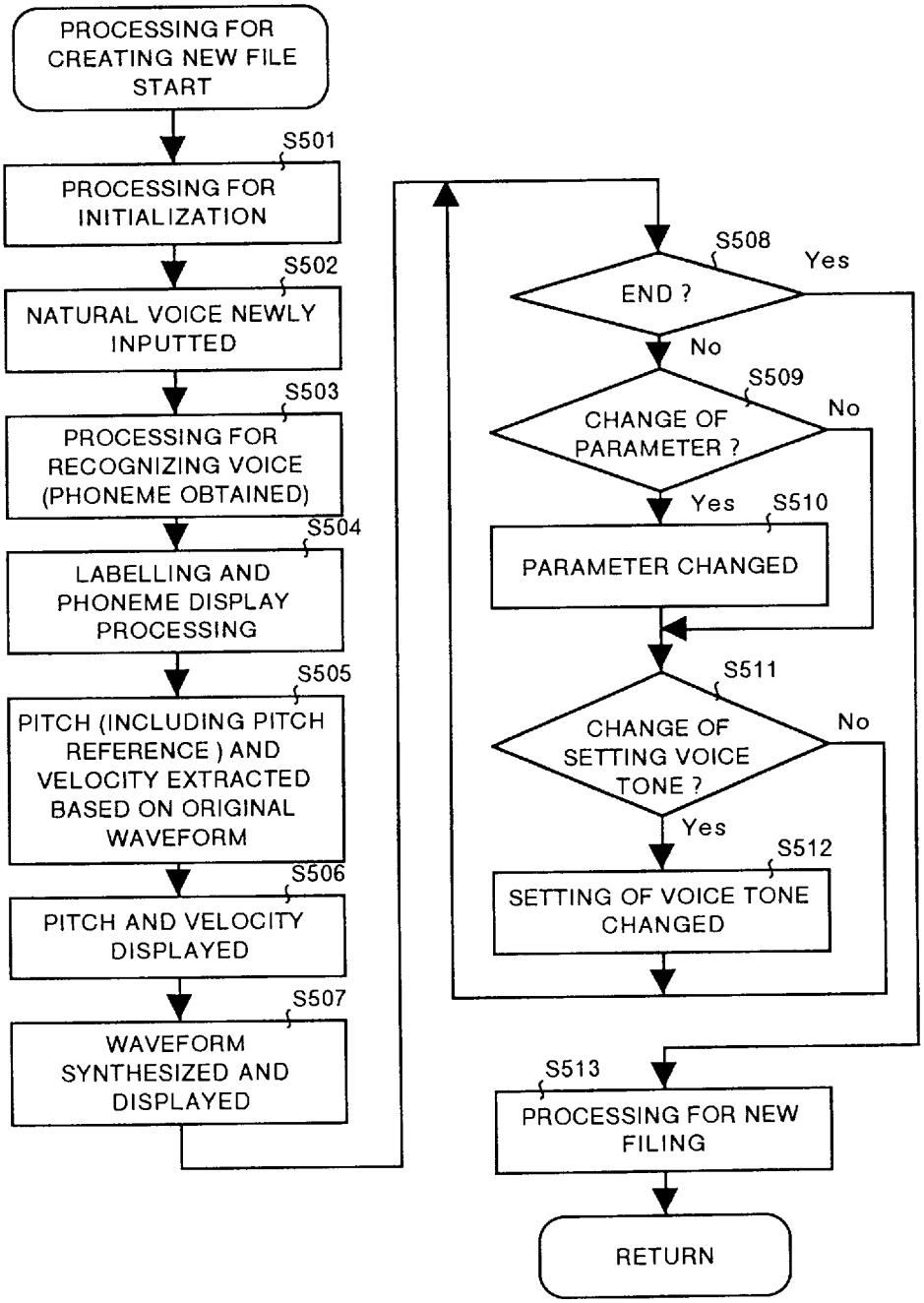
FIG. 37 is a flow chart illustrating the processing for making new voice-generating information according to Variant 1 of the embodiment.

Then description is made for main operations in this variant. FIG. 37 is a flow chart illustrating the processing for making new voice-generating information in Variant 1.

In the processing for making new voice-generating information in Variant 1, like in the step S101 described above (Refer to FIG. 24), at first header information and pronouncing information each constituting voice-generating information are initialized, and also a screen used for making a file is initialized (step S501).

Then, when a natural voice is inputted through the microphone 28 (step S502), the original waveform is displayed in the original waveform display window 25B on the screen for making a file (step S503).

It should be noted that the screen for making a file comprises, like in the embodiment described above (Refer to FIG. 17), the phoneme display window 25A, original waveform display window 25B, synthesized waveform display window 25C, pitch display window 25D, velocity display window 25E, original voice reproduce/stop button 25F, synthesized voice reproduce/stop button 25G, pitch reference setting scale 25H each present on the display section 25.

In this variant, voice identification based on an original waveform provided by inputting a voice is executed in the voice identifying section 35, and the phonemes are fetched in batch (step S503).

In the next step S504, phonemes are automatically allocated in the phoneme display window 25A according to the fetched phonemes and the original waveform, and in this step a label is assigned thereto. In this case, a time interval (a range on the time axis) between the phoneme name (character) and the phoneme is computed.

Further in step S505, pitch (including a pitch reference) and velocity are extracted from the original waveform, and in the next step S506 the pitch and velocity each correlated to a phoneme and extracted are displayed in the pitch display window 25D and in the velocity display window 25E respectively. It should be noted that there is a method of setting a pitch reference by setting it to a value two times larger than a minimum value of the pitch frequency.

Then, a voice waveform is generated depending on each parameter and default voice tone data, and the voice waveform is displayed in the synthesized waveform display window 25C (step S507).

Then in step S508, a determination is made as to whether the processing for making new voice-generating information has been terminated or not, and if it is determined that the processing for making new voice-generating information has been terminated, system control shifts to step S513, and the processing for making a new file is executed. In this processing for making a new file, a file name is inputted and the newly prepared file is stored in correspondence to the file name in the DB 26.

Also if it is determined in step S508 that the processing for making new voice-generating information has not been terminated and that an operation for changing any parameter of velocity, pitch, phonemes and labels has been executed (step S509), system control shifts to step S510, and processing for changing the object parameter is executed.

If it is determined in step S511 that the processing for changing voice tone setting has been executed, system control shifts to step S512, and the voice tone setting is changed.

It should be noted that, while an operation for terminating the processing for making new voice-generating information is not detected in step S508 and also execution of the processing for changing any parameter is not detected in step S509 or in step S511, the processing in step S508, S509, and S512 is repeatedly executed.

Even if each parameter is changed after a natural voice is inputted and the synthesized waveform is automatically obtained once, it is possible like in the embodiment described above to realize practical voice synthesis maintaining voice reproduction with high quality.

In Variant 2 of the present embodiment, after voice synthesis is executed once, a velocity value may be optimized by comparing the original waveform to an amplitude pattern of the synthesized waveform to adjust the synthesized waveform according to an amplitude of the original waveform, and in this case quality of the voice can further be improved.

In Variant 3, in a case where voice tone data specified by voice-generating information is not included in the voice tone section, voice tone having a feature (voice tone attribute) similar to a feature (voice tone attribute) of the voice-generating information may be selected from the voice tone section for voice synthesis.

Next a detailed description is made for the Variant 3. FIG. 38 is a view illustrating an example of a configuration of header information according to Variant 3, FIG. 39 is a view illustrating an example of a configuration of voice tone attribute in the header information, FIG. 40 is a view illustrating an example of a configuration of the voice tone section according to Variant 3, and FIG. 41 is a view illustrating an example of a configuration of voice tone attribute in the voice tone section shown in FIG. 40.

In this Variant 3, as shown in FIG. 38 and FIG. 40, voice tone attribute having a common format is prepared in header information in voice-generating information as well as in the voice tone section 213.

As for the header information HDRX in the voice-generating information, voice tone attribute information AT is added as a new parameter to the header information applied in the embodiment described above.

As shown in FIG. 39, this voice attribute information AT has the structure in which sex data SX, age data AG, a pitch reference PB, a clearance degree CL, and a degree of naturality NT are correlated to each other.

Similarly as for the voice tone section 213, voice tone attribute information ATn (n: natural number) is added as a new parameter in correlation to the voice tone data, different from the tone section 211 applied in the embodiment described above.

This voice tone attribute information ATn has the structure in which the sex data SXn, age data AGn, a pitch reference PBn, a clearance degree CLn, and a degree of naturality NTn are correlated to each other as shown in FIG. 41.

Common to the voice tone attribute information AT and ATn, each item in the voice tone attribute is defined by:

Sex: −1/1 (male/female)

Age: 0–N

Pitch reference (average pitch) : 100–300 [Hz]

Clearance degree: 1–10 [The larger the number is, the higher the clearance degree is]

Naturality degree: 1–10 [The larger the number is, the higher the naturality is].

It should be noted that the clearance degree and the naturality degree indicate a sensuous level.

Figure 42:
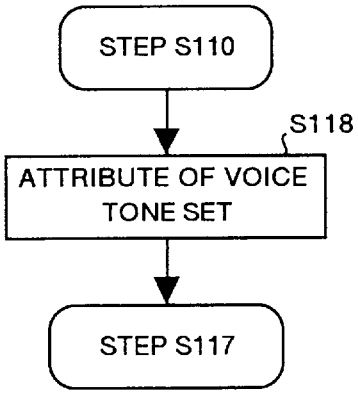
FIG. 42 is a flow chart illustrating main operations in the processing for making new voice-generating information according to Variant 3 of the embodiment.
Figure 43:
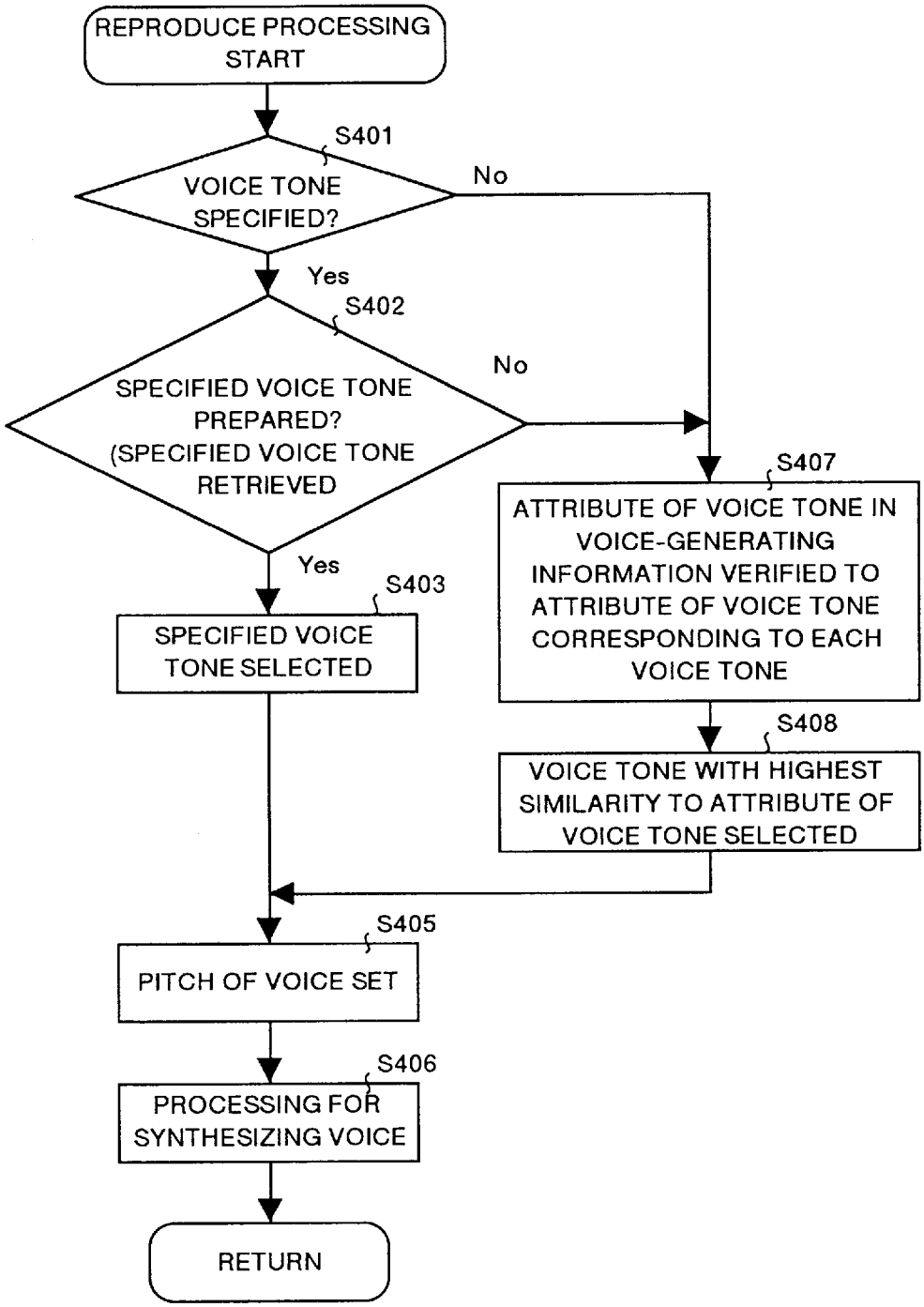
FIG. 43 is a flow chart illustrating the processing for reproduction according to Variant 3 of the embodiment.

Next description is made for main operations in Variant 3. FIG. 42 is a flow chart illustrating main operations in the processing for making new voice-generating information in Variant 3, and FIG. 43 is a flow chart illustrating the processing for reproduction in Variant 3.

The processing for making new voice-generating information is generally the same as the processing for making new voice-generating information in the embodiment as described above (Refer to FIG. 24), so that description is made herein for only the different portions.

In the processing flow shown in FIG. 24, when the processing for making new voice-generating information is terminated, system control shifts from step S110 to step S117, but in this Variant 3, as shown in FIG. 42, system control shifts to step S118, and voice tone attribute setting is executed. Then the processing for making a new file in step S117 is executed.

In step S118, the voice tone attribute information AT described above is prepared and is incorporated in the header information HDRX. Herein it is assumed, for instance, that the following data items are set in the voice tone attribute information AT:

Sex: 1 (female)

Age: 25 (years old)

Pitch reference (Average pitch): 200 [Hz]

Clearance degree: 5 (normal)

Naturality degree: 5 (normal)

Next description is made for the processing for reproduction. Before making the description, an example of contents of each item of the voice tone attribute information ATn in the voice tone section 213 is described below.

In a case of voice tone attribute information AT1, it is assumed that the content of each item therein is as follows:

Sex: −1 (male)

Age: 35 (years old)

Pitch reference (average pitch) : 140 [Hz]

Clearance degree: 7 (modestly high)

Naturality degree: 5 (ordinary)

In a case of voice tone attribute information AT2, it is assumed that the content of each item therein is as follows:

Sex: 1 (female)

Age: 20 (years old)

Pitch reference (average pitch) : 200 [Hz]

Clearance degree: 5 (ordinary)

Naturality degree: 5 (ordinary)

Also the processing for reproduction shown in FIG. 43 is generally the same as the processing for reproduction in the embodiment described above (Refer to FIG. 17 and FIG. 18), so that description is made herein for only the different portions.

In step S402, in a case where it is determined in step S402 that the specified voice tone data is not included, system control shifts to step S407. In step S407, the voice tone attribute information AT in voice-generating information is compared to each voice tone attribute information ATn stored in the voice tone section 213 for verification.

For the purpose of verification, various methods are available including the one in which a difference of each item as an object for verification from the reference is computed, the difference is weighed and squared, and a result of computing for each item is summed up (Euclid distance method), or the one in which an absolute value of the difference for each item is weighed and summed up.

Description is made for a case in which, for instance, a method of computing Euclid distance (DSn) is applied. Weighing for each item used in this method is assumed herein as follows:

Sex: 20

Age: 1

Pitch reference (average pitch): 1

Clearance: 5

Naturality Degree: 3

In this case, a result of verification between the voice tone attribute information AT and AT1 is as follows, $$DS1=(-1—1)*20)^2+((35-25)*1)^2+((140-200)*1)^2+((7-5)\cdot 5)^2+((5—5)*3)^2=720,$$

and also a result of verification between the voice tone attribute information AT and AT2 is as follows:

$$DS2=(-1—1)*20)^2+((20-25)*1)^2+((230-200)*1)^2+((4-5)*5)^2+((7-5)*3)^2=986.$$

So in step S408, the relation of DS1<DS2 is obtained, and the voice tone data VD1 stored in correlation to the voice tone attribute information AT1 with a short distance is selected as a type of voice tone having the closest voice tone attribute.

It should be noted that, although a type of voice tone is directly selected and then a voice is selected according to the voice tone attribute in the description of Variant 3 above, voice tone data may be selected according to the similarity by using only voice tone attribute.

In Variant 3 described above, meter patterns arranged successively in the direction of a time axis are developed according to velocity or pitch of a voice and not dependent on a phoneme, and a voice waveform is generated according to the meter pattern as well as to the voice tone data selected according to the similarity based on information indicating an attribute of voice tone in voice-generating information. Thus, a voice can be reproduced with a voice tone having the highest similarity and without using an inappropriate voice tone, and no displacement in a voice pitch pattern is generated when the voice waveform is generated, which makes it possible to reproduce a voice with high quality.

Also, meter patterns that are arranged successively in the direction of a time axis are developed according to velocity or pitch of a voice and not dependent on a phoneme, and a voice waveform is generated according to the meter pattern as well as to the voice tone data selected according to information indicating a type and an attribute of voice tone in voice-generating information. Thus, a voice can be reproduced with a voice tone having the highest similarity and without using an inappropriate voice tone, even if the voice tone directly selected is not available, and no displacement in a voice pitch pattern is generated when the voice waveform is generated, which makes it possible to reproduce a voice with high quality. Next a description is made for Variant 4 of the embodiment. In this Variant 4, the control event used in the embodiment described above is slightly modified.

Figure 44A:
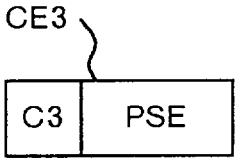
FIGS. 44A and 44B are views showing an example of a configuration of a controlling event according to Variant 4 of the embodiment.
Figure 44B:
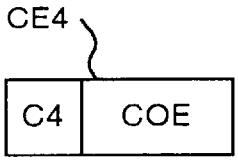

Now detailed description is made below for the control event CE in Variant 4. FIG. 44 is a view showing a configuration of the control event in Variant 4.

In variant 4, a pause event CE3 and a completion event CE4 are added anew to the control event CE.

The pose event CE4 has the structure in which identifying information C3 is correlated to pause event data PSE, and is an event for pausing once reproduction of narration at an arbitrary point of time.

Namely, this pose event can be incorporated, like other control events CE1, CE2, and CE4, in pronouncing data, and reproduction of the narration is paused when this event occurs. This paused state is released in synchronism to an operation according to other types of information (such as screen display).

The identifying information C3 added to the header of the pause event CE3 indicates a pause which is a type of control event.

The completion event CE4 has the structure in which the identifying information C4 is correlated to completion event data COE, and is an event for reporting up to what point reproduction of narration has been executed to an external upper application or the like.

Namely this completion event CE4 can be incorporated, like other control events CE1, CE2, CE3, in pronouncing data, and reports the completion of reproduction of narration to an upper application upon occurrence thereof.

The identifying information C4 added to the header of the completion event CE4 indicates a completion which is a type of control event.

Figure 45:
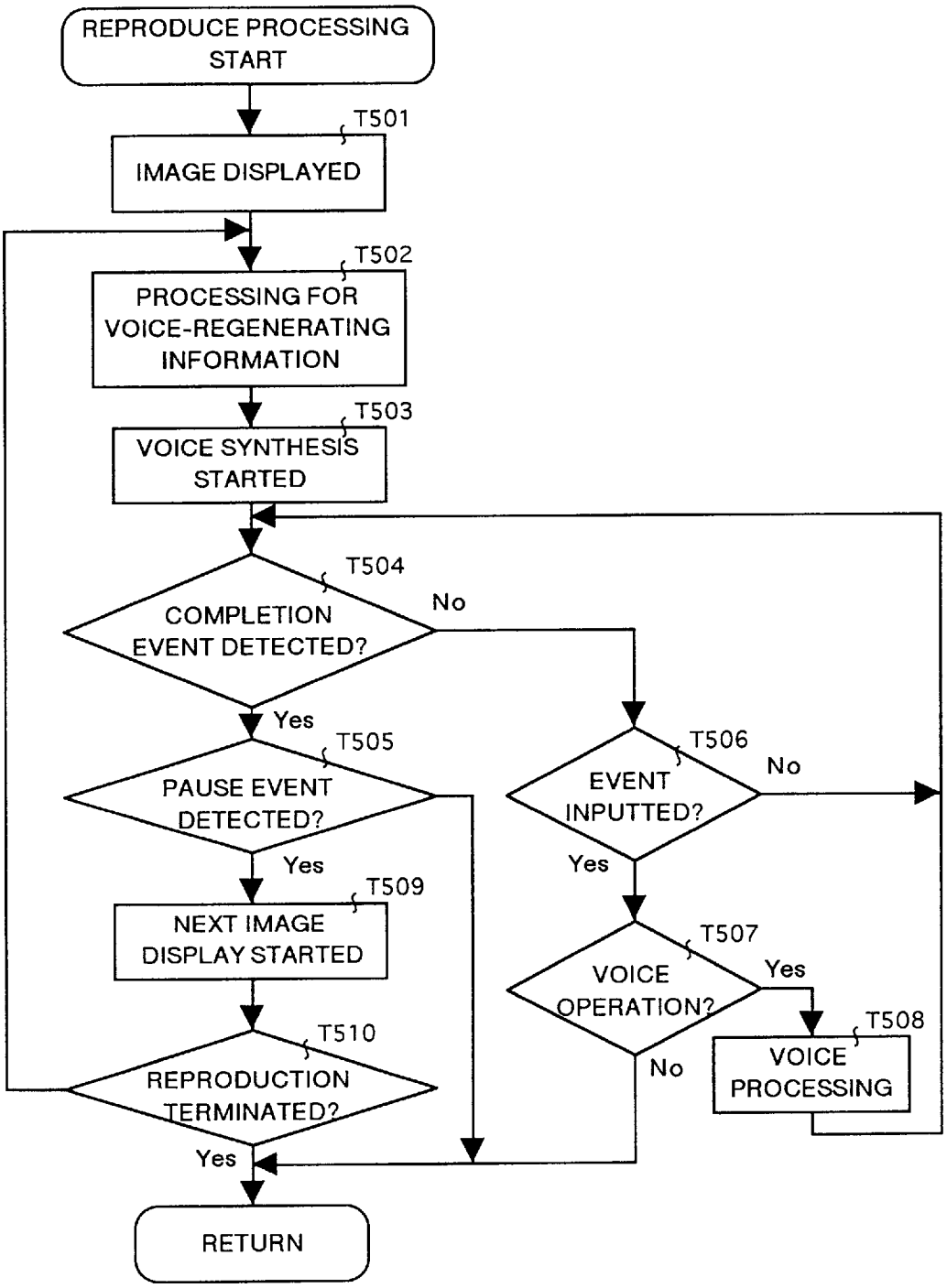
FIG. 45 is a flow chart illustrating the processing for reproduction according to Variant 4 of the embodiment.
Figure 47:
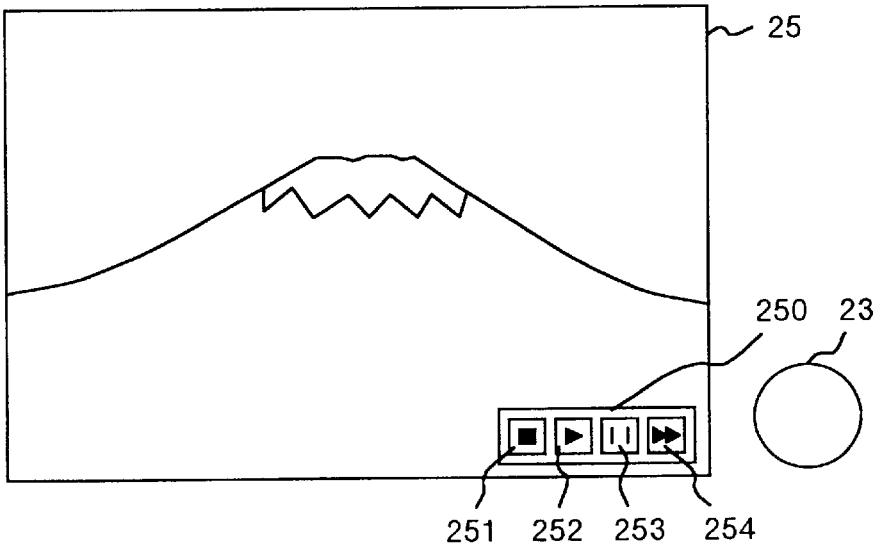
FIG. 47 is a view showing another example of a state shift of a display screen in the processing for reproduction according to Variant 4 of the embodiment.
Figure 48:
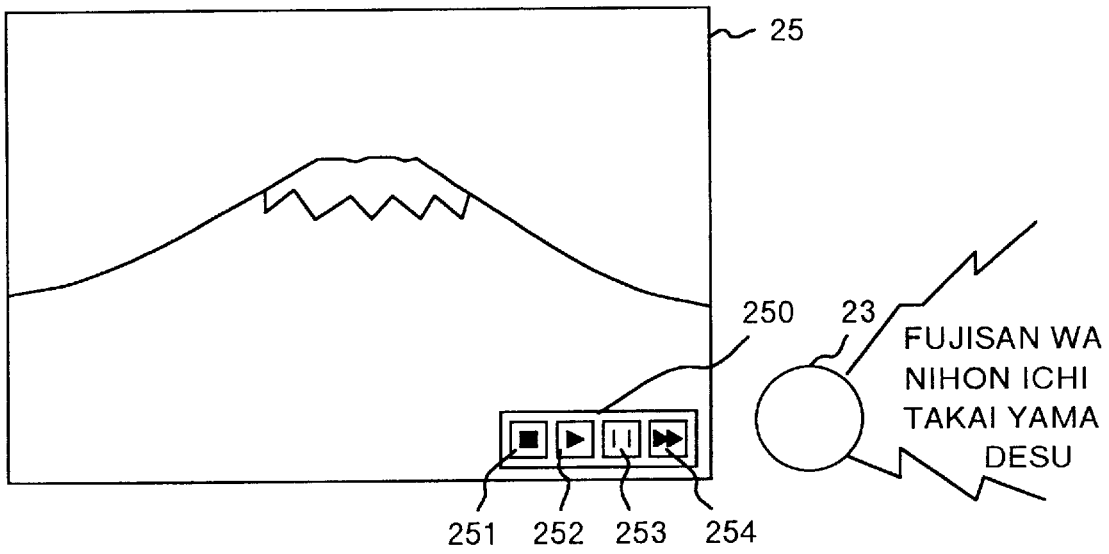
FIG. 48 is a view showing another example of a state shift of a display screen in the processing for reproduction according to Variant 4 of the embodiment.

Herein description is made for the processing for reproduction in Variant 4. FIG. 45 is a flow chart illustrating the processing for reproduction in Variant 4, and FIGS. 46 to 48 are views each illustrating the state shift of a display screen during the processing for reproduction.

Figure 46:
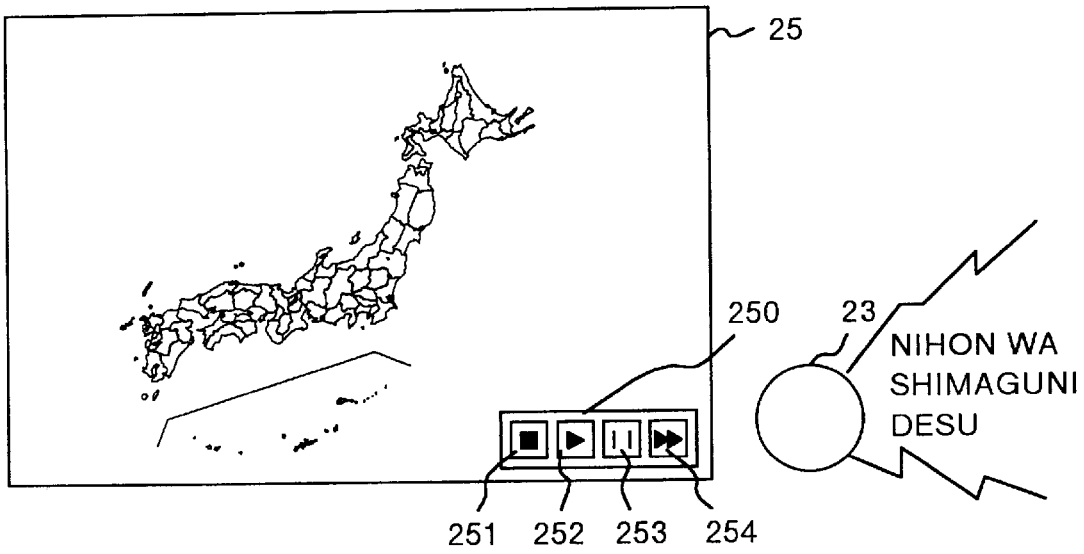
FIG. 46 is a view showing an example of a state shift of a display screen in the processing for reproduction according to Variant 4 of the embodiment.

It should be noted that, in the above description of the programming information, image information is programmed in the steps of displaying a first image and a second image in this order, while voice-generating information is programmed so that synchronism between the image and narration is insured by reproducing a first narration when display of the first image is started, then holding reproduction of a second narration in the waiting state with the completion event and pause event, and then reproducing a second narration when display of the second image is started In this Variant 4, when reproduction is started, a first image (for instance, a sheet with a Japanese picture) is displayed, as shown in FIG. 46, according to image information within the file information (step T501), and then voice-generating information within the file information is analyzed (step T502).

Depending on a result of the analysis, reproduction of a first narration of "Nihon wa shimaguni desu" (meaning that Japan is an island country) is started with the speaker 23 as shown in FIG. 46 (step T503). Also in this case, like in the embodiment described above, the NC window 250 is displayed together with an image in the display section 25.

In Variant 4, after reproduction of a first narration is started, detection of the completion event indicating completion of a first narration or of other events (such as an operation of the NC window 250, an instruction of a request for other file information, or an instruction for terminating the processing) is executed (step T504, step T506).

In step T506, if input of an event is detected, system control shifts to step T507. In this step T507, like in the embodiment described above, if input of an event for reproduction of narration by operating the NC window 250 is detected, system control further shifts to step T508, and control for reproduction, stop, pause, or fast feed is executed. If input of an event other than that for reproduction of narration is detected, system control goes out of this processing for reproduction, and returns to the file transfer processing (main processing) shown in FIG. 16.

If an end of reproduction of the first narration is detected upon the completion event which is in the pronouncing event in the voice-generating information (step T504), the pause event subsequent to this completion event is detected (step T505), and at this timing, a second image (such as, for instance, a picture of Mt. Fuji) is displayed, as shown in FIG. 47, in the display section 25 (step T509).

At the time when display of the second image is started, reproduction of the second narration such as "Fujisan wa nihon'ichi takai yama desu" (meaning that Mt. Fuji is the highest mountain in Japan) (Refer to FIG. 48) is started according to voice-generating information (pronouncing data) (restart of reproduction of narration), so that synchronism is insured between display of the second image and reproduction of the second narration (step T502, step T503).

It should be noted that, although above description of Variant 4 assumes a case in which the completion event and pause event are used in a pair, each event may be used independently.

Namely, an upper application may be constructed so that the synchronism between the application and other operations can be issued by reporting the occurrence of the completion event, during reproducing a narration, to the upper application of the processing for reproduction as a reference point for obtaining a position for the reproduction of narration. In this case, the completion event may be incorporated at the arbitrary point of time (point of time when the synchronism between other operations should be taken) in the direction of a time axis for the reproduction of narration.

Also, in the pause event, operation for releasing the reproduction of narration may be synchronized with an operation by the key entry section 29 differently from the display of an image described above by incorporating the pause event in the pronouncing data for each one sentence of narration.

As described above, according to the Variant 4, the voice-generating information includes the control event which synchronizes an operation based on an image information in the file information with an operation for the reproduction of narration, and the operation for the reproduction of narration is executed according to the control event included in the voice-generating information and synchronizing with the operation by the image information in the file information, so that it is possible to enhance the expressive power by integrating a voice with an expression by other media.

It should be noted that the file information may include a music information or the like besides an image information, and for this feature, it is possible to enhance the expressive power by integrating a voice with an expression by the music or the like in addition to the image.

Also, the control event is included in the voice-generating information when preparing the voice-generating information, so that it is possible to give the information which synchronizes an operation for the voice synthesis with an operation by other information into the voice-generating information.

In the embodiment and each Variant described above, the voice tone data is selected according to the specification of pitch or velocity of a voice not dependent on a phoneme, but when paying attention to only selection of voice tone data, it is possible to select the voice tone data that is most appropriate to the voice-generating information for the voice synthesis in the voice tone section 211 (voice tone section 213) even if the pitch of velocity of a voice is not dependent on a phoneme, whereby it is possible to reproduce a voice with high quality.

As described above, with an information communication system according to the present invention, file information including voice-generating information is transferred from a first communicating apparatus to a second communicating apparatus; in the second communicating apparatus, meter patterns successive in the direction of a time axis are developed according to velocity and pitch of a voice not dependent on phonemes, and a voice waveform is generated according to the meter patterns as well as to voice tone data selected based on the voice-generating information; so that a voice can be reproduced with a preferable type of voice tone without limiting the voice tone to a particular type, and no displacement in patterns of voice pitch is generated when the voice waveform is generated, and as a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, file information including voice-generating information is transferred from a first communicating apparatus to a second communicating apparatus; in the second communicating apparatus, meter patterns successive in the direction of a time axis are developed according to velocity and pitch of a voice not dependent on phonemes, and a voice waveform is generated according to the meter patterns as well as to voice tone data selected based on information indicating types of voice tone included in the voice-generating information, so that a voice can be reproduced with the most suitable type of voice tone directly specified from a plurality of types of voice tone without limiting the voice tone to a particular type, and no displacement in patterns of voice pitch is generated when the voice waveform is generated. As a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, file information including voice-generating information is transferred from a first communicating apparatus to a second communicating apparatus; in the second communicating apparatus, meter patterns successive in the direction of a time axis are developed according to velocity and pitch of a voice not dependent on phonemes, and a voice waveform is generated according to the meter patterns as well as to voice tone data selected according to similarity based on information indicating attributes of voice tone included in the voice-generating information, so that a voice can be reproduced with a type of voice tone having highest similarity without using any unsuitable types of voice tone, also no displacement in patterns of voice pitch is generated when the voice waveform is generated, and as a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, file information including voice-generating information is transferred from a first communicating apparatus to a second communicating apparatus; in the second communicating apparatus, meter patterns successive in the direction of a time axis are developed according to velocity and pitch of a voice not dependent on phonemes, and a voice waveform is generated according to the meter pattern as well as to voice tone data selected according to information indicating a type and attribute of voice tone included in voice-generating information, so that the voice can be reproduced with a type of voice tone having highest similarity without using any unsuitable type of voice tone even though the type of the voice tone data directly specified is not available, also no displacement in patterns of voice pitch is generated when the voice waveform is generated. As a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, file information including voice-generating information is transferred from a first communicating apparatus to a second communicating apparatus; in the second communicating apparatus, meter patterns successive in the direction of a time axis are developed according to voice-generating information included in the file information, also a voice waveform is generated according to the meter patterns as well as to voice tone data selected based on the voice-generating information, so that a voice can be reproduced with a preferable type of voice tone without limiting the voice tone to a particular type, and no displacement in patterns of voice pitch is generated when the voice waveform is generated. As a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, file information including voice-generating information is transferred from a first communicating apparatus to a second communicating apparatus; in the second communicating apparatus, meter patterns successive in the direction of a time axis are developed according to voice-generating information included in the file information, and a voice waveform is generated according to the meter patterns as well as to voice tone data selected based on information indicating types of voice tone included in the voice-generating information; so that a voice can be reproduced with the most suitable type of voice tone directly specified from a plurality of types of voice tone without limiting voice tone to a particular type, and no displacement in patterns of voice pitch is generated when the voice waveform is generated. As a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, file information including voice-generating information is transferred from a first communicating apparatus to a second communicating apparatus; in the second communicating apparatus, meter patterns successive in the direction of a time axis are developed according to voice-generating information included in the file information, and a voice waveform is generated according to the meter patterns as well as to voice tone data selected according to similarity based on information indicating attributes of voice tone included in the voice-generating information, so that a voice can be reproduced with a type of voice tone having highest similarity without using any unsuitable types of voice tone, also no displacement in patterns of voice pitch is generated when the voice waveform is generated, and as a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, file information including voice-generating information is transferred from a first communicating apparatus to a second communicating apparatus; in the second communicating apparatus, meter patterns successive in the direction of a time axis are developed according to voice-generating information included in the file information, and a voice waveform is generated according to the meter patterns as well as to voice tone data selected according to information indicating a type and attribute of voice tone included in voice-generating information, so that the voice can be reproduced with a type of voice tone having highest similarity without using an unsuitable type of voice tone even though there the type of the voice tone directly specified is not available, also no displacement in patterns of voice pitch is generated when the voice waveform is generated. As a result, there is provided the advantage that it is possible to obtain an information communication system enabling to maintain high voice quality in voice synthesis by obtaining the most suitable correlation between voice-generating information and voice tone data without fixing the correlation between them.

With an information communication system according to the present invention, the information indicating an attribute is any one of data on sex, age, a reference for voice pitch, clearness, and naturality, or a combination of two or more types of data described above, so that an object for verification between an attribute of a voice-generating information storing means and an attribute of a voice tone data storing means is parameterized. As a result, there is provided the advantage that it is possible to obtain an information communication system in which a type of voice tone can easily be selected.

With an information communication system according to the present invention, a reference for pitch of a voice in a voice-generating information storing means is shifted according to a reference for pitch of a voice in a voice tone data storing means when the voice is reproduced; whereby pitch for each voice relatively changes according to the shifted reference for voice pitch regardless of time period for phonemes; because of this, the reference for voice pitch becomes closer to that for voice tone, and as a result, there is provided the advantage that it is possible to obtain an information communication system making it possible to further improve the voice quality.

With an information communication system according to the present invention, a reference for voice pitch in a voice-generating information storing means is shifted according to an arbitrary reference for voice pitch when the voice is reproduced; whereby pitch for each voice relatively changes according to the shifted reference of voice pitch regardless of time period for phonemes, and as a result, there is provided the advantage that it is possible to obtain an information communication system allowing voice processing such as making it closer to the intended voice quality according to the shift rate.

With an information communication system according to the present invention, the reference for voice pitch based on the first and second information is an average frequency, a maximum frequency, or a minimum frequency of voice pitch, and as a result, there is provided the advantage that it is possible to obtain an information communication system in which a reference for voice pitch can easily be decided.

With an information communication system according to the present invention, the second communicating apparatus reads out voice tone data from a storage medium and stores the voice tone data in the voice tone data storing means, so that it is possible to add variation to types of voice tone through the storage medium. As a result, there is provided the advantage that it is possible to obtain an information communication system in which the most suitable voice tone is applied when the voice is reproduced.

With an information communication system according to the present invention, the second communicating apparatus receives voice tone data through a communication line from an external device and stores the voice tone data in the voice tone data storing means, so that it is possible to add variation to types of voice tone through the communication line, and as a result, there is provided the advantage that it is possible to obtain an information communication system in which the most suitable type of voice tone can be applied when the voice is reproduced.

With an information communication system according to the present invention the voice-generating information includes control information for synchronizing an operation according to other information in the file information to an operation by the voice reproducing means, and the voice reproducing means operates in synchronism with an operation according to other information in the file information according to the control information included in the voice-generating information when a voice is reproduced, so that there is provided the advantage that it is possible to obtain an information communication system in which the expressing capability can be enhanced by mixing voice with expression by other media.

With an information communication system according to the present invention, the other information is image information and music information or the like, so that there is provided the advantage that it is possible to obtain an information communication system in which the expressing capability can be further enhanced by integrating voices, images, and music or the like.

With an information processing apparatus according to the present invention, voice-generating information is made by dispersing voice data for either one of or both velocity and pitch of a voice based on an inputted natural voice so that each voice data is not dependent on a time lag between phonemes and has a level relative against the reference, and the voice-generating information is transferred to a first communicating apparatus to be registered in a voice-generating information storing means; whereby there is provided the advantage that it is possible to obtain a data processing apparatus in which it is possible to give velocity and pitch of a voice to the voice data not dependent on the time lag between phonemes at an arbitrary point of time.

With an information processing apparatus according to the present invention for making and editing voice-generating information used in the information communication system according to the above invention, a making means makes a first information indicating a reference for pitch of a voice in the state where the first information is included in the voice-generating information, so that there is provided the advantage that it is possible to obtain a data processing apparatus in which it is possible to give a reference for voice pitch in the voice-generating information.

With an information processing apparatus according to the present invention, the making means comprises a changing means for changing the various information at an arbitrary point of time, so that there is provided the advantage that it is possible to obtain a data processing apparatus in which it is possible to change information to improve quality of a voice.

With an information processing apparatus according to the present invention for making and editing voice-generating information used in the information communication system according to the above invention, a making means includes control information in the voice-generating information when the voice-generating information is made, so that there is provided the advantage that it is possible to obtain a data processing apparatus in which it is possible to give information for synchronizing a voice synthesizing operation to an operation according to other information into the voice-generating information.

With an information communicating method according to the present invention, there are provided the steps of transferring file information including voice-generating information from a first communicating apparatus to a second communicating apparatus; developing meter patterns successive in the direction of time axis according to velocity and pitch of a voice not dependent on phonemes in the second communicating apparatus, and generating a voice waveform according to the meter patterns as well as to voice tone data selected based on the voice-generating information, so that a voice can be reproduced with a preferable type of voice tone without limiting the voice tone to a particular type, and no displacement in patterns of voice pitch is generated when the voice waveform is generated. As a result, there is provided the advantage that it is possible to obtain a data communicating method in which it is possible to maintain high voice quality in voice synthesis by obtaining the most suitable correlation between voice-generating information and voice tone data without fixing the correlation between them.

With an information communicating method according to the present invention, there are provided the steps of transferring file information including voice-generating information from a first communicating apparatus to a second communicating apparatus; developing meter patterns successive in the direction of time axis according to velocity and pitch of a voice not dependent on phonemes in the second communicating apparatus, and generating a voice waveform according to the meter patterns as well as to voice tone data selected based on information indicating types of voice tone included in the voice-generating information, so that a voice can be reproduced with most suitable type of voice tone directly specified from a plurality of types of voice tone without limiting voice tone to a particular type, and no displacement in patterns of voice pitch is generated when the voice waveform is generated, and as a result, there is provided the advantage that it is possible to obtain a data communicating method in which it is possible to maintain high voice quality in voice synthesis by obtaining the most suitable correlation between voice-generating information and voice tone data without fixing the correlation between them.

With an information communicating method according to the present invention, there are provided the steps of transferring file information including voice-generating information from a first communicating apparatus to a second communicating apparatus; developing meter patterns successive in the direction of time axis according to velocity and pitch of a voice not dependent on phonemes in the second communicating apparatus, and generating a voice waveform according to the meter patterns as well as to voice tone data selected according to similarity based on information indicating attributes of voice tone included in the voice-generating information, so that a voice can be reproduced with a type of voice tone having highest similarity without using any unsuitable type of voice tone, also no displacement in patterns of voice pitch is generated when the voice waveform is generated, and as a result, there is provided the advantage that it is possible to obtain a data communicating method in which it is possible to maintain high voice quality in voice synthesis by obtaining the most suitable correlation between voice-generating information and voice tone data without fixing the correlation between them.

With an information communicating method according to the present invention, there are provided the steps of transferring file information including voice-generating information from a first communicating apparatus to a second communicating apparatus; developing meter patterns successive in the direction of time axis according to velocity and pitch of a voice not dependent on phonemes in the second communicating apparatus, and generating a voice waveform according to the meter patterns as well as to voice tone data selected according to information indicating a type and attribute of voice tone included in voice-generating information so that a voice can be reproduced with a type of voice tone having highest similarity without using any type of voice tone even though the type of the voice tone directly specified is not available, also no displacement in patterns of voice pitch is generated when the voice waveform is generated, and as a result, there is provided the advantage that it is possible to obtain a data communicating method enabling to maintain high voice quality in voice synthesis by obtaining the most suitable correlation between voice-generating information and voice tone data without fixing the correlation between them.

With an information communicating method according to the present invention, there are provided the steps of transferring file information including voice-generating information from a first communicating apparatus to a second communicating apparatus; developing meter patterns successive in the direction of time axis according to voice-generating information included in the file information, and generating a voice waveform according to the meter patterns as well as to voice tone data selected based on the voice-generating information, so that a voice can be reproduced with a preferable type of voice tone without limiting the voice tone to a particular type, and no displacement in patterns of voice pitch is generated when the voice waveform is generated, and as a result, there is provided the advantage that it is possible to obtain a data communicating method enabling to maintain high voice quality in voice synthesis by obtaining the most suitable correlation between voice-generating information and voice tone data without fixing the correlation between them.

With an information communicating method according to the present invention, there are provided the steps of transferring file information including voice-generating information from a first communicating apparatus to a second communicating apparatus; developing meter patterns successive in the direction of time axis according to voice-generating information included in the file information, and generating a voice waveform according to the meter patterns as well as to voice tone data selected based on information indicating types of voice tone included in the voice-generating information, so that a voice can be reproduced with most suitable type of voice tone directly specified from a plurality of types of voice tone without limiting voice tone to a particular type, and no displacement in patterns of voice pitch is generated when the voice waveform is generated, and as a result, there is provided the advantage that it is possible to obtain a data communicating method enabling to maintain high voice quality in voice synthesis by obtaining the most suitable correlation between voice-generating information and voice tone data without fixing the correlation between them.

With an information communicating method according to the present invention, there are provided the steps of transferring file information including voice-generating information from a first communicating apparatus to a second communicating apparatus; developing meter patterns successive in the direction of time axis according to voice-generating information included in the file information, and generating a voice waveform according to the meter patterns as well as to voice tone data selected according to similarity based on information indicating attributes of voice tone included in the voice-generating information, so that a voice can be reproduced with a type of voice tone having highest similarity without using any unsuitable types of voice tone, also no displacement in patterns of voice pitch is generated when the voice waveform is generated, and as a result, there is provided the advantage that it is possible to obtain a data communicating method enabling to maintain high voice quality in voice synthesis by obtaining the most suitable correlation between voice-generating information and voice tone data without fixing the correlation between them.

With an information communicating method according to the present invention, there are provided the steps of transferring file information including voice-generating information from a first communicating apparatus to a second communicating apparatus; developing meter patterns successive in the direction of time axis according to voice-generating information included in the file information, and generating a voice waveform according to the meter patterns as well as to voice tone data selected according to information indicating a type and attribute of voice tone included in voice-generating information, so that a voice can be reproduced with a type of voice tone having highest similarity without using any unsuitable type of voice tone even though the type of the voice tone directly specified is not available, also no displacement in patterns of voice pitch is generated when the voice waveform is generated. As a result, there is provided the advantage that it is possible to obtain a data communicating method enabling to maintain high voice quality in voice synthesis by obtaining the most suitable correlation between voice-generating information and voice tone data without fixing the correlation between them.

With an information communicating method according to the present invention, there is provided the step that the information indicating an attribute is any one of data on sex, age, a reference for voice pitch, clearness, and naturality, or a combination of two or more types of data described above, so that an object for verification between an attribute of a voice-generating information storing means and an attribute of a voice tone data storing means is parameterized. As a result, there is provided the advantage that it is possible to obtain a data communicating method in which a type of voice tone can easily be selected.

With an information communicating method according to the present invention, there is provided the step of shifting a reference for pitch of a voice in a voice-generating information storing means according to a reference for pitch of a voice in a voice tone data storing means when the voice is reproduced, so that pitch for each voice relatively changes according to the shifted reference for voice pitch regardless of a time zone of a phoneme. Because of this feature, the reference for voice pitch becomes closer to that for voice tone. As a result, there is provided the advantage that it is possible to obtain a data communicating method in which it is possible to further improve voice quality.

With an information communicating method according to the present invention, there is provided the step of shifting a reference for pitch of a voice in a voice-generating information storing means according to an arbitrary reference for voice pitch when the voice is reproduced, so that pitch for each voice relatively changes according to the shifted reference of voice pitch regardless of a time zone of a phoneme. As a result, there is provided the advantage that it is possible to obtain a data communicating method in which it is possible to execute such voice processing as making voice tone closer to that with intended voice quality according to the shift rate.

With an information communicating method according to the present invention, the references for voice pitch based on the first and second information are an average frequency, a maximum frequency, or a minimum frequency of voice pitch, and as a result, there is provided the advantage that it is possible to obtain a data communicating method in which a reference for voice pitch can be decided easily.

With an information communicating method according to the present invention, there are provided the steps of reading out voice tone data from the storage medium and storing the voice tone data in the voice tone data storing means in a second communicating apparatus, so that it is possible to add variation to types of voice tone through the storage medium, and there is provided the advantage that it is possible to obtain a data communicating method in which it is possible to use the most suitable type of voice tone when a voice is reproduced.

With an information communicating method according to the present invention, there are provided the steps that a second communicating apparatus receives voice tone data through a communication line from an external device and stores the voice tone data in the voice tone data storing means, so that it is possible to add variation to types of voice tone through the communication line, and there is provided the advantage that it is possible to obtain a data communicating method in which it is possible to use the most suitable type of voice tone when a voice is reproduced.

With an information communicating method according to the present invention, there are provided the steps that the voice-generating information includes control information for synchronizing an operation according to other information in the file information to an operation in the voice reproducing step, and the operation in the voice reproducing step is synchronized to an operation based on other information in the file information according to the control information included in the voice-generating information, so that there is provided the advantage that it is possible to obtain a data communicating method in which it is possible to enhance expressive power by integrating voices with expression by other media.

With an information communicating method according to the present invention, the other information is image information and music information or the like, so that there is provided the advantage that it is possible to obtain a data communicating method in which it is possible to enhance expressive power by integrating voices, images, musical sounds or the like.

With an information processing method according to the present invention, there are provided the steps of making voice-generating information by dispersing voice data for at least one of velocity and pitch of a voice based on an inputted natural voice so that each voice data is not dependent on a time lag between phonemes and has a level relative against the reference, transferring the voice-generating information to a first communicating apparatus, and registering the voice-generating information in a voice-generating information storing means, so that there is provided the advantage that it is possible to obtain a data processing method in which it is possible to give velocity and pitch of a voice to the voice data not dependent on the time lag between phonemes at an arbitrary point of time.

With an information processing method according to the present invention for making and editing voice-generating information used in the information communicating method, there is provided the step of making a first information indicating a reference for voice pitch in the state where the first information is included in the voice-generating information in the making step, so that there is provided the advantage that it is possible to obtain a data processing method in which it is possible to give a reference for voice pitch in the voice-generating information.

With an information processing method according to the present invention, a making step comprises a changing step for changing various information at an arbitrary point of time, so that there is provided the advantage that it is possible to obtain an information processing method in which it is possible to change information to further improve quality of a voice.

With an information processing method according to the present invention for making and editing voice-generating information used in the information communicating method according to the above invention, there is provided the step of including control information in the voice-generating information when the voice-generating information is made in the making step, so that there is provided the advantage that it is possible to obtain a data processing method in which it is possible to give information for synchronizing a voice synthesizing operation to an operation according to other information into the voice-generating information.

This application is based on Japanese patent application No. HEI 8-324458 filed in the Japanese Patent Office on Dec. 4, 1996, the entire contents of which are hereby incorporated by reference It should be recognized that the sequence of steps that comprise the processing for transferring, reproducing, creating, making, interrupt/reproducing, editing and/or registering voice-generating information or are otherwise related thereto, as illustrated in flow charts or otherwise described in the specification, may be stored, in whole or in part, for any finite duration within computer-readable media. Such media may comprise, for example but without limitation, a RAM, hard disc, floppy disc, ROM, including CD ROM, and memory of various types of now known or hereinafter developed. Such media also may comprise buffers, registers and transmission media, alone or as part of an entire communication network, such as the Internet.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An information communication system with a first communication apparatus and a second communicating apparatys each connected to a communication network for executing data communications between said first communicating apparatus and second communicating apparatus through said communication network, wherein said first communicating apparatus comprises:

a file information storing means for storing therein file information including voice-generating information comprising discrete voice data for at least one of velocity and pitch of a voice correlated to a time lag between each discrete voice data, and made by dispensing each discrete data for either one of or both velocity and pitch of a voice so that each voice data is not dependent on a time lag between phonemes and at the same tiime present at a level relative to a reference; and a first communicating means for transferring the voice-generating information stored in said file information storing means to said second communicating apparatus according to a request from said second communicating apparatus; and also, wherein said second communicating apparatus comprises:

a voice tone data storing means for storing therein voice tone data each indicating sound parameters for each raw voice element;

a second communicating means for issuing a request for transfer of file information stored in said file information storing means to said first communicating apparatus and then receiving the file information transferred from said first communicating means;

a selecting means for selecting one voice tone data from a plurality of types of voice tone data stored in said voice tone data storing means according to voice-generating information in the file information received by said second communicating means;

a developing means for developing meter patterns successively in the direction of a time axis according to at least one of velocity and pitch of a voice included in said voice-generating information and a time lag therebetween; and a voice reproducing means for generating a voice waveform according to the meter pattern developed by said developing means as well as to the voice tone data selected by said selecting means.

2. An information communication system according to claim 1, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

3. An information communication system according to claim 2, wherein the reference for voice pitch based on said first and second information comprises at least one of an average frequency, a maximum frequency, or a minimum frequency of voice pitch.

4. An information communication system according to claim 1, wherein said file information storing means stores first information indicating a reference for pitch of a voice in the state where the first information is included in said voice-generating information, said voice reproducing means has an input means for inputting a second information indicating a reference for voice pitch at an arbitrary point of time, and decides a reference for voice pitch when the voice is reproduced by shifting the reference for voice pitch based on the first information to the reference for voice pitch based on the second information inputted by said input means.

5. An information communication system according to claim 4, wherein the reference for voice pitch based on said first and second information comprises at least one of an average frequency, a maximum frequency, or a minimum frequency of voice pitch.

6. An information communication system according to claim 1, wherein said second communicating apparatus further comprises a detachable storage medium with voice tone data stored therein, reads out voice tone data from said storage medium and stores the voice tone data in said voice tone data storing means.

7. An information communication system according to claim 1, wherein said second communicating apparatus receives voice tone data through a communication line from an external device and stores the voice tone data in said voice tone data storing means.

8. An information communication system according to claim 1, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

9. An information communication system according to claim 8, wherein said other information is image information and music information or the like.

10. An information processing apparatus for making and editing voice-generating information used in the information communication system according to claim 1 comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

11. An information processing apparatus according to claim 10 for making and editing voice-generating information used in said information communication system, wherein said making means makes a first information indicating a reference for pitch of a voice in a state when the first information is included in said voice-generating information.

12. An information processing apparatus according to claim 10 for making and editing voice-generating information used in said information communication system, wherein said making means comprises a changing means for changing said information at an arbitrary point of time.

13. An information processing apparatus according to claim 10 for making and editing voice-generating information used in said information communication system, wherein said making means includes said control information in said voice-generating information when said voice-generating information is made.

14. An information communication system with a first communicating apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information comprising discrete voice data for at least one of velocity or pitch of a voice correlated to a time lag and data for a type of voice tone inserted between each discrete voice data and made by dispensing, each discrete data for either one of or both velocity and pitch of a voice so that each voice data is not dependent on a time lag between phonemes and at the same time present at a level relative against to a reference; and a first communicating means for transferring the file information stored in said file information storing means to said second communicating apparatus according to a request from said second communicating apparatus; and also wherein said second communicating apparatus comprises:

a voice tone data storing means for storing therein voice tone data indicating sound parameters for each raw voice element;

a second communicating means for issuing a request for transfer of file information stored in said file information storing means to said first communicating apparatus and then receiving the file information transferred from said first communicating means;

a selecting means for selecting voice tone data corresponding to each type of voice tone in the voice-generating information of the file information received by said second communicating means from a plurality of types of voice tone data stored in said voice tone data storing means;

a developing means for developing meter patterns successively in the direction of a time axis according to voice data for at least one of velocity and pitch of a voice included in said voice-generating information and the time lag; and a voice reproducing means for generating a voice waveform according to the meter patterns developed by said developing means as well as to the voice tone data selected by said selecting means.

15. An information communication system according to claim 14, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

16. An information communication system according to claim 15, wherein the reference for voice pitch based on said first and second information comprises at least one of an average frequency, a maximum frequency, or a minimum frequency of voice pitch.

17. An information communication system according to claim 14, wherein said file information storing means stores first information indicating a reference for pitch of a voice in the state where the first information is included in said voice-generating information, said voice reproducing means has an input means for inputting a second information indicating a reference for voice pitch at an arbitrary point of time, and decides a reference for voice pitch when the voice is reproduced by shifting the reference for voice pitch based on the first information to the reference for voice pitch based on the second information inputted by said input means.

18. An information communication system according to claim 17, wherein the references for voice pitch based on said first and second information comprise at least one of an average frequency, a maximum frequency, or a minimum frequency of voice pitch.

19. An information communication system according to claim 14, wherein said second communicating apparatus further comprises a detachable storage medium with voice tone data stored therein, reads out voice tone data from said storage medium and stores the voice tone data in said voice tone data storing means.

20. An information communication system according to claim 14, wherein said second communicating apparatus receives voice tone data through a communication line from an external device and stores the voice tone data in said voice tone data storing means.

21. An information communication system according to claim 14, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

22. An information communication system according to claim 21, wherein said other information is image information and music information or the like.

23. An information communication system according to claim 14 further comprising a processing apparatus for making and editing voice-generating information, such apparatus comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

24. An information processing apparatus according to claim 23, wherein said making means makes a first information indicating a reference for pitch of a voice in a state when the first information is included in said voice-generating information.

25. An information processing apparatus according to claim 23, wherein said making means comprises a changing means for changing said information at an arbitrary point of time.

26. An information processing apparatus according to claim 23, wherein said making means includes said control information in said voice-generating information when said voice-generating information is made.

27. An information communication system with a first communicating apparatus and a second communicating apparatus each connected to a communication network for executing data communications between said first communicating apparatus and second communicating apparatus through said communication network;

wherein said first communicating apparatus comprises:

a file information storing means for storing therein file information including voice-generating information comprising discrete voice data for at least one of velocity and pitch of a voice correlated to a time lag between each discrete voice data and data for attribute of the voice tone inserted between each discrete voice data, and made by dispensing said discrete voice data for either one or both velocity and pitch of a voice so that each voice data is not dependent on a time lag between phonemes and at the same time present at a level relative to a reference; and a first communicating means for transferring the file information stored in said file information storing means to said second communicating apparatus according to a request from said second communicating apparatus; and also, wherein said second communicating apparatus comprises:

a voice tone data storing means for storing therein voice tone data indicating sound parameters for each raw voice element with information indicating attributes of the voice tone correlated thereto;

a second communicating means for issuing a request for transfer of file information stored in said file information storing means to said first communicating apparatus and then receiving the file information transferred from said first communicating means;

a verifying means for comparing information indicating attributes of a voice tone included in voice-generating information in the file information received by said second communicating means to information indicating attributes of each type of voice tone stored in said voice tone data storing means to obtain a similarity of the voice tones;

a selecting means for selecting voice tone data having the highest similarity from a plurality of types of voice tone data stored in said voice tone data storing means according to the similarity obtained by said verifying means;

a developing means for developing meter patterns successively in the direction of a time axis according to voice data for at least one of velocity and pitch of a voice included in said voice-generating information as well as to the time lag; and a voice reproducing means for generating a voice waveform according to the meter patterns developed by said developing means as well as to the voice tone data selected by said selecting means.

28. An information communication system according to claim 27, wherein said information indicating an attribute is at least one of data on sex, age, a reference for voice pitch, clearness, and naturality.

29. An information communication system according to claim 27, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

30. An information communication system according to claim 29, wherein the references for voice pitch based on said first and second information comprise at least one of an average frequency, a maximum frequency, or a minimum frequency of voice pitch.

31. An information communication system according to claim 27, wherein said file information storing means stores first information indicating a reference for pitch of a voice in the state where the first information is included in said voice-generating information, said voice reproducing means has an input means for inputting a second information indicating a reference for voice pitch at an arbitrary point of time, and decides a reference for voice pitch when the voice is reproduced by shifting the reference for voice pitch based on the first information to the reference for voice pitch based on the second information inputted by said input means.

32. An information communication system according to claim 31, wherein the references for voice pitch based on said first and second information comprise at least one of an average frequency, a maximum frequency, or a minimum frequency of voice pitch.

33. An information communication system according to claim 27, wherein said second communicating apparatus further comprises a detachable storage medium with voice tone data stored therein, reads out voice tone data from said storage medium and stores the voice tone data in said voice tone data storing means.

34. An information communication system according to claim 27, wherein said second communicating apparatus receives voice tone data through a communication line from an external device and stores the voice tone data in said voice tone data storing means.

35. An information communication system according to claim 27, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

36. An information communication system according to claim 35, wherein said other information is image information and music information or the like.

37. An information communication system according to claim 27 further comprising a processing apparatus for making and editing voice-generating information, such apparatus comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

38. An information processing apparatus according to claim 27 for making and editing voice-generating information used in the information communication system, wherein said making means makes a first information indicating a reference for pitch of a voice in a state when the first information is included in said voice-generating information.

39. An information processing apparatus according to claim 27 for making and editing voice-generating information used in said information communication system, wherein said making means comprises a changing means for changing said information at an arbitrary point of time.

40. An information processing apparatus according to claim 27 for making and editing voice-generating information used in said information communication system, wherein said making means includes said control information in said voice-generating information when said voice-generating information is made.

41. An information communication system with a first communicating apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information comprising discrete voice data for at least one of velocity and pitch of a voice correlated to a time lag between each discrete voice data, data on a type of the voice tone, and an attribute of the voice tone, and made by dispensing said discrete voice data for either one of or both velocity and pitch of a voice so that each voice data is not dependent on a time lag between phonemes and at the same time present at a level relative to a reference; and a first communicating means for transferring the file information stored in said file information storing means to said second communicating apparatus according to a request from said second communicating apparatus; and also, wherein said second communicating apparatus comprises:

a voice tone data storing means for storing therein voice tone data indicating sound parameters for each raw voice element correlated to information indicating an attribute of the voice tone;

a second communicating means for issuing a request for transfer of file information stored in said file information storing means to said first communicating apparatus and then receiving the file information transferred from said first communicating means;

a retrieving means for retrieving a type of voice tone in the voice-generating information of the file information received by said second communicating means from a plurality of types of voice tone stored in said voice tone data storing means;

a first selecting means for selecting, in a case where a type of voice tone in said voice-generating information was obtained through retrieval by said retrieving means, voice tone data corresponding to the obtained type of voice tone from various types of voice tone data stored in said voice tone data storing means;

a verifying means for comparing, in a case where a type of voice tone in the voice-generating information was not obtained through retrieval by said retrieving means, information indicating an attribute of the voice tone in the voice-generating information stored in said file information storing means to information indicating attributes of various types of voice tone stored in said voice tone data storing means to obtain a similarity of the voice tones;

a second selecting means for selecting voice tone data with the highest similarity from a plurality of types of voice tone data stored in said voice tone data storing means according to the similarity obtained by said verifying means;

a developing means for developing meter patterns successively in the direction of a time axis according to voice data for at least one of velocity and pitch of a voice included in said voice-generating information as well as to the time lag between each discrete voice data; and a voice reproducing means for generating a voice waveform according to the meter pattern developed by said developing means as well as to the voice tone data selected by said first or second selecting means.

42. An information communication system according to claim 41, wherein said information indicating an attribute is at least one of data on sex, age, a reference for voice pitch, clearness, and naturality.

43. An information communication system according to claim 41, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

44. An information communication system according to claim 43, wherein the reference for voice pitch based on said first and second information comprises at least one of an average frequency, a maximum frequency, or a minimum frequency of voice pitch.

45. An information communication system according to claim 41, wherein said file information storing means stores first information indicating a reference for pitch of a voice in a state where the first information is included in said voice-generating information, said voice reproducing means has an input means for inputting second information indicating a reference for voice pitch at an arbitrary point of time, and decides a reference for voice pitch when the voice is reproduced by shifting the reference for voice pitch based on the first information to the reference for voice pitch based on the second information inputted by said input means.

46. An information communication system according to claim 45, wherein the references for voice pitch based on said first and second information comprise at least one of an average frequency, a maximum frequency, or a minimum frequency of voice pitch.

47. An information communication system according to claim 41, wherein said second communicating apparatus further comprises a detachable storage medium with voice tone data stored therein, reads out voice tone data from said storage medium and stores the voice tone data in said voice tone data storing means.

48. An information communication system according to claim 41, wherein said second communicating apparatus receives voice tone data through a communication line from an external device and stores the voice tone data in said voice tone data storing means.

49. An information communication system according to claim 41, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

50. An information communication system according to claim 49, wherein said other information is image information and music information or the like.

51. An information communication system according to claim 41 further comprising a processing apparatus for making and editing voice-generating information, such apparatus comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

52. An information processing apparatus according to claim 51 for making and editing voice-generating information used in the information communication system, wherein said making means makes a first information indicating a reference for pitch of a voice in a state when the first information is included in said voice-generating information.

53. An information processing apparatus according to claim 51, wherein said making means comprises a changing means for changing said various information at an arbitrary point of time.

54. An information processing apparatus according to claim 51 for making and editing voice-generating information used in said information communication system, wherein said making means includes said control information in said voice-generating information when said voice-generating information is made.

55. An information communication system with a first communicating apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information containing data for phonemes and meters as information; and a first communicating means for transferring the file information stored in said file information storing means to said second communicating apparatus according to a request from said second communicating apparatus; and also wherein said second communicating apparatus comprises:

a voice tone data storing means for storing therein voice tone data indicating sound parameters for each raw voice element;

a second communicating means for issuing a request for transfer of file information stored in said file information storing means to said first communicating apparatus and then receiving the file information transferred from said first communicating means;

a selecting means for selecting one voice tone data from a plurality of types of voice tone data stored in said voice tone data storing means according to the voice-generating information of the file information received by said second communicating means;

a developing means for developing meter patterns successively in the direction of a time axis according to said voice-generating information; and a voice reproducing means for generating a voice waveform according to the meter patterns developed by said developing means as well as to the voice tone data selected by said selecting means.

56. An information communication system according to claim 55, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

57. An information communication system according to claim 56, wherein the references for voice pitch based on said first and second information comprise at least one of an average frequency, a maximum frequency, or a minimum frequency of voice pitch.

58. An information communication system according to claim 55, wherein said file information storing means stores first information indicating a reference for pitch of a voice in the state where the first information is included in said voice-generating information, said voice reproducing means has an input means for inputting a second information indicating a reference for voice pitch at an arbitrary point of time, and decides a reference for voice pitch when the voice is reproduced by shifting the reference for voice pitch based on the first information to the reference for voice pitch based on the second information inputted by said input means.

59. An information communication system according to claim 58, wherein the references for voice pitch based on said first and second information comprise at least one of an average frequency, a maximum frequency, or a minimum frequency of voice pitch.

60. An information communication system according to claim 55, wherein said second communicating apparatus further comprises a detachable storage medium with voice tone data stored therein, reads out voice tone data from said storage medium and stores the voice tone data in said voice tone data storing means.

61. An information communication system according to claim 55, wherein said second communicating apparatus receives voice tone data through a communication line from an external device and stores the voice tone data in said voice tone data storing means.

62. An information communication system according to claim 55, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

63. An information communication system according to claim 62, wherein said other information is image information and music information or the like.

64. An information communication system according to claim 55 further comprising a processing apparatus for making and editing voice-generating information, such apparatus comprising: a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

65. An information processing apparatus according to claim 64 for making and editing voice-generating information used in the information communication system, wherein said making means makes a first information indicating a reference for pitch of a voice in the state when the first information is included in said voice-generating information.

66. An information processing apparatus according to claim 64, wherein said making means comprises a changing means for changing said information at an arbitrary point of time.

67. An information processing apparatus according to claim 64 for making and editing voice-generating information used in said information communication system, wherein said making means includes said control information in said voice-generating information when said voice-generating information is made.

68. An information communication system with a first communicating apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information containing data for phonemes, meters, and a type of voice tone as information; and a first communicating means for transferring the file information stored in said file information storing means to said second communicating apparatus according to a request from said second communicating apparatus; and also wherein said second communicating apparatus comprises:

a voice tone data storing means for storing therein voice tone data indicating sound parameters for each raw voice element;

a second communicating means for issuing a request for transfer of file information stored in said file information storing means to said first communicating apparatus and then receiving the file information transferred from said first communicating means;

a selecting means for selecting voice tone data corresponding to a type of voice tone in the voice-generating information of the file information received by said second communicating means from a plurality of types of voice tone data stored in said voice tone data storing means;

a developing means for developing meter patterns successively in the direction of a time axis according to said voice-generating information; and a voice reproducing means for generating a voice waveform according to the meter patterns developed by said developing means as well as to the voice tone data selected by said selecting means.

69. An information communication system according to claim 68, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

70. An information communication system according to claim 69, wherein the references for voice pitch based on said first and second information comprise at least one of an average frequency, a maximum frequency, or a minimum frequency of voice pitch.

71. An information communication system according to claim 68, wherein said file information storing means stores first information indicating a reference for pitch of a voice in the state where the first information is included in said voice-generating information, said voice reproducing means has an input means for inputting the second information indicating a reference for voice pitch at an arbitrary point of time, and decides a reference for voice pitch when the voice is reproduced by shifting the reference for voice pitch based on the first information to the reference for voice pitch based on the second information inputted by said input means.

72. An information communication system according to claim 71, wherein the references for voice pitch based on said first and second information comprises at least one of an average frequency, a maximum frequency, or a minimum frequency of voice pitch.

73. An information communication system according to claim 68, wherein said second communicating apparatus further comprises a detachable storage medium with voice tone data stored therein, reads out voice tone data from said storage medium and stores the voice tone data in said voice tone data storing means.

74. An information communication system according to claim 68, wherein said second communicating apparatus receives voice tone data through a communication line from an external device and stores the voice tone data in said voice tone data storing means.

75. An information communication system according to claim 68, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

76. An information communication system according to claim 75, wherein said other information is image information and music information or the like.

77. An information communication system according to claim 68 further comprising a processing apparatus for making and editing voice-generating information, such apparatus comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

78. An information processing apparatus according to claim 77 for making and editing voice-generating information used in the information communication system, wherein said making means makes a first information indicating a reference for pitch of a voice in a state when the first information is included in said voice-generating information.

79. An information processing apparatus according to claim 77, wherein said making means comprises a changing means for changing said information at an arbitrary point of time.

80. An information processing apparatus according to claim 77 for making and editing voice-generating information used in said information communication system; wherein said making means includes said control information in said voice-generating information when said voice-generating information is made.

81. An information communication system with a first communicating apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information containing data for phonemes, meters, and attributes of a voice as information; and a first communicating means for transferring the file information stored in said file information storing means to said second communicating apparatus according to a request from said second communicating apparatus; and also wherein said second communicating apparatus comprises:

a voice tone data storing means for storing therein voice tone data indicating sound parameters for each raw voice element correlated to information indicating attributes of the voice tone;

a second communicating means for issuing a request for transfer of file information stored in said file information storing means to said first communicating apparatus and then receiving the file information transferred from said first communicating means;

a verifying means for comparing information indicating an attribute of a voice tone in the voice-generating information of the file information received by said second communicating means to the information indicating attributes of various types of voice tone stored in said voice tone data storing means to obtain a similarity of the voice tones;

a selecting means for selecting voice tone data having the high similarity from a plurality of types of voice tone data stored in said voice tone storing means according to the similarity obtained by said verifying means;

a developing means for developing meter patterns successively in the direction of a time axis according to said voice-generating information; and a voice reproducing means for generating a voice waveform according to the meter patterns developed by said developing means as well as to the voice tone data selected by said selecting means.

82. An information communication system according to claim 81, wherein said information indicating an attribute is at least one of data on sex, age, a reference for voice pitch, clearness, and naturality.

83. An information communication system according to claim 81, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

84. An information communication system according to claim 83, wherein the references for voice pitch based on said first and second information comprises at least one of an average frequency, a maximum frequency, or a minimum frequency of voice pitch.

85. An information communication system according to claim 81, wherein said file information storing means stores first information indicating a reference for pitch of a voice in the state where the first information is included in said voice-generating information, said voice reproducing means has an input means for inputting a second information indicating a reference for voice pitch at an arbitrary point of time, and decides a reference for voice pitch when the voice is reproduced by shifting the reference for voice pitch based on the first information to the reference for voice pitch based on the second information inputted by said input means.

86. An information communication system according to claim 85, wherein the references for voice pitch based on said first and second information comprises at least one of an average frequency, a maximum frequency, or a minimum frequency of voice pitch.

87. An information communication system according to claim 81, wherein said second communicating apparatus further comprises a detachable storage medium with voice tone data stored therein, reads out voice tone data from said storage medium and stores the voice tone data in said voice tone data storing means.

88. An information communication system according to claim 81, wherein said second communicating apparatus receives voice tone data through a communication line from an external device and stores the voice tone data in said voice tone data storing means.

89. An information communication system according to claim 81, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

90. An information communication system according to claim 89, wherein said other information is image information and music information or the like.

91. An information communication system according to claim 81 further comprising a processing apparatus for making and editing voice-generating information, such apparatus comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

92. An information processing apparatus according to claim 91 for making and editing voice-generating information used in the information communication system, wherein said making means makes a first information indicating a reference for pitch of a voice in a state when the first information is included in said voice-generating information.

93. An information processing apparatus according to claim 91, wherein said making means comprises a changing means for changing said information at an arbitrary point of time.

94. An information processing apparatus according to claim 91 for making and editing voice-generating information used in said information communication system, wherein said making means includes said control information in said voice-generating information when said voice-generating information is made.

95. An information communication system with a first communicating apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information containing data for phonemes, meters, a type of voice tone, and attributes of voice tone as information; and a first communicating means for transferring the file information stored in said file information storing means to said second communicating apparatus according to a request from said second communicating apparatus; and also wherein said second communicating apparatus comprises:

a voice tone data storing means for storing therein voice tone data indicating sound parameters for each raw voice element correlated to the information indicating an attribute of the voice tone;

a second communicating means for issuing a request for transfer of file information stored in said file information storing means to said first communicating apparatus and then receiving the file information transferred from said first communicating means;

a retrieving means for retrieving a type of voice tone included in the voice-generating information of the file information received by said second communicating means from various types of voice tone stored in said voice tone data storing means;

a first selecting means for selecting, in a case where a type of voice tone including in said voice-generating information was obtained through retrieval by said retrieving means, voice tone data corresponding to the retrieved voice tone from various types of voice tone data stored in said voice tone data storing means;

a verifying means for verifying, in a case where a type of voice tone in the voice-generating information could not be obtained through retrieval by said retrieving means, the information indicating an attribute of voice tone in the voice-generating information stored in said file information storing means to the information indicating attributes of various types of voice tone stored in said voice tone data storing means to obtain a similarity of the voice tones;

a second selecting means for selecting voice tone data having the highest similarity from a plurality of types of voice tone data stored in said voice tone data storing means according to the similarity obtained by said verifying means;

a developing means for developing meter patterns successively in the direction of a time axis according to said voice-generating information; and a voice reproducing means for generating a voice waveform according to the meter patterns developed by said developing means as well as to the voice tone data selected by said first or second selecting means.

96. An information communication system according to claim 95, wherein said information indicating an attribute is at least one of data on sex, age, a reference for voice pitch, clearness, and naturality.

97. An information communication system according to claim 95, wherein said file information storing means stores first information indicating a reference for pitch of a voice in a state where the first information is included in said voice-generating information, said voice tone data storing means stores second information indicating a reference for pitch of a voice in the state where the second information is included in said voice tone data, and said voice reproducing means decides a reference for pitch of a voice when the voice is reproduced by shifting the reference for voice pitch based on the first information to the reference for voice pitch based on the second information.

98. An information communication system according to claim 97, wherein the references for voice pitch based on said first and second information comprises at least one of an average frequency, a maximum frequency, or a minimum frequency of voice pitch.

99. An information communication system according to claim 95, wherein said file information storing means stores first information indicating a reference for pitch of a voice in a state where the first information is included in said voice-generating information, said voice reproducing means has an input means for inputting a second information indicating a reference for voice pitch at an arbitrary point of time, and decides a reference for voice pitch when the voice is reproduced by shifting the reference for voice pitch based on the first information to the reference for voice pitch based on the second information inputted by said input means.

100. An information communication system according to claim 99, wherein the references for voice pitch based on said first and second information comprise at least one of an average frequency, a maximum frequency, or a minimum frequency of voice pitch.

101. An information communication system according to claim 95, wherein said second communicating apparatus further comprises a detachable storage medium with voice tone data stored therein, reads out voice tone data from said storage medium and stores the voice tone data in said voice tone data storing means.

102. An information communication system according to claim 95, wherein said second communicating apparatus receives voice tone data through a communication line from an external device and stores the voice tone data in said voice tone data storing means.

103. An information communication system according to claim 95, wherein said voice-generating information includes control information for synchronizing an operation according to other information in said file information to an operation by said voice reproducing means, and said voice reproducing means operates in synchronism with an operation according to other information in said file information according to the control information included in said voice-generating information when the voice is reproduced.

104. An information communication system according to claim 103, wherein said other information is image information and music information or the like.

105. An information communication system according to claim 95 further comprising a processing apparatus for making and editing voice-generating information, such apparatus comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

106. An information processing apparatus according to claim 105 for making and editing voice-generating information used in the information communication system, wherein said making means makes a first information indicating a reference for pitch of a voice in the state when the first information is included in said voice-generating information.

107. An information processing apparatus according to claim 105, wherein said making means comprises a changing means for changing said various information at an arbitrary point of time.

108. An information processing apparatus according to claim 105 for making and editing voice-generating information used in said information communication system, wherein said making means includes said control information in said voice-generating information when said voice-generating information is made.

109. An information communicating method for synthesizing a voice that is applicable to a system in which a first communicating apparatus and a second communicating apparatus are connected to a communication network, and in said first communicating apparatus, file information, including voice-generating information comprising discrete voice data for at least one of velocity and pitch of a voice correlated to a time lag between each discrete voice data, and made by providing each discrete data for at least one of velocity and pitch of a voice so that each voice data is not dependent on a time lag between phonemes and at the same time is present at a level relative to a reference, is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the voice-generating information stored in said file information storing means to said second communicating apparatus according to a request from said second communicating apparatus to said first communicating apparatus; and, in said second communicating apparatus:

selecting one voice tone data from a plurality of types of voice tone data stored in said voice tone data storing section according to voice-generating information in the file information transferred in said transferring step;

developing meter patterns successively in the direction of a time axis according to at least one of velocity and pitch of a voice included in said voice-generating information and a time lag therebetween; and reproducing a voice by generating a voice waveform according to the meter pattern developed in said developing step as well as to the voice tone data selected in said selecting step.

110. An information communicating method according to claim 109, further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

111. An information communicating method according to claim 110, wherein the references for voice pitch based on said first and second information comprise at least one of an average frequency, a maximum frequency, or a minimum frequency of voice pitch.

112. An information communicating method according to claim 109, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

113. An information communicating method according to claim 112, wherein the references for voice pitch based on said first and second information comprise at least one of an average frequency, a maximum frequency, or a minimum frequency of voice pitch.

114. An information communicating method according to claim 109, further comprising connecting to said second communicating apparatus a detachable storage medium with voice tone data stored therein, reading out voice tone data from said storage medium and storing the voice tone data in said voice tone data storing section.

115. An information communicating method according to claim 109, further comprising receiving by said second communicating apparatus voice tone data through a communication line from an external device and storing the voice tone data in said voice tone data storing section.

116. An information communicating method according to claim 109, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

117. An information communicating method according to claim 116, wherein said other information comprises image information, music information or the like.

118. An information communicating method according to claim 109, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

119. An information communicating method according to claim 118, wherein said making step comprises changing said various information at an arbitrary point of time.

120. An information processing method according to claim 118 for making and editing voice-generating information used in said information communicating method, wherein said control information is included in said voice-generating information when said voice-generating information is made in said making step.

121. An information communicating method for synthesizing a voice that is applicable to a system in which a first communicating apparatus and a second communicating apparatus are connected to a communication network, and in said first communicating apparatus, file information, including voice-generating information comprising discrete voice data for at least one of velocity and pitch of a voice correlated to a time lag and data for a type of voice tone inserted between each discrete voice data, and made by providing each discrete data for at least one of velocity and pitch of a voice so that each voice data is not dependent on a time lag between phonemes and at the same time present at a level relative to a reference, is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the file information stored in said file information storing means to said second communicating apparatus according to a request from said second communicating apparatus to said first communicating apparatus; and in said second communication apparatus:

selecting voice tone data corresponding to a type of voice tone in the voice-generating information of the file information transferred in said transferring step from a plurality of types of voice tone data stored in said voice tone data storing section;

developing meter patterns successively in the direction of a time axis according to at least one of velocity and pitch of a voice included in said voice-generating information and a time lag therebetween; and reproducing a voice by generating a voice waveform according to the meter pattern developed in said developing step as well as to the voice tone data selected in said selecting step.

122. An information communicating method according to claim 121, further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

123. An information communicating method according to claim 122, wherein the references for voice pitch based on said first and second information comprise at least one of an average frequency, a maximum frequency, or a minimum frequency of voice pitch.

124. An information communicating method according to claim 121, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

125. An information communicating method according to claim 124, wherein the references for voice pitch based on said first and second information comprise at least one of an average frequency, a maximum frequency, or a minimum frequency of voice pitch.

126. An information communicating method according to claim 121, further comprising connecting to said second communicating apparatus a detachable storage medium with voice tone data stored therein, reading out voice tone data from said storage medium and storing the voice tone data in said voice tone data storing section.

127. An information communicating method according to claim 121, further comprising receiving by said second communicating apparatus voice tone data through a communication line from an external device and storing the voice tone data in said voice tone data storing section.

128. An information communicating method according to claim 121, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

129. An information communicating method according to claim 128, wherein said other information comprises image information and music information or the like.

130. An information communicating method according to claim 121, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

131. An information communicating method according to claim 130, wherein said making step comprises changing said various information at an arbitrary point of time.

132. An information processing method according to claim 130 for making and editing voice-generating information used in said information communicating method, wherein said control information is included in said voice-generating information when said voice-generating information is made in said making step.

133. An information communicating method for synthesizing a voice that is applicable to a system in which a first communicating apparatus and a second communicating apparatus are connected to a communication network, and in said first communicating apparatus, file information, including voice-generating information comprising discrete voice data for at least one of velocity and pitch of a voice correlated to a time lag between each discrete voice data and data for attributes of the voice tone inserted between each discrete voice data, and made by providing, each discrete data for at least one of velocity and pitch of a voice so that each voice is not dependent on a time lag between phonemes and at the same time is present at a level relative to a reference, is previously stored in a file information storing section, and in said second communicating apparatus, voice tone data each indicating sound parameters for each raw voice element correlated to information indicating attributes of the voice tone is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the file information stored in said file information storing means to said second communicating apparatus according to a request from said second communicating apparatus to said first communicating apparatus; and in said second communication apparatus:

verifying information indicating attributes of a voice tone included in voice-generating information in the file information transferred in said transferring step to information indicating attributes of each type of voice tone stored in said voice tone data storing section to obtain similarity of the voice tone;

selecting voice tone data having the highest similarity from a plurality of types of voice tone data stored in said voice tone data storing section according to the similarity obtained in said verifying step;

developing meter patterns successively in the direction of a time axis according to at least one of velocity and pitch of a voice included in said voice-generating information and a time lag therebetween; and reproducing a voice by generating a voice waveform according to the meter pattern developed in said developing step as well as to the voice tone data selected in said selecting step.

134. An information communicating method according to claim 133, wherein said information indicating an attribute at least one of data on sex, age, a reference for voice pitch, clearness, and naturality.

135. An information communicating method according to claim 133, further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

136. An information communicating method according to claim 135, wherein the references for voice pitch based on said first and second information comprise at least one of an average frequency, a maximum frequency, or a minimum frequency of voice pitch.

137. An information communicating method according to claim 133, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

138. An information communicating method according to claim 137, wherein the references for voice pitch based on said first and second information comprise at least one of an average frequency, a maximum frequency, or a minimum frequency of voice pitch.

139. An information communicating method according to claim 133, further comprising connecting to said second communicating apparatus a detachable storage medium with voice tone data stored therein, reading out voice tone data from said storage medium and storing the voice tone data in said voice tone data storing section.

140. An information communicating method according to claim 133, further comprising receiving by said second communicating apparatus voice tone data through a communication line from an external device and storing the voice tone data in said voice.

141. An information communicating method according to claim 133, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

142. An information communicating method according to claim 141, wherein said other information comprises image information, music information or the like.

143. An information communicating method according to claim 133, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

144. An information processing method according to claim 143, wherein said making step comprises changing said various information at an arbitrary point of time.

145. An information processing method according to claim 143 for making and editing voice-generating information used in said information communicating method, wherein said control information is included in said voice-generating information when said voice-generating information is made in said making step.

146. An information communicating method for synthesizing a voice that is applicable to a system in which a first communicating apparatus and a second communicating apparatus are connected to a communication network, and in said first communicating apparatus, file information, including voice-generating information comprising discrete voice data for at least one of velocity and pitch of a voice correlated to a time lag between each discrete voice data, data on a type of the voice tone, and an attribute of the voice tone, and made by providing, each discrete data for at least one of velocity and pitch of a voice so that each voice data is not dependent on a time lag between phonemes and at the same time is present at a level relative to a reference, is previously stored in a file information storing section, and in said second communicating apparatus, voice tone data each indicating sound parameters for each raw voice element correlated to information indicating attributes of the voice tone is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the file information stored in said file information storing means to said second communicating apparatus according to a request from said second communicating apparatus to said first communicating apparatus; and, in said second communicating apparatus:

retrieving a type of voice tone in the voice-generating information of the file information transferred in said transferring step from various types of voice tone stored in said voice tone data storing means;

firstly selecting, in a case where a type of voice tone in said voice-generating information was obtained through retrieval in said retrieving step, voice tone data corresponding to the obtained type of voice tone from various types of voice tone data stored in said voice tone data storing means;

verifying, in a case where a type of voice tone in the voice-generating information was not obtained through retrieval in said retrieving step, information indicating an attribute of the voice tone in the voice-generating information stored in said file information storing section to information indicating attributes of various types of voice tone stored in said voice tone data storing section to obtain similarity of the voice tone;

secondly selecting voice tone data with the highest similarity from a plurality of types of voice tone data stored in said voice tone data storing section according to the similarity obtained in said verifying step;

developing meter patterns successively in the direction of a time axis according to at least one of velocity and pitch of a voice included in said voice-generating information and a time lag therebetween; and reproducing a voice by generating a voice waveform according to the meter pattern developed in said developing step as well as to the voice tone data selected in said selecting step.

147. An information communicating method according to claim 146, wherein said information indicating an attribute is at least one of data on sex, age, a reference for voice pitch, clearness, and naturality.

148. An information communicating method according to claim 146, further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

149. An information communicating method according to claim 148, wherein the references for voice pitch based on said first and second information comprise at least one of an average frequency, a maximum frequency, or a minimum frequency of voice pitch.

150. An information communicating method according to claim 146, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

151. An information communicating method according to claim 150, wherein the references for voice pitch based on said first and second information comprise at least one of an average frequency, a maximum frequency, or a minimum frequency of voice pitch.

152. An information communicating method according to claim 146, further comprising connecting to said second communicating apparatus a detachable storage medium with voice tone data stored therein, reading out voice tone data from said storage medium and storing the voice tone data in said voice tone data storing section.

153. An information communicating method according to claim 146, wherein said second communicating apparatus receives voice tone data through a communication line from an external device and storing the voice tone data in said voice tone data storing section.

154. An information communicating method according to claim 146, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

155. An information communicating method according to claim 154, wherein said other information comprises image information, music information or the like.

156. An information communicating method according to claim 146, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

157. An information communicating method according to claim 156, wherein said making step comprises changing said various information at an arbitrary point of time.

158. An information processing method according to claim 156 for making and editing voice-generating information used in said information communicating method, wherein said control information is included in said voice-generating information when said voice-generating information is made in said making step;

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

159. An information communicating method for synthesizing a voice that is applicable to a system in which a first communicating apparatus and a second communicating apparatus are connected to a communication network, and in said first communicating apparatus, file information, including voice-generating information, containing data for phonemes and meters as information is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the voice-generating information stored in said file information storing means to said second communicating apparatus according to a request from said second communicating apparatus to said first communicating apparatus; and, in said second communicating apparatus:

selecting one voice tone data from a plurality of types of voice tone data stored in said voice tone data storing section according to voice-generating information in the file information transferred in said transferring step;

developing meter patterns successively in the direction of a time axis according to said voice-generating information; and reproducing a voice by generating a voice waveform according to the meter pattern developed in said developing step as well as to the voice tone data selected in said selecting step.

160. An information communicating method according to claim 159, further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

161. An information communicating method according to claim 160, wherein the references for voice pitch based on said first and second information comprise at least one of an average frequency, a maximum frequency, or a minimum frequency of voice pitch.

162. An information communicating method according to claim 159, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

163. An information communicating method according to claim 162, wherein the references for voice pitch based on said first and second information comprise at least one of an average frequency, a maximum frequency, or a minimum frequency of voice pitch.

164. An information communicating method according to claim 159, further comprising connecting to said second communicating apparatus a detachable storage medium with voice tone data stored therein, reading out voice tone data from said storage medium and storing the voice tone data in said voice tone data storing section.

165. An information communicating method according to claim 159, further comprising receiving by said second communicating apparatus voice tone data through a communication line from an external device and storing the voice tone data in said voice tone data storing section.

166. An information communicating method according to claim 159, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

167. An information communicating method according to claim 166, wherein said other information comprises image information, music information or the like.

168. An information communicating method according to claim 159, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

169. An information communicating method according to claim 168, wherein said making step comprises changing said various information at an arbitrary point of time.

170. An information processing method according to claim 168 for making and editing voice-generating information used in said information communicating method, wherein said control information is included in said voice-generating information when said voice-generating information is made in said making step.

171. An information communicating method for synthesizing a voice that is applicable to a system in which a first communicating apparatus and a second communicating apparatus are connected to a communication network, and in said first communicating apparatus, file information, including voice-generating information containing data for phonemes, meters and types of a voice tone as information, is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the voice-generating information stored in said file information storing means to said second communicating apparatus according to a request from said second communicating apparatus to said first communicating apparatus; and in said second communicating apparatus:

selecting voice tone data corresponding to a type of voice tone in the voice-generating information of the file information transferred in said transferring step from a plurality of types of voice tone data stored in said voice tone data storing section;

developing meter patterns successively in the direction of a time axis according to said voice-generating information; and reproducing a voice by generating a voice waveform according to the meter pattern developed in said developing step as well as to the voice tone data selected in said selecting step.

172. An information communicating method according to claim 171, further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

173. An information communicating method according to claim 172, wherein the references for voice pitch based on said first and second information comprise at least one of an average frequency, a maximum frequency, or a minimum frequency of voice pitch.

174. An information communicating method according to claim 171, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

175. An information communicating method according to claim 174, wherein the references for voice pitch based on said first and second information comprise at least one of an average frequency, a maximum frequency, or a minimum frequency of voice pitch.

176. An information communicating method according to claim 171, further comprising connecting to said second communicating apparatus a detachable storage medium with voice tone data stored therein, reading out voice tone data from said storage medium and storing the voice tone data in said voice tone data storing section.

177. An information communicating method according to claim 171, further comprising receiving by said second communicating apparatus voice tone data through a communication line from an external device and storing the voice tone data in said voice tone data storing section.

178. An information communicating method according to claim 171, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

179. An information communicating method according to claim 178, wherein said other information comprises image information, music information or the like.

180. An information communicating method according to claim 171, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

181. An information communicating method according to claim 180, wherein said making step comprises changing said various information at an arbitrary point of time.

182. An information processing method according to claim 180 for making and editing voice-generating information used in said information communicating method, wherein said control information is included in said voice-generating information when said voice-generating information is made in said making step.

183. An information communicating method for synthesizing a voice that is applicable to a system in which a first communicating apparatus and a second communicating apparatus are connected to a communication network, and in said first communicating apparatus, file information, including voice-generating information containing data for phonemes, meters and an attribute of a voice tone as information is previously stored in a file information storing section, an in said second communicating apparatus, voice tone data each indicating sound parameters for each raw voice element correlated to information indicating an attribute of the voice is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the file information stored in said file information storing means to said second communicating apparatus according to a request from said second communicating apparatus to said first communicating apparatus; and in said second communicating apparatus:

verifying information indicating an attribute of a voice tone in the voice-generating information of the file information transferred in said transferring set to the information indicating attributes of various types of voice tone stored in said voice tone data storing section to obtain similarity of the voice tone;

selecting voice tone data having the high similarity from a plurality of types of voice tone data stored in said voice tone storing section according to the similarity obtained in said verifying step;

developing meter patterns successively in the direction of a time axis according to said voice-generating information; and reproducing a voice by generating a voice waveform according to the meter pattern developed in said developing step as well as to the voice tone data selected in said selecting step.

184. An information communicating method according to claim 183, wherein said information indicating an attribute is at least one of data on sex, age, a reference for voice pitch, clearness, and naturality.

185. An information communicating method according to claim 183, further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

186. An information communicating method according to claim 185, wherein the references for voice pitch based on said first and second information comprise at least one of an average frequency, a maximum frequency, or a minimum frequency of voice pitch.

187. An information communicating method according to claim 183, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

188. An information communicating method according to claim 187, wherein the references for voice pitch based on said first and second information comprise at least one of an average frequency, a maximum frequency, or a minimum frequency of voice pitch.

189. An information communicating method according to claim 183, further comprising connecting to said second communicating apparatus a detachable storage medium with voice tone data stored therein, reading out voice tone data from said storage medium and storing the voice tone data in said voice tone data storing section.

190. An information communicating method according to claim 183, further comprising receiving by said second communicating apparatus voice tone data through a communication line from an external device and storing the voice tone data in said voice tone data storing section.

191. An information communicating method according to claim 183, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

192. An information communicating method according to claim 191, wherein said other information comprises image information, music information or the like.

193. An information communicating method according to claim 183, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

194. An information communicating method according to claim 193, wherein said making step comprises changing said various information at an arbitrary point of time.

195. An information processing method according to claim 193 for making and editing voice-generating information used in said information communicating method, wherein said control information is included in said voice-generating information when said voice-generating information is made in said making step.

196. An information communicating method for synthesizing a voice that is applicable to a system in which a first communicating apparatus and a second communicating apparatus are connected to a communication network, and in said first communicating apparatus, file information, including voice-generating information containing data for phonemes, meters, a type of voice tone, and an attribute of a voice tone as information, is previously stored in a file information storing section, and in said second communicating apparatus, voice tone data each indicating sound parameters for each raw voice element correlated to information indicating an attribute of the voice, is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the steps of:

transferring the file information stored in said file information storing section to said second communicating apparatus according to a request from said second communicating apparatus to said first communicating apparatus; and in said second communicating apparatus;

retrieving a type of voice tone in the voice-generating information of the file information transferred in said transferring step from a plurality of types of voice tone stored in said voice tone data storing section;

firstly selecting, in a case where a type of voice tone in said voice-generating information was obtained through retrieval in said retrieving step, voice tone data corresponding to the obtained type of voice tone from said plurality of types of voice tone data stored in said voice tone data storing section;

verifying, in a case where a type of voice tone in the voice-generating information was not obtained through retrieval in said retrieving step, information indicating an attribute of the voice tone in the voice-generating information stored in said file information storing section to information indicating attributes of various types of voice tone stored in said voice tone data storing section to obtain similarity of the voice tone;

secondly selecting voice tone data with the highest similarity from a plurality of types of voice tone data stored in said voice tone data storing section according to the similarity obtained in said verifying step;

developing meter patterns successively in the direction of a time axis according to said voice-generating information; and reproducing a voice by generating a voice waveform according to the meter pattern developed in said developing step as well as to the voice tone data selected in said selecting step.

197. An information communicating method according to claim 196, wherein said information indicating an attribute is at least one of data on sex, age, a reference for voice pitch, clearness, and naturality.

198. An information communicating method according to claim 196 further comprising: storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

199. An information communicating method according to claim 198, wherein the references for voice pitch based on said first and second information comprise at least one of an average frequency, a maximum frequency, or a minimum frequency of voice pitch.

200. An information communicating method according to claim 196, further comprising: storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

201. An information communicating method according to claim 200, wherein the references for voice pitch based on said first and second information comprise at least one of an average frequency, a maximum frequency, or a minimum frequency of voice pitch.

202. An information communicating method according to claim 196, further comprising connecting to said second communicating apparatus a detachable storage medium with voice tone data stored therein, reading out voice tone data from said storage medium and storing the voice tone data in said voice tone data storing section.

203. An information communicating method according to claim 196, further comprising receiving by said second communicating apparatus voice tone data through a communication line from an external device and storing the voice tone data in said voice tone data storing section.

204. An information communicating method according to claim 196, wherein said voice-generating information includes control information for synchronizing an operation according to other information in said file information to an operation in said voice reproducing step, and the operation in said voice reproducing step is synchronized to an operation based on other information in said file information according to the control information included in said voice-generating information.

205. An information communicating method according to claim 204, wherein said other information comprises image information, music information or the like.

206. An information communicating method according to claim 196, wherein a third communicating apparatus is connected to said communication network, further comprising processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

207. An information communicating method according to claim 206, wherein said making step comprises changing said various information at an arbitrary point of time.

208. An information processing method according to claim 206 for making and editing voice-generating information used in said information communicating method, wherein said control information is included in said voice-generating information when said voice-generating information is made in said making step.

209. An information processing method according to claim 206 for making and editing voice-generating information used in said information communicating method, wherein a first information indicating a reference for voice pitch is made in the state where the first information is included in said voice-generating information in said making step.

210. An information communication system with a first communication apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information comprising discrete voice data for at least one of velocity and pitch of a voice correlated to a time lag between each discrete voice data, and made by dispensing each discrete data for either one of or both velocity and pitch of a voice so that each voice data is not dependent on a time lag between phonemes and at the same time present at a level relative to a reference; and an information processing apparatus for making and editing voice-generating information used in the information communication system comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

211. An information processing apparatus according to claim 210 for making and editing voice-generating information used in said information communication system, wherein said making means makes a first information indicating a reference for pitch of a voice in a state when the first information is included in said voice-generating information.

212. An information processing apparatus according to claim 210 for making and editing voice-generating information used in said information communication system, wherein said making means comprises a changing means for changing said information at an arbitrary point of time.

213. An information processing apparatus according to claim 210 for making and editing voice-generating information used in said information communication system, wherein said making means includes said control information in said voice-generating information when said voice-generating information is made.

214. An information communication system with a first communicating apparatus and a second communicating apparatus each connected to a communication network for executing data communications between said first communicating apparatus and second communicating apparatus through said communication network, wherein said first communicating apparatus comprises:

a file information storing means for storing therein file information including voice-generating information containing data for phonemes, meters, a type of voice tone, and attributes of voice tone as information; and wherein said information communication system further comprises a processing apparatus for making and editing voice-generating information, such apparatus comprising:

a voice inputting means for inputting a natural voice;

a making means for making said voice-generating information based on the natural voice inputted by said voice inputting means; and a registering/transferring means for issuing a request for registration of the file information including the voice-generating information made by said making means to said first communicating apparatus and transferring the file information including said voice-generating information made thereby to said first communicating apparatus to register the file information in said file information storing means of said first communicating apparatus.

215. An information processing apparatus according to claim 214 for making and editing voice-generating information used in the information communication system, wherein said making means makes a first information indicating a reference for pitch of a voice in the state when the first information is included in said voice-generating information.

216. An information processing apparatus according to claim 214, wherein said making means comprises a changing means for changing said various information at an arbitrary point of time.

217. An information processing apparatus according to claim 214 for making and editing voice-generating information used in said information communication system, wherein said making means includes said control information in said voice-generating information when said voice-generating information is made.

218. An information communicating method for synthesizing a voice that is applicable to a system in which at least a first communicating apparatus and a second communicating apparatus are connected to a communication network, and in said first communicating apparatus, file information, including voice-generating information comprising discrete voice data for at least one of velocity and pitch of a voice correlated to a time lag between each discrete voice data, and made by providing each discrete data for at least one of velocity and pitch of a voice so that each voice data is not dependent on a time lag between phonemes and at the same time is present at a level relative to a reference, is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said information communicating method comprising the processing for making and editing voice-generating information including the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

219. An information communicating method according to claim 218, wherein said making step comprises changing said various information at an arbitrary point of time.

220. An information processing method according to claim 218 for making and editing voice-generating information used in said information communicating method, wherein said control information is included in said voice-generating information when said voice-generating information is made in said making step.

221. A computer readable medium from which a computer can read out a program enabling execution of an information communicating method for synthesizing a voice that is applicable to a system in which at least a first communicating apparatus and a second communicating apparatus are connected to a communication network, and in said first communicating apparatus, file information, including voice-generating information comprising discrete voice data for at least one of velocity and pitch of a voice correlated to a time lag between each discrete voice data, and made by providing each discrete data for at least one of velocity and pitch of a voice so that each voice data is not dependent on a time lag between phonemes and at the same time is present at a level relative to a reference, is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said program for making and editing voice-generating information including:

a sequence for inputting a natural voice;

a sequence for making said voice-generating information based on the natural voice inputted in said voice inputting step; and a sequence for issuing a request for registration of the file information including the voice-generating information made in said making step to said first communicating apparatus and transferring the file information including said voice-generating information made thereby to said first communicating apparatus to register the file information in said file information storing section of said first communicating apparatus.

222. A computer readable medium according to claim 221, wherein said sequence for making comprises a sequence for changing said various information at an arbitrary point of time.

223. A computer readable medium according to claim 221 for making and editing voice-generating information used in said information communicating method, wherein said control information is included in said voice-generating information when said voice-generating information is made in response to said sequence for making.

224. A computer readable medium from which a computer can read out a program enabling execution of an information communicating method for synthesizing a voice that is applicable to a system in which a first communicating apparatus and a second communicating apparatus are connected to a communication network, and in said first communicating apparatus, file information, including voice-generating information comprising discrete voice data for at least one of velocity and pitch of a voice correlated to a time lag between each discrete voice data, and made by providing each discrete data for at least one of velocity and pitch of a voice so that each voice data is not dependent on a time lag between phonemes and at the same time is present at a level relative to a reference, is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said program comprising:

a sequence for transferring the voice-generating information stored in said file information storing means to said second communicating apparatus according to a request from said second communicating apparatus to said first communicating apparatus; and, in said second communicating apparatus:

a sequence for selecting one voice tone data from a plurality of types of voice tone data stored in said voice tone data storing section according to voice-generating information in the file information transferred in said transferring step;

a sequence for developing meter patterns successively in the direction of a time axis according to at least one of velocity and pitch of a voice included in said voice-generating information and a time lag therebetween; and a sequence for reproducing a voice by generating a voice waveform according to the meter pattern developed in said developing step as well as to the voice tone data selected in said selecting step.

225. A computer readable medium according to claim 224 further comprising:

a sequence for storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

226. A computer readable medium according to claim 224 further comprising:

a sequence for storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

227. A computer readable medium according to claim 224 further comprising:

a sequence for connecting to said second communicating apparatus a detachable storage medium with voice tone data stored therein, reading out voice tone data from said storage medium and storing the voice tone data in said voice tone data storing section.

228. A computer readable medium according to claim 224 further comprising:

a sequence for receiving by said second communicating apparatus voice tone data through a communication line from an external device and storing the voice tone data in said voice tone data storing section.

229. A computer readable medium according to claim 228 further comprising:

a sequence for processing for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

230. A computer readable medium according to claim 229, wherein said making step comprises changing said various information at an arbitrary point of time.

231. A computer readable medium according to claim 224, wherein said voice tone data comprises at least one of voice tone type and voice tone attributes.

232. A computer readable medium from which a computer can read out a program enabling execution of an information communicating method for synthesizing a voice that is applicable to a system in which a first communicating apparatus and a second communicating apparatus are connected to a communication network, and in said first communicating apparatus, file information, including voice-generating information, containing data for phonemes and meters as information is previously stored in a file information storing section, and in said second communicating apparatus, voice tone data each indicating sound parameters for each raw voice element is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said program comprising:

a sequence for transferring the voice-generating information stored in said file information storing means to said second communicating apparatus according to a request from said second communicating apparatus to said first communicating apparatus; and, in said second communicating apparatus:

a sequence for selecting one voice tone data from a plurality of types of voice tone data stored in said voice tone data storing section according to voice-generating information in the file information transferred in said transferring step;

a sequence for developing meter patterns successively in the direction of a time axis according to said voice-generating information; and a sequence for reproducing a voice by generating a voice waveform according to the meter pattern developed in said developing step as well as to the voice tone data selected in said selecting sequence.

233. A computer readable medium according to claim 232, further comprising:

the sequence of storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing sequence.

234. A computer readable medium according to claim 232, further comprising:

a sequence for storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input sequence.

235. A computer readable medium according to claim 232, further comprising:

a sequence for connecting to said second communicating apparatus a detachable storage medium with voice tone data stored therein, reading out voice tone data from said storage medium and storing the voice tone data in said voice tone data storing section.

236. A computer readable medium according to claim 232, further comprising:

a sequence for receiving by said second communicating apparatus voice tone data through a communication line from an external device and storing the voice tone data in said voice tone data storing section.

237. A computer readable medium according to claim 232, further comprising:

a sequence for making and editing voice-generating information comprising the steps of:

inputting a natural voice;

making said voice-generating information based on the natural voice inputted in said voice inputting step; and issuing a request for registration of the file information including the voice-generating information made in said making step to said first communicating apparatus and transferring the file information including said voice-generating information made thereby to said first communicating apparatus to register the file information in said file information storing section of said first communicating apparatus.

238. A computer readable medium according to claim 237, wherein said making sequence comprises changing said various information at an arbitrary point of time.

239. A computer readable medium from which a computer can read out a program enabling execution of an information communicating method for synthesizing a voice that is applicable to a system in which a first communicating apparatus and a second communicating apparatus are connected to a communication network, and in said first communicating apparatus, file information, including voice-generating information containing data for phonemes, meters, a type of voice tone, and an attribute of a voice tone as information, is previously stored in a file information storing section, and in said second communicating apparatus, voice tone data each indicating sound parameters for each raw voice element correlated to information indicating an attribute of the voice, is previously stored in a voice tone data storing section, and a voice is synthesized according to voice-generating information in the file information stored in said file information storing section as well as to voice tone data stored in said voice tone data storing section by executing data communications between said first communicating apparatus and said second communicating apparatus through said communication network, said program coprising:

a sequence for transferring the file information stored in said file information storing section to said second communicating apparatus according to a request from said second communicating apparatus to said first communicating apparatus; and in said second communicating apparatus;

a sequence for retrieving a type of voice tone in the voice-generating information of the file information transferred in said transferring step from a plurality of types of voice tone stored in said voice tone data storing section;

a sequence for firstly selecting, in a case where a type of voice tone in said voice-generating information was obtained through retrieval in said retrieving step, voice tone data corresponding to the obtained type of voice tone from said plurality of types of voice tone data stored in said voice tone data storing section;

a sequence for verifying, in a case where a type of voice tone in the voice-generating information was not obtained through retrieval in said retrieving step, information indicating an attribute of the voice tone in the voice-generating information stored in said file information storing section to information indicating attributes of various types of voice tone stored in said voice tone data storing section to obtain similarity of the voice tone;

a sequence for secondly selecting voice tone data with the highest similarity from a plurality of types of voice tone data stored in said voice tone data storing section according to the similarity obtained in said verifying step;

a sequence for developing meter patterns successively in the direction of a time axis according to said voice-generating information; and a sequence for reproducing a voice by generating a voice waveform according to the meter pattern developed in said developing step as well as to the voice tone data selected in said selecting step.

240. A computer readable medium according to claim 239, further comprising:

the sequence of storing in said file information storing section first information indicating a reference for voice pitch in a state where the first information is included in said voice-generating information, and storing in said voice tone data storing section second information indicating a reference for voice pitch in a state where the second information is included in the voice tone data, and providing a reference for voice pitch when a voice is reproduced by shifting the reference for voice pitch based on said first information to the reference for voice pitch based on said second information in said voice reproducing step.

241. A computer readable medium according to claim 239, further comprising:

the sequence of storing in said file information storing section first information indicating a reference for voice pitch in a state where the first information is included in said voice-generating information, and wherein said voice reproducing step includes an input step for inputting second information indicating a reference for voice pitch at an arbitrary point of time, and providing a reference for voice pitch when a voice is reproduced is decided by shifting the reference for voice pitch based on said first information to the reference for voice pitch based on the second information inputted in said input step.

242. A computer readable medium according to claim 239, further comprising:

the sequence of connecting to said second communicating apparatus a detachable storage medium with voice tone data stored therein, reading out voice tone data from said storage medium and storing the voice tone data in said voice tone data storing section.

243. A computer readable medium according to claim 239, further comprising:

the sequence of receiving by said second communicating apparatus voice tone data through a communication line from an external device and storing the voice tone data in said voice tone data storing section.

* * * * *